US011926471B2

(12) United States Patent
Loh

(10) Patent No.: US 11,926,471 B2
(45) Date of Patent: Mar. 12, 2024

(54) SECTIONAL PANEL TANK

(71) Applicant: POLY-LINE PTE LTD, Singapore (SG)

(72) Inventor: Chin Kiat Loh, Singapore (SG)

(73) Assignee: POLY-LINE PTE LTD, Singapore (SG)

( * ) Notice: Subject to any disclaimer, the term of this patent is extended or adjusted under 35 U.S.C. 154(b) by 146 days.

(21) Appl. No.: 17/599,572

(22) PCT Filed: Nov. 20, 2020

(86) PCT No.: PCT/SG2020/050677
§ 371 (c)(1),
(2) Date: Sep. 29, 2021

(87) PCT Pub. No.: WO2021/101448
PCT Pub. Date: May 27, 2021

(65) Prior Publication Data

US 2022/0161993 A1 May 26, 2022

(30) Foreign Application Priority Data

Nov. 21, 2019 (SG) ..... 10201910976U
Dec. 26, 2019 (MY) ..... PI2019007789
(Continued)

(51) Int. Cl.
*B65D 90/02* (2019.01)
*B65D 88/08* (2006.01)
(Continued)

(52) U.S. Cl.
CPC ..... *B65D 90/023* (2013.01); *B65D 88/08* (2013.01); *B65D 90/022* (2013.01);
(Continued)

(58) Field of Classification Search
CPC ..... B65D 2590/02; B65D 2590/04; B65D 90/023; B65D 88/08; B65D 90/022;
(Continued)

(56) References Cited

U.S. PATENT DOCUMENTS 1,427,166 A * 8/1922 Parton ..... B65D 90/08 220/672
1,943,191 A * 1/1934 Schwemlein ..... B65D 90/08 220/4.12
(Continued)

FOREIGN PATENT DOCUMENTS

DE 1481070 A1 2/1969
DE 2321953 A1 11/1974
(Continued)

*Primary Examiner* — Kareen K Thomas
(74) *Attorney, Agent, or Firm* — Idea Intellectual Limited; Margaret A. Burke; Sam T. Yip

(57) ABSTRACT

A sectional panel tank comprises one or more side wads that are joined together in forming the sectional panel tank. One of the side wall comprises a first unit panel having a first extension at a first edge of the first unit panel and a second unit panel having a second extension at a second edge of the second unit panel. By combing the second extension to the second extension, the second unit panel is joined to the first unit panel for providing a continuous surface of the side wall. No gasket is needed between the first extension and the second extension. A method of making the sectional panel tank is also disclosed. A method of making prefabricated unit panels with lining sheets is further disclosed for the sectional panel tank.

30 Claims, 41 Drawing Sheets

(30) Foreign Application Priority Data

Dec. 31, 2019 (CN) ..... 201911414932.X
Dec. 31, 2019 (CN) ..... 201922481683.8
Jan. 30, 2020 (KR) ..... 10-2020-0011070

(51) Int. Cl.
*B65D 90/04* (2006.01)
*B65D 90/06* (2006.01)
*B65D 90/08* (2006.01)
*B65D 90/10* (2006.01)

(52) U.S. Cl.
CPC ..... *B65D 90/024* (2013.01); *B65D 90/027* (2013.01); *B65D 90/04* (2013.01); *B65D 90/06* (2013.01); *B65D 90/08* (2013.01); *B65D 90/10* (2013.01); *B65D 2590/0091* (2013.01); *B65D 2590/026* (2013.01)

(58) Field of Classification Search
CPC .... B65D 90/024; B65D 90/027; B65D 90/04; B65D 90/06; B65D 90/08; B65D 90/10; B65D 2590/0091; B65D 2590/026
See application file for complete search history.

(56) References Cited

U.S. PATENT DOCUMENTS 3,410,441 A * 11/1968 Rhyne ..... A47B 88/941 312/263
RE27,330 E * 4/1972 Marcmann ..... B65D 90/06 52/249
4,188,759 A * 2/1980 Liet ..... A01F 25/2009 52/192
4,244,486 A * 1/1981 Ewald, Jr. ..... B65D 88/123 220/4.12
4,376,360 A * 3/1983 Hanson ..... B65D 90/10 52/196
5,052,569 A * 10/1991 Cooper ..... B65D 90/023 220/692
5,449,081 A * 9/1995 Sjostedt ..... B62D 29/045 220/666
5,522,522 A * 6/1996 Fukumoto ..... B65D 90/022 220/62.22
5,688,086 A * 11/1997 Menzemer ..... B65D 90/0026 403/231
5,741,042 A * 4/1998 Livingston ..... B62D 29/045 296/181.6
6,244,063 B1 * 6/2001 Yates ..... F25D 23/063 62/297
9,555,959 B1 * 1/2017 Ziegs ..... B65D 88/005
2004/0107823 A1 * 6/2004 Kiley ..... F41H 5/013 86/50
2005/0229501 A1 * 10/2005 Grossman ..... B65D 88/68 52/79.9

FOREIGN PATENT DOCUMENTS

EP 0226776 A2 7/1987
GB 2000216 A 1/1979
JP 2001130692 A 5/2001
KR 20080043185 A 5/2008
KR 20130066056 A 6/2013
KR 101706038 B1 2/2017
KR 101732484 B1 5/2017
WO 2004056677 A1 7/2004
WO 2019178688 A1 9/2019

* cited by examiner (a)

(b)

SECTIONAL PANEL TANK

The present application claims the priority of earlier Singapore patent application Nr. 102019109760 that was filed on 21 Nov. 2019. The present application further claims the priority of earlier Chinese Utility Model application Nr. 201922481683.8 that was filed on 31 Dec. 2019. The present application additionally claims the priority of earlier Chinese invention patent application Nr. 201911414932.X that was filed on 31 Dec. 2019 too. The present application moreover claims the priority of earlier Korean invention patent application Nr. 10-2020-0011070 that was filed on 30 Jan. 2020. The present application besides claims the priority of earlier Malaysian patent application Nr. PI 2019 007789 that was filed on 26 Dec. 2019.

The present patent application primarily relates to a sectional panel tank for storing liquids (such as water and chemical solutions), solids, gases and sludge. The application also relates to a method of making the sectional panel tank. The application further relates to a prefabricated unit panel for assembling the sectional panel tank; and a method of making the prefabricated unit panel.

Current tanks for aggressive chemicals and hazardous wastes are prefabricated in a factory and then transported as a whole or as semi-finished parts to be assembled on site. However, known technologies of manufacturing the tanks are time consuming, machinery/labour intensive and host specific.

Meanwhile, sectional panel tanks for water are widely demanded due to their economical, scalable and potable advantages. However, the current technologies are not suitable for the water tightness due to a weakness of elastomeric gaskets or seals that join the panels together. The known sectional panel tank thus has a short term of usage although panels thereof can last much longer. The known sectional panel tanks are also limited by their poor biological and chemical resistance of panel materials, such as fiberglass, reinforced polymer, hot dipped galvanized, and stainless steel. In addition, the known sectional panel tanks cannot resist natural disasters such as earthquakes. Therefore, the present application aims to provide one or more sectional panel tanks that are more durable and scalable for storing or transporting liquids (such as water and chemical solutions), solids, gases, slurry and/or sludge securely and reliably. Alternatively speaking, the present application aims to provide a new purpose for sectional panel tank. In addition, the sectional panel tank of the subject application can resist biological and chemical hazardous materials and earthquakes.

As a first aspect, the present application discloses a sectional panel tank (i.e. panel tank, panel assembled tank or concealed container). The sectional panel tank comprises one or more side walls (i.e. sidewalls) that are joined together in forming the sectional panel tank. The side wall comprises a first unit panel having a first extension at a first edge of the first unit panel and a second unit panel having a second extension at a second edge of the second unit panel. The extensions (e.g. first extension; second extension) are also known as flanges, which may be folded or bent (e.g, at about 90°) at the edges of the unit panels respectively. The second extension and the second extension are preferably joined together contiguously by fasteners (e.g. bolts and nuts) such that no gasket is required at their contacting areas. Accordingly, the second unit panel is then connected or attached to the first unit panel for providing a continuous surface of the side wall. As a whole, the first unit panel and the second unit panel provide structural support to the side wall or the sectional panel tank. The first unit panel or the second unit panel may have various designs in terms of shape and dimensions. In some implementations, the first or the second unit panel size has a typical size of 1 meter (m)×1 meter (m) and a typical thickness of 20 millimetres (mm). It is understood to the skilled person that the thickness of the unit panel is also dependent on its materials. For example, the unit pane made of fiberglass reinforced polymers (FRP) typically has the thickness of 5 to 10 millimetres (mm); while the unit panel made of stainless steel (SUS standard) has the thickness of 2 to 4 millimetres (mm), subject to the height of the sectional tank.

The first unit panel and the second unit panel are optionally made of impermeable, corrosion resistive or resistant and structurally robust materials. For example, the unit panels or the side wall of the sectional panel tank may comprise hot pressed metals or metal alloys sheets, such as stainless steel (SUS 304 or SUS 316), mild steel (such as hot dipped galvanized (HUG) or epoxy coated), copper, bronze, brass or galvanized steel; plastics, such as polyethylene or polypropylene; and composites, such as fiberglass reinforced polymers (FRP) (FRP/SUS or HDG/SUS), or glass reinforced plastics (GRP), including rubbers, EPDM, and mixture of rubber and plastics. The unit panels made of plastics or composites are particularly suitable for chemical equipment such as tanks or vessels. For example, the chemical equipment with a size ranging from less than 1 meter to 200 meters are fabricated by FRP unit panels. In addition, the first unit panel and/or the second unit panel may be treated with any coating for additional functions, e.g. an impermeable coating (such as fluoropolymer, epoxy, phenolic, phosphate, PTFE and FFP) for water sealing; a water repellent coating (such as silicone, polyurethane and zinc) for water resisting; and a corrosion-proof or chemical resistant coating (such as PE, PP, PVDF and ECTFE) for preventing corrosion. In particular, an ultraviolet (UV) laminate or gel coating is applied onto the FRP unit panel for preventing any damage caused by ultraviolet (UV) rays and meanwhile making a smooth surface.

The first unit panel and the second unit panel have substantially similar or identical shapes (e.g. square, rectangular, hexagonal), profiles, sizes, structures, materials and/or mechanical strength so that the first and second panels can be mass produced and standardized. In addition, surfaces or contours of the first unit panel, the second unit panel, the side wall or a combination of any of these (segments, panels, walls) can be curved (e.g. 3D geometric shape or 2D geometric shape) or straight. For example, the first unit panel and the second unit panel are aligned at an angle substantially larger than 90°, 120°, 150° (e.g. around 180° for being a flat side wall).

The first unit panel and the second unit panel are joined, affixed, or fastened together either detachably or permanently. In particular, they are contiguously, directly or immediately joined with direct surface contact at and/or by the first extension and the second extension without any intermediate materials, e.g. in the absence of any gasket, mechanical seal by the at least one fastener on the first extension and the second extension. In other words, the extensions or flanges of the first and second unit panels directly contact each other without any intermediate material so that the extensions or flanges can be tightened together strongly. Therefore, the first unit panel and the second unit panel have a line of division exposed, known as a seam joint.

The first extension and the second extension may adopt any form that provides structural support to the first unit panel and the second panel respectively. In particular, the first extension and the second extension are firmly and inflexibly jointed by touching each other directly without any foreign component between their contacting surfaces in order to form the side wall in a rigid form.

In some implementations, the first extension has one or more first flanges (or any other first external or internal ridge or rim for attachment) at the edges of the first unit panel. A flange is an example of the first extension or second extension, which is an external or internal ridge of the first unit panel, the second unit pane or another panel as an extra rim or lip, which provides structural support for strength, as a flange of an iron beam, an I-beam or a T-beam; or for attachment to another object, as the flange on the end of a pipe, steam cylinder, etc., or for a flange of a rail car or tram wheel. The first flange is folded from an inner side to an external side of the first unit panel or the sectional panel tank. The external side is a side exposed to air or ambient when the sectional panel tank is filled with content. Similarly, the second extension has one or more second flanges (or any other second external or internal ridge or rim for attachment) at the edges of the second unit panel. The second flange is also folded from an inner side to an external side of the second unit panel or the sectional panel tank. As discussed above, the first flange and the second flange are firmly and inflexibly jointed by touching each other directly without any foreign component (such as a gasket) between their contacting surfaces.

In some implementations, the first extension comprises a first margin (i.e. flange) of the first unit panel at its edges; while the second extension comprises a second margin (i.e. flange) of the second unit panel at its edges. The first margin or second margin preferably comprises an engagement hole (i.e. through hole, perforation) for receiving a securing means (e.g. fastener). The first margin and the second margin are directly fastened together (e.g. stacked) for making the first unit panel and the second unit panel as a unitary piece, thereby forming the side wall of the sectional panel tank. In particular, the first margin and the second margin have substantially similar or identical materials and/or thicknesses respectively, so that the first margin and the second margin can be produced along with the first unit panel and the second unit panel respectively. The first margin or the second margin may be also known as flange.

The sectional panel tank optionally comprises a jointer (also known as a plaster, a paste or any solidified plastic material), such as polymeric welding joint applied at the seam on inner sides of the first unit panel and the second unit panel of the sectional panel tank. The jointer thus bridges a gap between the neighbouring unit panels such that the inner sides or surfaces of the first unit panel and the second unit panel form a continuous surface, which is impermeable to solid, liquid or gas. Since inner sides of the sectional tank are covered by a continuous sheet or surface of impermeable material (e.g. polymer), the sectional panel obviates the gasket sealing between flanges or unit panels. For example, if inner sides of unit panels of the sectional panel tank are covered by polymer sheets, the jointer can be provided by polymer welding by adopting the polymer similar or identical to that of the inner sides. In particular, the jointer is made of a same material as the first unit panel and the second unit panel (i.e. stainless welding on SUS panel, PP welding on homogenous PP panels). The jointer is applied for preventing any leakage of the liquid or the gas in the sectional panel tank from the seam. The jointer may be formed by any suitable method according to a specific material of the jointer. For example, a thermoplastic welding is adopted when the jointer comprises one or more thermoplastic materials. Accordingly, the jointer is alternatively known as a welding joint, a welder, a sheet joint, a surface joint, a liner joint, a polymer joint or a polymer welding joint, butt weld joint, hot gas weld joint, electro fusion weld joint, extrusion weld joint, infrared weld joint, ultrasonic weld joint, laser weld joint, etc. depending on relevant materials or methods adopted.

In some implementations, the jointer has a conductive strip applied at the seam on the inner sides of the first unit panel and the second unit panel if the inner sides have thermoplastic materials. The conductive strip has electrical conducting materials (such as carbon particles, carbon nanotubes or graphene, metal particles) which are embedded inside a thermoplastic base material (such as HDPE) and form continuous electrical conducting paths. When the conductive strip is subjected to an induction heater having an electromagnet and an electronic oscillator, a high-frequency alternating current (AC) through the electromagnet would heat the electrical conducting materials (i.e. induction heating) and further melt the thermoplastic base material for sealing the seam between the first and second unit panels. Preferably, the thermoplastic base material would permeate thorough the seam and be visually inspected externally. If the thermoplastic base material forms a continuous path at the seam from outside the first and second unit panels, the first and second unit panels are reliably connected together.

The first unit panel optionally comprises a structural panel extending between the first extensions (such as the first flanges) at the first edges of the first unit panel for resisting pressure and weight of a load inside the sectional panel tank. The structural panel may comprise any component that has a high strength and good durability under pressure (e.g. water pressure) and various environmental conditions (such as temperature, ultraviolet (UV) radiation, corrosion, wind and rain). In addition, the structural panel may also have embossments (such as a cross embossment at a center of the structural panel) for further resisting the pressure. The structural panel may have various shapes and sizes, such as a square shape with an edge of around 1.2 meter (or around 4.0 feet) or 1.0 meter in length. For another example, the structural panel has a rectangular shape with a length of 2.0 meters and a width of 1.0 meter. For another example, the structural panel has a curved shape for assembling cylindrical sectional panel tank.

The structural panel may have various structure. For example, the structural panel has a single layer made of stainless steel or fiberglass reinforced polymers (FRP). For example, the structural panel has an inner layer made of stainless steel and an exterior layer made of fiberglass reinforced polymers (FRP). In the former case, the first unit panel and the second unit panel are joined via metal welding; and in the latter case, the first unit panel and the second unit panel are joined via solvent welding. Alternatively, the structural panel has an inner layer made of fiberglass reinforced polymers (FRP) and an exterior layer made of stainless steel. Similarly, the first unit panel and the second unit panel are joined via metal welding.

The sectional panel tank optionally comprises one or more linings joined, attached, affixed, adhered or fixed onto the inner side, exterior side or both of the side wall (such as the encapsulation of the unit panel; especially in the case of partition unit panels within the tank itself where both surfaces of the unit panels are exposed to the stored content), in order to prevent biological and chemical corrosion and resultant leakage of the fluid, solid, gas or sludge stored inside the sectional panel tank. The lining may have a dimension large enough for covering an inner area of the sectional panel tank. Moreover, the lining may comprise a plurality of lining sheets. The lining sheets may have a same or various dimensions for covering the first unit panel or the second unit panel. For example, one single lining sheet is used for covering the first unit panel. Alternatively, multiple lining sheets are joined together for covering the second unit panel. In addition, the lining is optionally connected to the jointer at the seam for further strengthening the jointer. In some implementations, the lining has a thickness in a range of 0.5 millimetre (mm) to 6 millimetre (mm), such as 2~4 mm (i.e. from two to four millimetres) preferably, or 1 to 5 mm (La from one to five millimetres) preferably. One or more of the lining or linings are extendable and/or flexible. Hence, the one or more linings are able to hold water inside the sectional panel tank even if the unit panels of the sectional panel tank are broken or breached. The unique ability of holding liquid content (e.g. water or hazardous chemical solutions) is beneficial, desired and/or critical for keeping integrity of the sectional panel tank, even when the sectional panel tank experience earthquake, collision and/vibration. Another point for consideration is a "double containment system" wherein two layers of linings are formed over a same side of the unit panel, in such design, even if there is a breach from the inside, no risk would occur of exposure of the content inside the sectional panel tank to the outside. In addition, a leakage sensor can be incorporated between the two linings to detect such breach to effect timely repair. The leakage detection is particular important for storage of hazardous chemicals or waste inside the sectional panel tank.

The lining may comprise a thermoplastic material, a thermoset material or both. The thermoplastic material includes thermoplastics and thermoplastic elastomers. Thermoplastics include but are not limited to PerFluoroAlkoxy (PFA), PolyFluoroEth, Polyethylene (PE) (such as low density PE (LDPE), Cross Link PE (XLPE), High Density PE (HDPE), and Ultra High Molecular Weight Polyethylene (UHMWPE)), Polypropylene (PP) (such as PP Random (PPR)), PolyTetraFluoroEthylene (PTFE), EthyleneChloroTrifFluoroEthylene (ECTFE), PolyVinyliDeneFluoride (PVDF), Fluorinated Ethylene Propylene (FEP) and Perfluoroalkoxy Alkanes (PFA). The thermoset material includes but is not limited to EthyleneVinylalcOHol (EVOH), PolyVinylChoride (PVC), PolyStyrene (PS), PolyCarbonate (PC), PolyMethylMethAcrylate (PMMA) and Acrylonitrile Butadiene Styrene (ABS). Therefore, the lining is bound or secured to the inner side of the side wall by a hybrid joining method if the first unit panel is made of metals or metal alloys (such as stainless steel sheet) or a plastic joining if the first unit panel is made of plastic or composites. In particular, the hybrid joining comprises adhesive and solvent bonding (such as hot-metal adhesive bonding), as well as welding (such as thermal welding). The hybrid joining method is optionally conducted in combination of suitable mechanical bonding (such as gaskets) or joining methods (such as clinching or press joining). An adhesion strength of the lining to the first unit panel is optionally examined or tested by peel test and/or shear test with multiple force-extension courses.

The lining is optionally preformed (e.g. coated, moulded, adhered, attached or casted) onto the inner side, exterior side or both including the first extension (such as the flanges) of the first unit panel. The preforming process may be conducted by any suitable method accordingly to a nature of the sectional panel tank. For example, the sectional panel tank is made of metals (such as stainless steel), the preforming process is conducted by mechanical fastening, adhesive bonding, welding, moulding or a combination of any foregoing technologies.

The mechanical fastening method often uses clamping components or fasteners (such as, nuts, bolts, screws or rivets) or integrated design elements (such as snap-fit or press-fit). In addition, the mechanical fastening may also require mechanical operations such as drilling holes or making screw threads. The mechanical fastening method has several advantages such as simplicity, reliability and easy inspection and repair.

Alternatively, the adhesive bonding method optionally applies adhesives (such as heat sensitive adhesive or pressure sensitive adhesive) between the lining and the first unit panel. The adhesives bond the lining (such as polyester, fiberglass, felt, geotextile, and fabric backed liner (FBL)) and the first unit panel together by creating chemical and/or physical reactions for forming intermolecular forces at an interface of the lining and the first unit panel. The adhesive bonding method has a major advantage of homogeneously distributing internal stresses throughout both the lining and the first unit panel, especially if incorporating an intermediate layer (e.g. fabric material) between the lining and the first unit panel.

Alternatively, the coating method applies the lining as a coat onto the structural panel. For example, the coating method adopts a thermal spray coating of lining materials to the structural panel whose inner surface is cleaned and roughened before the coating process. The thermal spray coating method is suitable for a variety of materials, including metal alloys, oxide and nonoxide ceramics, plastics, cermets, and composite structures comprised of metals, ceramics, and plastics. The thermal spray coating may generate the lining of various thickness, typically from 2.5 micrometres (μm) to 6.5 millimetres (mm). In addition, the thermal spray coating method has a rapid deposition rate and low processing costs. Furthermore, the thermal spray coating does not need a high temperature and thus would not create hazardous degradation to the structural panel during the processing.

The welding method comprises shielded metal arc welding (SMAW), gas tungsten arc welding (GTAW), gas metal arc welding (GMAW), submerged arc welding (SAW), ultrasonic welding, laser welding, friction stir welding, or friction spot welding when the lining and the unit panel are made of metal materials. For example, the lining material is titanium, whilst the panel material is stainless steel. The specific welding method is selected according to chemical and physical natures of the lining material and the panel material. The specific welding method is selected according to chemical and physical natures of the lining material and the panel material.

The moulding method is conducted by firstly pre-heating the thermoplastics lining, granules or pellets to a soften state and then directly applying the soften lining onto the panel. The moulding method further comprises compression moulding, injection moulding, blow moulding, rotational moulding, extrusion moulding, and thermoforming. In contrast, the preforming process is conducted by a polymeric joining method if the unit panel is made of polymers or polymeric composites (such as Fiberglass Reinforced Polymer (FRP)). The preforming process is thus conducted by mechanical fastening, adhesive bonding, welding, solvent bonding or a combination of any foregoing technologies. The mechanical fastening method and the adhesive bonding method are generally similar to those described above for the sectional panel tank made of metals. The preforming process is applicable to FRP or metal (e.g. stainless steel), basically independent of the materials of which the unit (substrate) panel is made.

The welding method for polymers or polymeric materials comprises external heating methods including hot-gas welding, hot wedge welding, extrusion welding, hot plate welding, infrared (IR) welding and laser welding; as well as internal heating methods. The internal heating methods further comprises mechanical ways including spin welding, stir welding, vibration welding (i.e. friction welding) and ultrasonic welding; and electromagnetic ways including resistance welding (also known as implant welding or electrofusion welding), induction welding, dielectric welding and microwave welding. In addition, thermal spraying technologies are also suitable for welding of polymers or polymeric materials, including electrical means (such as plasma or arc) or chemical means (combustion flame). In particular, plasma spraying or plasma coating is adopted for welding a thin layer of polymers or polymeric materials.

The solvent bonding method is particularly suitable for preforming the lining onto the unit panel when the unit panel has a layer of thermosetting polymers. In particular, the polymers or polymeric materials are amorphous (such as PolyVinylChoride (PVC), acrylic (AK) and PolyStyrene (PS), PolyCarbonate (PC), PolyMethylMethAcrylate (PMMA) and Acrylonitrile Butadiene Styrene (ABS)). A solvent is applied at the interface of two unit panels for plasticizing the surfaces of the polymers or polymeric materials.

The lining optionally comprises a bonding layer on one surface or both surfaces of the lining. For example, the bonding layer comprises a fabric backed liner (FBL) having a thin layer of any fabric material (such as felt, polyester) to provide a rough or coarse surface for adhesives. For another example, the bonding layer comprises a thin homogenous layer of mechanical fixtures having a plurality of anchors, surface texture, extensions, legs, studs. In particular, various fillers may be embedded inside gaps between studs for specific purposes. When the fillers are porous materials (such as aerogel, rigid polyurethane (PUR), polyisocyanurate (PIR), mineral wool), the lining provides a thermal insulation function, fire resistance function, noise reduction function and a mechanical cushion function. The thermal insulation function ensures that the sectional panel tank is workable in special regions (such as high latitude countries in cold winter) or for special applications (such as spa). The mechanical cushion function ensures that the lining is tightly pushed against the unit panel under a pressure of the water stored inside the sectional panel tank. In addition, the lining may work as a matrix for holding firmly various functional particular substances inside the lining without losing the functional particles when in contact with water. For example, the lining may hold a self-cleaning particular substance (such as titanium dioxide ($TiO2$)) for removing any debris or sediments from the self-cleaning surface automatically. The self-cleaning particular substance is optionally superhydrophobic, superhydrophilic or photocatalytic. The lining may further hold an antimicrobial particular substance (such as silver nanoparticles) for killing any microbial-organism in the water.

The lining optionally comprises a fore layer (or first layer) and a base layer (or second layer). In particular, the fore layer and the base layer are co-extruded at manufacturing to form a homogenous boned liner. Typically, the fore layer and the base layer have a fore colour and a base colour respectively. The base colour is preferably distinctively different to human's eyes from the fore colour, so that any erosion, wear or destruction of an exposed fore layer of the two layers will uncover an underneath base layer of the two layers for an easy vision inspection. If the base colour is observed in the inner side of the sectional panel tank, repair or replacement is then warranted.

Both layers are joined by co-extrusion and/or The base and fore layers are optionally made of a same or similar materials for a homogenous joint. In some implementations, the total thickness is in a range from 1.0 to 6.0 millimetres (mm). The base layer and the fore layer have a base thickness and a fore thickness respectively. Typically, the fore layer thickness account for no more than 50% (such as 10% or 30%) of the total thickness.

The sectional panel tank may further comprise a thermal insulation layer for reducing temperature fluctuation of the fluid inside the sectional panel tank. The thermal insulation layer is made of thermal insulation material that slows down heat transfer by conduction or convection, especially in a thickness direction of the first unit panel. The thermal insulation material comprises fiberglass, mineral wool, cellulose, polyurethane foam, polystyrene, aerogel, pyrogel, natural fibres (such as hemp, sheep's wool, cotton and straw) and polyisocyanurate (PIR) foam. The mineral wool further comprises glass wool, rock wool and slag wool. The polystyrene also further comprises expanded polystyrene (EPS) and extruded polystyrene (XEPS). In particular, the thermal insulation material is preferred to be hydrophobic or non-absorbing to water, such as fiberglass.

The thermal insulation layer is optionally sandwiched between the unit panels and the lining. Due to its light weight, the thermal insulation layer can be held in place without further assistance. In particular, the thermal insulation layer is completely encapsulated by the unit panels and the lining such that the thermal insulation layer would be on one hand protected from external shocks and on the other hand not in touch with the liquid, solids, gas or sludge stored inside the sectional panel tank.

Alternatively, the thermal insulation layer, the external side of the first unit panel is treated or processed for being substantially reflective to light, heat, infrared wave or any other types of irradiation. In particular, since stainless steel (also known as inox steel or inox) is reflective to solar and thermal irradiations, the first unit panel made of stainless steel may achieve a same or similar reflective effect without the treatment. In addition, the reflective effect of stainless steel is further compounded by not converting wavelengths of incoming light. Therefore, solar energies carried by the incoming light are directly sent back into space substantially without atmospheric absorption, which effectively prevents re-radiation from the outside environment.

In addition to the thermal insulation layer, the sectional panel tank may also comprise a radiant barrier layer for further suppressing temperature fluctuation of the fluid inside the sectional panel tank. The radiant barrier layer is reflective to heat radiation (such as visible light or infrared waves) and thus reduces heat transfer. The radiant barrier layer optionally comprises a very thin and mirror-like aluminium foil. Alternatively, an external side first unit panel maybe treated with low heat transmission material such as chromium oxide and Iriotec pigments. It is understood to a skilled person that the thermal insulation is not to limit to heat reflection and heat dispersion layer only, a heat absorption coating on the exterior, interior or both exterior and interior can also be incorporated to keep the sectional panel tanks warm at night and/or during the winter months. In addition, a photovoltaic coating and/or laminate can also be harnessed for energy where needed.

The sectional panel tank optionally further comprises a shield layer for protecting the thermal insulation layer and the fireproofing layer. The shield layer is made of structural material resisting to loads and impacts. The structural material comprises iron, concrete, aluminium (Al), composites, masonry, timber, adobe, alloy, bamboo, carbon fibres, fiber reinforced plastics and mudbrick. The iron further comprises wrought iron, cast iron, steel and stainless steel. The concrete further comprises reinforced concrete and pre-stressed concrete. The shield layer is optionally positioned externally to the thermal insulation layer and the fireproofing layer.

The sectional panel tank optionally further comprises a cover, an access hole (e.g. manhole), a ladder or a combination of the foregoing objects. The cover is used for partially or completely covering the sectional panel tank for preventing foreign contaminates. The cover optionally comprises a plurality of cover unit panels that are assembled and/or joined together into the single unitary piece of cover. Alternatively, the cover may be a pre-fabricated part and loaded as a whole onto the side wall of the sectional panel tank. The access hole is made as an opening to access the inner space of the sectional panel tank by a worker or technician for inspection, maintenance, or even modification (e.g. upgrading). The access hole is preferably located near a periphery edge of the sectional panel tank of the cover for easy access. The ladder comprises a bottom end at or near the ground; and a top end at or slightly higher than the cover. In particular, the top end is in vicinity of the access hole such that an operator can easily get to the access hole by climbing the ladder until the top end.

The sectional panel tank optionally further comprises a framework (e.g. structural bracing) that is either detachably or permanently connected to the first unit panel, the second unit panel or both for upholding structural integrity of the sectional panel tank. For example, the structural bracing may comprise an internal bracing and/or an external bracing. The internal bracing and the external bracing is often made of steel (such as steel rods) or even polymer which can withhold the designed pressure. The framework is optionally made of wood, engineered wood, concrete, structural steel or a combination of any of these. In addition, the framework comprises a side frame detachably connected to the side wall of the sectional panel tank. The side frame may further comprise a steel beam structure, a portal frame structure (also known as goal post structure), or box frame structure (also known as picture frame structure), or a cage frame structure. The box frame structure is particularly suitable since multiple horizontal bars and multiple vertical poles are combined together to create the box frame structure. Furthermore, the framework may also comprise a roof beam detachably connected to the cover of the sectional panel tank for maintaining a shape of the cover. The framework comprises one or more rods that connects inner sides or outer sides of two opposite unit panels.

The sectional panel tank optionally further comprises an external foundation (also known as or structure) for supporting the framework. For example, the sectional panel tank comprises a concrete foundation (such as concrete flat foundation or plinth spaced at regular intervals) as the external foundation for supporting the sectional panel tank including the framework. The external foundation may also comprise a I-shaped (double-T) foundation, a slab-on-ground foundation or a frost protected foundation. One or more corner bracings (such as angle bar) are applied at the external foundation for structurally supporting the foundation. The corner bracing has a shape and a size adaptable to a specific foundation.

The framework optionally comprises at least one rod, shaft or other internal bracing that connects or fixes the inner sides of two opposite unit panels. In contrast to the side frame detachably connected to the external side of the sectional panel tank, the rods are secured inside the sectional panel tank by connecting the rods to the inner sides of two first unit panels at opposite sides of the sectional panel tank (i.e. opposite first unit panels). In addition, some internal bracings are tied diagonally to the unit panel.

The sectional panel tank optionally further comprises one or more sensors, communication modules (e.g. Internet-of-Things IoT device), or a combination of these for a monitoring operation status (such as water level) of the sectional panel tank. For example, water leak sensors are embedded behind the lining for detecting any leakage of the lining. If water stored inside the sectional panel tank is leaked though the lining, the water leak sensors would be triggered when the water gets in touch with the water leak sensors. In addition, the sectional panel tank may also have a warning device connected to the sensors and/or the communication modules for generating a warning signal (such as sound or light) to an operator of the sectional panel tank. Furthermore, the sectional panel tank may comprise solar panels for generating and providing electrical power to other components such as the sensors and the communication modules.

The sectional panel tank optionally further comprises a drainage panel having a drainage hole, orifice or valve for discharging the fluid away from the sectional panel tank. In some implementation, the drainage hole is positioned at a bottom or sidewall of the sectional panel water tank for automatically discharging the fluid due to the gravity. In addition, the sectional panel tank may also comprise an inlet for filling the liquid into the sectional panel tank, an overflow pipe for diffusing the liquid out of the sectional panel tank, and an air vent for ventilation or pressure relief if the sectional panel tank is sealed when in operation.

The sectional panel tank optionally further comprises a cross connector (e.g. external bracket) configured to join four corners of neighbouring unit panels together. The cross connector provides an additional mechanical force for joining the unit panels and thus makes the sectional panel tank a unitary storage device.

The sectional panel tank optionally further comprises an inner partition or board completely encapsulated with the lining for providing an inner portion of the sectional panel tank. In this way, the sectional panel tank is divided into a plurality of smaller and independent cells for storing a same liquid or different liquids. Therefore, each cell may be constructed, maintained, inspected and repaired without any interference from any other cell. In addition, the lining may also be joined or attached to the inner partition for preventing communication of the liquids from individually cells.

The sectional panel tank optionally further comprises a base frame for holding the sectional panel tank at a building site (e.g. ground, rooftop). The base frame is either detachably or permanently attached to the bottom of the sectional panel tank. In addition, the base frame is optionally connected to the external foundation and or the framework of the sectional panel tank.

In addition to the side wall, the sectional panel tank may further comprise a bottom having a bottom extension. The bottom and the side wall are directly joined at the bottom extension and the side wall. For example, the first unit panel further comprises a side extension (such as a side flange) matching the bottom extension (such as a bottom flange) of the bottom. The bottom and the first unit panel are directly or contiguously joined by fixing the side extension and the bottom extension together.

If the sectional panel tank is elevated from the ground, the plastic welding (polymer welding) alone can join a bottom seam between the bottom extension and the side extension. In addition, the sectional panel tank also comprises a bottom jointer or bottom protector applied at a bottom seam (also known as bottom gap or bottom joint) between the bottom extension and the side wall. The bottom jointer is applied to the bottom seam between the bottom extension and the side extension on the inner side of the first unit panel and an inner side of the bottom respectively. The bottom jointer is similar to the jointer at the seam between the first extension and the second extension. The bottom jointer is used for providing additional coverage that there is no leakage at the bottom seam. The bottom jointer is particularly important in a scenario when the plastic welding cannot reach a standard quality.

The bottom jointer is formed by any suitable method according to a specific material of the bottom jointer. For example, the bottom jointer is made by a thermoplastic welding method. The thermoplastic welding method is conducted by a mechanical welding means, a thermal welding means, an electromagnetic welding means, or a chemical welding means (also known as solvent welding). The mechanical means includes but not limited to ultrasonic welding (20-40 kHz), stir welding (1-100 Hz), vibration welding (100-250 Hz) and spin welding (1-100 Hz). The electromagnetic welding means includes but is not limited to induction welding (5-25 MHz), microwave welding (1-100 GHz), dielectric welding (1-100 MHz) and resistance, implant or electrofusion. The thermal welding means includes but is not limited to hot gas welding (such as tack welding and rod welding), extrusion welding, infrared welding, laser welding, hot wedge welding and hot plate or butt fusion welding. The thermoplastic welding is examined by using various methods for testing welding integrity. The methods include but are not limited to creep test (such as creep rupture test and tensile creep test), impact test, shear test, peel test (BS EN 12814-4), bend test (DVS), tensile test (DVS) and hydrostatic pressure test (ASTM). For example, the thermoplastic welding is examined by a non-destructive test (NDT) for ensuring a welding quality of the bottom. The non-destructive test includes but is not limited to holiday spark test, ultrasonic test, leak-tightness test, radiography and visual inspection (DVS). In particular, the non-destructive test comprises a holiday spark test for identifying unacceptable discontinuities such as pinholes, holidays, bare spots or thin points.

The sectional panel tank is also subjected to leakage test and vacuum test if gas would be stored inside the sectional panel tank. It is understood to a skilled person that the leakage test and vacuum test could refer to known standards, such as standards set by the DVS German Welding Society.

The bottom for the sectional panel tank may comprise a single component of any load bearing material (such as concrete, metal or compacted soil) and the lining is attached thereon for interfacing with the unit wall panel. The single component of the bottom may comprise one or more weight-bearing parts, such as a stainless steel plate, sump and compacted soil plate for providing a flat bottom surface. The lining is then applied for completely covering the flat bottom surface; and then the sectional panel tank is directly built on the lining and the flat bottom surface. This technology is particularly used for oil storage tanks and chemical waste tanks. Alternatively, the bottom of the sectional panel tank may also comprise a third unit panel and a fourth unit panel similar to the first unit panel or the second unit panel. The third and the fourth unit panels are contiguously joined together for forming the bottom. For example, the bottom extension comprises a third extension (such as a third flange) and a fourth extension (such as a fourth flange) at peripheral edges of the third unit panel and the fourth unit panel respectively. The third extension and the fourth extension are joined together for forming the bottom. In some implementations, the bottom made of unit panels is supported above the ground by plinth or other heavy base. It is understood that the unit wall panels are not limited to a square shape, but might be of any other shapes, which are suitable for constructing a container (e.g. cylindrical container).

Similarly, the sectional panel tank may further comprise a roof. In particular, the roof is made of a chemically resistant material to chlorine gas or other corrosive chemicals (in gas state or liquid state) containing chlorine groups. Similar to the bottom of the sectional panel tank, the roof may be made of a single component (such as a monolithic covering) or assembled by a plurality of the unit panels (i.e. top unit panels) having top extensions. Similarly, the top extensions are joined together for forming the roof. The top extensions may be joined at top joints by nuts or bolts either inwardly (i.e. the top extension extending or pointing into the inner side of the sectional panel tank) or outwardly (i.e. the top extension extending or pointing out of the outer side of the sectional panel tank). In the former case, one or more supporting structures (such as steel bar) are provided below the roof for supporting the top joints since a human or an inspection machine often to walk on the roof. In the latter case, a flat and strong structure may be laid on the roof for covering the top unit panels and the top joints for the human or the inspection machine to walk on the roof. In addition, one or more supporting structures (such as steel bar) are provided at the top extension for supporting the roof. Meanwhile, the roof and the side wall are directly joined at the top extension and the side wall. For example, the first unit panel further comprises a side extension (such as a side flange) matching the top extension (such as a top flange) of the roof. The roof and the first unit panel are directly joined by fixing the side extension and the top extension together. In some implementations, the side extension is folded in a horizontal direction and is thus parallel to the roof. In some implementations, the top extension is folded in a vertical direction and is thus parallel to the first unit panel. It is noted that all the above technologies joining the bottom and the side wall (such as plastic welding) are also suitable for joining the roof and the side wall.

The sectional panel tank optionally comprises a securing means for securing the first extension and the second extension of the side wall. For example, the first extension and the second extension have a first engaging hole and a second engaging hole respectively. The first engaging hole and the second engaging hole match each other in terms of size and position. The securing means comprises an engaging screw and an engaging nut. The engaging screw passes through the first and second engaging holes from the first extension and then rests on the first extension by a slotted head of the engaging screw. Then the engaging nut secures the engaging screw from the second extension on a thread of the engaging screw and thus fastens the first securing means. In addition, the securing means may further comprise a reinforcement plate arranged between the slotted head of the engaging screw and the first extension for avoiding damages to the first extension. Similarly, the sectional panel tank comprises another securing means for securing the third extension and the fourth extension of the bottom.

The first securing means and the second securing means (e.g. fasteners) may comprise a first coating and a second coating respectively for preventing any leakage from the first and second extensions. The first coating and the second coating are optionally compatible with the lining when covered by the lining, including material compatibility, including chemical compatibility. For example, the first coating and the second coating are made of the thermoplastic material such as PE, PP, PVDF and ECTFE. In particular, the first coating or the second coating is integrated with the first lining or the second lining for forming a unitary component by any method described above (such as co-extruding).

The sectional panel tank optionally comprises a fixture for joining, fastening or fixing the side extension and the bottom extension together. Similarly, the fixture may also comprise a fixing coating compatible with the lining such as thermoplastic material including PE, PP, PVDF and ECTFE. In particular, the fixing coating is also integrated with the lining as a unitary component by any method described (such as co-extruding).

The jointer including the bottom jointer is strongly combined with the lining at their joints by suitable methods according to the materials of the jointer and the lining, such as thermoplastic welding for thermoplastic materials. In some implementations, the combination is so strong that the jointer and the lining become a unitary structure. In other words, the unitary structure would not break first from the joints which has even stronger mechanical properties than the lining itself. In addition, if made of thermoplastic materials, the unitary structure would not be easily broken but expand substantially homogenously under pressure. The homogenous expansion guarantees that there is no weak position for the unitary structure such that the unitary structure can resist a rather large force. The degree of expansion is determined by the specific thermoplastic materials and thickness of the lining sheets under a certain force. For example, the unitary structure would expand for 3 to 9 times, or particularly 4 to 7 times. Therefore, if one of the unit panels of the sectional panel tank is broken or spoiled, water stored inside the sectional panel would be held by the unitary structure and not leaked outside the sectional panel tank. Under pressure of the stored water, the unitary structure would expand homogenously and not be breached easily. As a result, the unitary structure formed by the jointer and the lining provide an additional protection to the sectional panel tank in addition to the unit panels.

As a second aspect, the present application also discloses a prefabricated unit panel for the sectional panel tank of the first aspect. The prefabricated unit panel comprises a structural panel having an extension; and a lining sheet preformed on an inner side of the structural panel for substantially or completely covering the structural panel, including the extension. The lining sheet optionally comprises a thermoplastic material (such as PE, PP, PVDF and ECTFE); while the structural panel optionally comprises metals or metal alloys (such as stainless steel, copper, bronze, brass or galvanized steel), plastics (such as polyethylene or polypropylene), composites (such as fiberglass reinforced plastics (FRP) or glass reinforced plastics (GRP)).

Similar to the lining of the first aspect, the lining sheet comprises a base layer (also known as signal layer) of a first colour and a fore layer of a second colour, such that erosion of one of the layers (such as the fore layer) will expose another layer (such as the base layer) for vision inspection of premature wear or damage. The base layer (i.e. first layer) of the first colour and the fore layer (i.e. second layer) of a second colour are contiguously joined together.

The lining sheet is optionally preformed on an inner side of the structural panel for substantially or completely covering the structural panel, possibly including the extension.

Similar to the securing means of the first aspect, the extension optionally comprises an engaging hole for a securing means such as an engaging screw and an engaging nut. Accordingly, the lining sheet may comprise a through hole matching (e.g. size or diameter similar or identical) the engaging hole of the extension in terms of size and position for the securing means. Therefore, the extension and the lining sheets of one prefabricated unit panel are fixed together with those of another prefabricated unit panel by the securing means.

The lining sheet optionally comprises a bonding layer for bonding to the inner side of the structural panel tightly for forming a unitary structure. The structural panel preferably has a smooth surface facing towards the lining sheet for coupling the lining sheet to the structural panel more reliably via the vacuum forming process. For example, the bonding layer comprises a fabric backed liner (FBL) having a thin layer of any fabric material (such as felt, polyester) for increasing the contact areas. For another example, the bonding layer comprises a thin homogenous layer of mechanical fixtures having a plurality of anchors, surface texture, extensions, legs, studs for increasing the contact areas.

The inner side of the structural panel provides a rough surface for binding the lining sheet tightly for forming a unitary structure. In some implementations, the inner side has a plurality of protrusions for increasing the contact areas between the structural panel and the lining sheet. The protrusions may have any shapes and sizes as long as the protrusions do not create hindrance to the tight bonding of the lining sheet and the structural panel into the unitary component. The lining sheets substantially covers the structural panel completely including the extension for maximizing the contact areas between the structural panel and the lining sheet. Excessive lining material extending out of the extension is completely trimmed away after the thermoforming process. Alternatively, a small portion of the excessive lining material is kept for the thermoplastic welding for joining two adjacent prefabricated unit panels. As a result, the inner sides of the structural unit panels are completely covered by the lining sheets and thus excluded from contact with water stored in the sectional panel tank. Since the thermoplastic materials are chemically stable and resistance to almost all hazardous wastes (such as biological or chemical solutions), the sectional panel tanked assembled by the prefabricated unit panels are also suitable for storing chemical solutions, in addition to water.

The prefabricated unit panel optionally further comprises a thermal insulation layer sandwiched between the structural unit panel and the lining sheet. The thermal insulation ensures that the sectional panel tank is workable in special regions (such as high latitude countries in cold winter) or for special applications (such as spa). The thermal insulation layer may be made up of any insulation materials which can effectively prevent heat conduction across the structural panel. The thermal insulation layer may have fibrous insulation materials (such as silica, glass fibers, rock wool, mineral wool, slag wool and alumina silica fibres), cellular insulation materials (such as closed-cell polystyrene, polyurethane, polyisocyanurate, polyolefin and elastomers), granular insulation materials (such as calcium silicate, expanded vermiculite, perlite, cellulose, diatomaceous earth and expanded polystyrene), and any combination of the foregoing objects.

In particular, the thermal insulation layer may be made of aerogel which on one hand has excellent thermal insulation with a typical R-value of around 20 due to its extremely low pore sizes for reducing gas conduction and on the other hand incredible low density between 0.001 to 0.5 gram per cubic meter ($g/cm^3$) for reducing weight of the prefabricated unit panel as a whole. The thermal insulation layer has a spacer for holding the aerogel for maintain a certain thickness of the thermal insulation layer. For example, the space has a porous material having a plurality of pores for the aerogel to fill. In other words, the space act as a backbone to the thermal insulation layer when aerogel is adopted.

In some implementations, the lining sheet, the structural panel and the second thermal insulation layer are formed into the unitary structure via a thermoforming process. The thermoforming process is also known as a plastic thermoforming process since the lining sheet predominantly comprises thermoplastic materials. Exemplary thermoplastic materials include PerFluoroAlkoxy (PFA), PolyFluoroEth, Polyethylene (PE) (such as low density PE (LDPE), Cross Link PE (XLPE), High Density PE (HDPE), and Ultra High Molecular Weight Polyethylene (UHMWPE)), Polypropylene (PP) (such as PP Random (PPR)), PolyTetraFluoroEthylene (PTFE), EthyleneChloroTrifFluoroEthylene (ECTFE), PolyVinyliDeneFluoride (PVDF), Fluorinated Ethylene Propylene (FEP) and Perfluoroalkoxy Alkanes (PFA). The thermoset material includes but is not limited to EthyleneVinylalcOHol (EVOH), PolyVinylChoride (PVC), PolyStyrene (PS), PolyCarbonate (PC), PolyMethylMethAcrylate (PMMA) and Acrylonitrile Butadiene Styrene (ABS).

The thermoforming process refers to any process in which the lining sheet is heated to soften, then conforms to the concave or female contours of the structural panel from the inner side under either negative pressure or positive pressure, and finally is cooled to environmental temperature for fixing the concave or female contours. In addition to the concave or female contours from the inner side, the thermoforming process can be also applied to convex or male contours from an external side of the structural panel for attaching another lining sheet or similar thermoplastic sheet to the external side tightly.

The thermoforming process may comprise a vacuum forming process in which the contours are formed under the negative pressure which pulls the lining sheet onto the inner side, the exterior side or both of the structural panel. The vacuum forming process is suitable for relatively large structural panel (such as 1-meter×1-meter size); and also have lower running costs. Alternatively, the thermoforming process comprises a pressure forming process under the positive pressure. The pressure forming process is suitable for the structural panel which has complex shapes and subtle details on the contours since lining sheet is formed more uniformly with tight tolerances to the contours. It is appreciated that the thermoforming process optionally comprises a combination of the vacuum forming process and the pressure forming process for the relatively large structural panel having complex shapes and subtle details to the contours.

In some implementations, the lining sheet and the second thermal insulation layer are formed into a moulded structure via a moulding process. The moulded structure is then thermoformed with the structural panel into the unitary structure, via the vacuum forming process, the pressure forming process or a combination thereof. As a result, the first thermal insulation layer and the second thermal insulation layer provide double thermal insulation abilities to the sectional panel tank assembled by the prefabricated unit panels; and the first lining sheet and the second lining sheet also provide double protection abilities for preventing leakage of the water or chemical solutions stored inside the sectional panel tank.

As a third aspect, the present application also discloses a method of making the side wall for the sectional panel tank of the first aspect. The method of making comprises a step of providing a first unit panel having a first extension at its peripheral edge; a step of providing a second unit panel having a second extension at its peripheral edge; a step of directly joining the first unit panel and the second unit panel together by securing a securing means at the first extension and the second extension; and a step of applying a jointer at a seam between the first extension and the second extension on inner sides of the first unit panel and the second unit panel. The jointer is applied by any suitable method discussed in the first aspect. If made of fiberglass reinforced plastics (FRP), the first unit panel and the second unit panel are provided by any suitable method, including sheet moulding compound (such as compression moulding), hand laid, bulk moulding compound (such as injection moulding, transfer moulding and compression moulding), and compression moulding. In particular, the applying step may comprise a thermoplastic welding process. The thermoplastic welding process is optionally conducted by a mechanical welding means, a thermal welding means, an electromagnetic welding means or a chemical welding means.

The method of making optionally comprises a step of joining or attaching a lining onto the inner sides of the first unit panel and the second unit panel separately or collectively. The lining has all the characteristics described in the first aspect. The lining is prepared by any suitable method, including but not limited to injection moulding, pultrusion, rotational moulding, compression moulding, extrusion, thermoforming or vacuum forming, calendaring and blow moulding. In particular, the joining step optionally comprises a thermoforming process. The method of making optionally further comprise a step of examining the jointer by a non-destructive test. The non-destructive test comprises a holiday spark test or vacuum test.

The method of making optionally comprises a step of selecting the lining for resisting corrosion of a predetermined host. For example, the lining is selected not to be made of step-growth polymers (such as polyesters, polyamides o polycarbonates) when the sectional panel tank stored an acid solution or a base solution as the predetermined host. In addition, the method of making also optionally comprises a step of coating the securing means for avoiding a leakage of the predetermined host. Preferably, the coating is made of a same or similar material with the lining for easily and firmly joining the coating and the lining together. In some implementations, the coating and the lining are integrated together as a unitary component before they are joined onto the unit panel.

The joining step may further comprise a first step of providing a fore layer and a base layer; a second step of co-extruding the fore layer and the base layer for forming a homogenous bonded layer; and a third step of attaching the homogeneous bonded layer onto the inner side of the first unit panel. As described above, the fore layer has a fore colour; and the base layer has a base colour different from the fore colour for an easy visual inspection. In particular, the joining step comprises a step of joining the lining onto the first extension and the second extension for directly joining the first unit panel and the second unit panel. In this way, the method of making does not need any gasket inserted between the first extension and the second extension. Therefore, existing problems of the gasket such as leakage and corrosion are overcome; and the first unit panel and the second unit panel are joined more tightly and durably at the first and second extension.

As a fourth aspect, the present application also discloses in the case of thermoset lining such as PVC, ABS, PMMA (Acrylic), etc. a method of joining an individual lined sectional panel tank having two parts. The method of joining comprises a step of pressing the two parts; and a step of applying a jointer at a seam between the two parts. The two parts of the sectional panel tank is pressed together tightly such that the seam has a dimension less than 0.5 millimetres (mm) for creating a capillary effect. The jointer is in a liquid state and then goes into the seam due to the capillary effect. The jointer is finally fixed at the jointer and completely covers the seam for preventing any leakage. For example, a solution with a resin dissolved or suspended enters into the seam due to the capillary effect; and then the resin is fixed inside and near the seam by solvent welding.

As a fifth aspect, the present application also discloses a method of making the prefabricated unit panel for the sectional panel tank described in the second aspect. The method of making the prefabricated unit panel comprises a step of providing a structural panel having an extension; a step of providing a lining sheet larger than the structural panel; and a step of attaching the lining sheet onto an inner side of the structural panel. In particular, the lining sheet completely covers the extension of the structural panel.

The lining optionally comprises a thermoplastic material. Accordingly, step of attaching may be conducted by a thermoforming method that is suitable for the thermoplastic material.

The lining optionally comprises a fore layer having a fore thickness and a base thickness having a base thickness. In some implementations, the fore thickness accounts for around 50% of the total thickness, such as ranging from 150 to 200 micrometres.

The structural panel is made of impermeable, corrosion resistive and structurally robust material, including metals or metal alloys (such as stainless steel, copper, bronze, brass, galvanized steel, aluminium, titanium, etc.), plastics (such as polyethylene or polypropylene), composites (such as fiberglass reinforced plastics (FRP) or glass reinforced plastics (GRP) carbon fiber).

The method of making the prefabricated unit panel optionally comprises a step of attaching a thermal insulation layer sandwiched between the structural panel and the lining for reducing temperature fluctuation.

The attaching step optionally comprises a thermoforming process for incorporating the lining sheet and the structural panel tightly into a unitary component if the lining sheet is made of thermoplastic materials. The unitary component can be directly used as the prefabricated unit panel without further processing or modification. The unitary component means the lining sheet would not be detached or removed completely from the structural panel during normal operation of the prefabricated unit panel.

The thermoforming process optionally comprises a vacuum forming process for bonding the lining sheet and the structural panel into the unitary component. The vacuum forming process comprises a step of aligning the lining sheet over the inner side of the structural panel; a step of heating the lining sheet to be pliable for deformation; and a step of forming the lining to the inner side through bonding the lining sheet and the structural panel by a negative pressure or even substantially vacuum. In the heating step, the lining sheet is controlled to reach a temperature at or slightly above a glass transition temperature (Tg) but well below a rubbery state of the thermoplastic material of which the lining sheet is made. In addition, different locations of the lining sheet may be heated to different temperatures suitable for distinct features of the contours of the structural panel. To a specific location, the more concave or convex, the higher the temperature should be heated to for allowing more pliable deformation of the lining sheet at the specific location.

The forming step may comprise a procedure of moving the structural panel upwardly towards the lining sheet at a predetermined position; a procedure of vacuum forming the lining sheet to the structural panel for transferring contours of the inner side of the structural panel to the lining sheet via vacuum; and a procedure of cooling the lining sheet for crystalizing the contours to the lining sheet. In addition, the forming step optionally further comprises a step of puffing downwardly the lining sheet towards the structural panel for facilitating the step of moving the structural panel towards the lining sheet.

The thermoforming process optionally comprises a pressure forming process. In contrast to the vacuum forming process, the pressure forming process creates a positive pressure for bonding the lining sheet and the structural panel by pushing the lining sheet downwardly towards the lining sheet after the lining sheet is heated to become pliable for deformation. In addition, the thermoforming process may comprise a combination of the vacuum forming process and pressure forming process by creating a negative pressure under the lining sheet for pulling the lining sheet downwardly and a positive pressure above the lining sheet for pushing the lining sheet downwardly, respectively.

The method of making the prefabricated unit panel may further comprise a step of applying an adhesive layer between the lining sheet and the inner side of the structural panel. The adhesive layer provides additional force to bind the lining sheet and the structural panel.

The method of making the prefabricated unit panel may further comprise a step of applying a thermal insulation layer between the lining sheet and the inner side of the structural panel. As described above, the thermal insulation layer is made of low density materials (such as aerogel) for being sandwiched between the lining sheet and the structural panel into the unitary structure.

The accompanying figures (FIGS.) illustrate embodiments and serve to explain principles of the disclosed embodiments. It is to be understood, however, that these figures are presented for purposes of illustration only, and not for defining limits of relevant applications.

Figure 1:
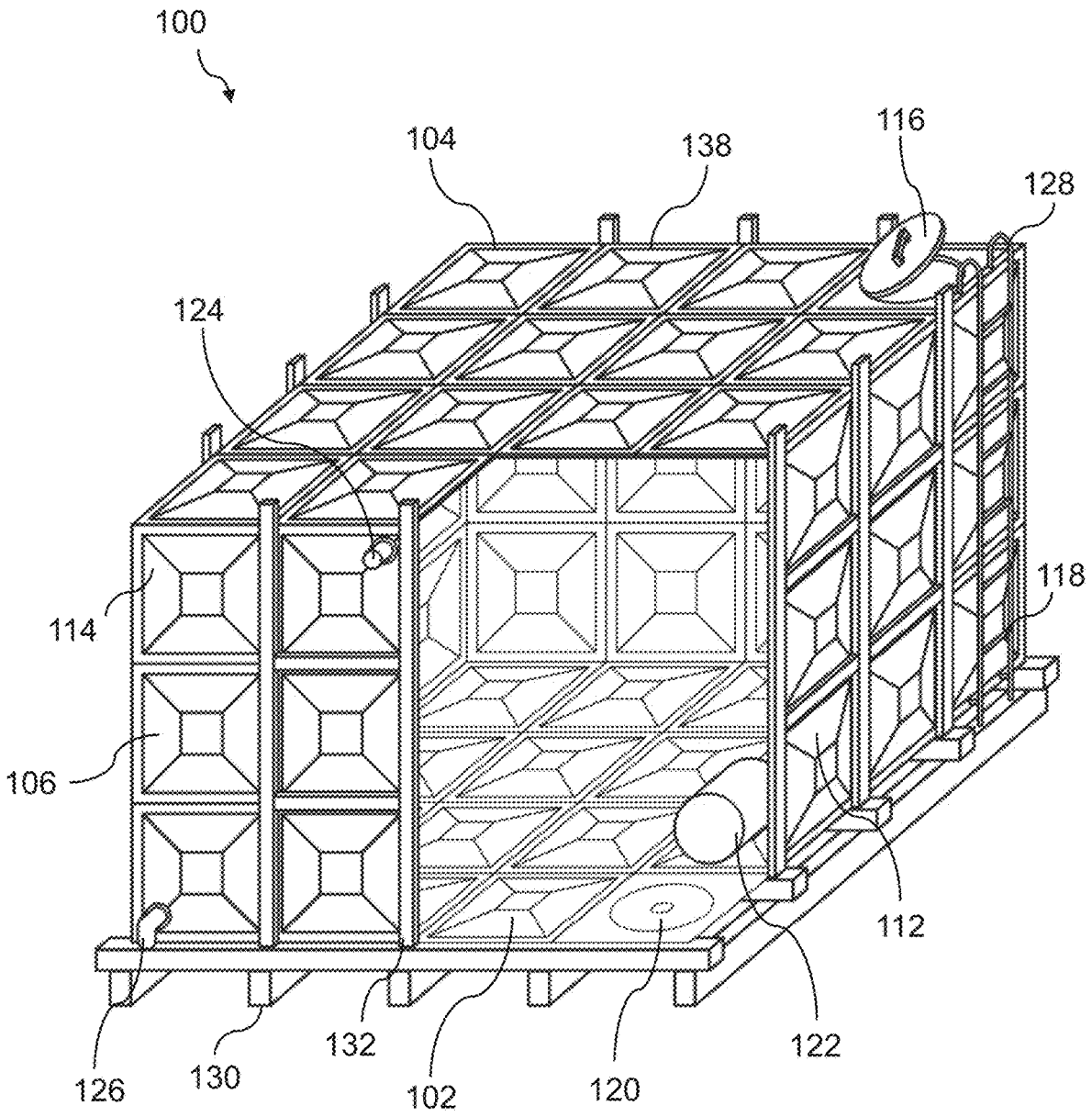
FIG. 1 illustrates a partially exploded view of a first sectional panel tank with an external foundation.

FIG. 1 illustrates a partially exploded view of a first sectional panel tank 100 with an external foundation 130. The first sectional panel tank 100 has a cubic dimension with a bottom 102, a roof or cover 104 and four side walls, including a front wall 106, a rear wall 108 (not shown), a left wall 110 (not shown) and a right wall 112. Therefore, twelve (12) edges 138 of the sectional panel tank 100 are formed for the first sectional panel tank 100. The bottom 102, the cover 104 and the side walls 106, 108, 110, 112 are assembled by multiple unit panels 114 joined together. The first sectional panel tank 100 further comprises an access hole or manhole 116 at a corner of the cover 104, a ladder 118 fixed to the right wall 112, a drainage hole 120 connected to a drainage tube 122, an inlet 124 and an outlet 126 at an upper part and a lower part of the front wall 106 respectively. It is understood to a skilled person that the inlet 124 and the outlet 126 are typically furthest apart from each other for proper circulation of liquid to avoid stagnation. In particular, a top end 128 of the ladder 118 is located inn vicinity of the access hole 116. In addition, the external foundation 130 is laid on the ground for supporting the first sectional tank 100; and an external framework 132 connected to the multiple unit panels for upholding structural integrity of the first sectional panel tank 100. The first sectional panel tank 100 is used for storing a liquid 134 (not shown) inside a space defined by the bottom 102, the cover 104 and the four side walls 106, 108, 110, 112. The liquid 134 is filled into and discharged out of the space through the inlet 124 and the outlet 126. In addition; the liquid 134 is removed from the space through the drainage tube 122 and the drainage hole 120 in a quicker manner. It is understood to a skilled person that the outlet 126 is usually higher than the drainage hole 120 so that any sediments cannot enter into the supply line. Drainage hole 120 is usually the lowest point of the first sectional panel tank 100, where sedimentation can be discharged.

Figure 2:
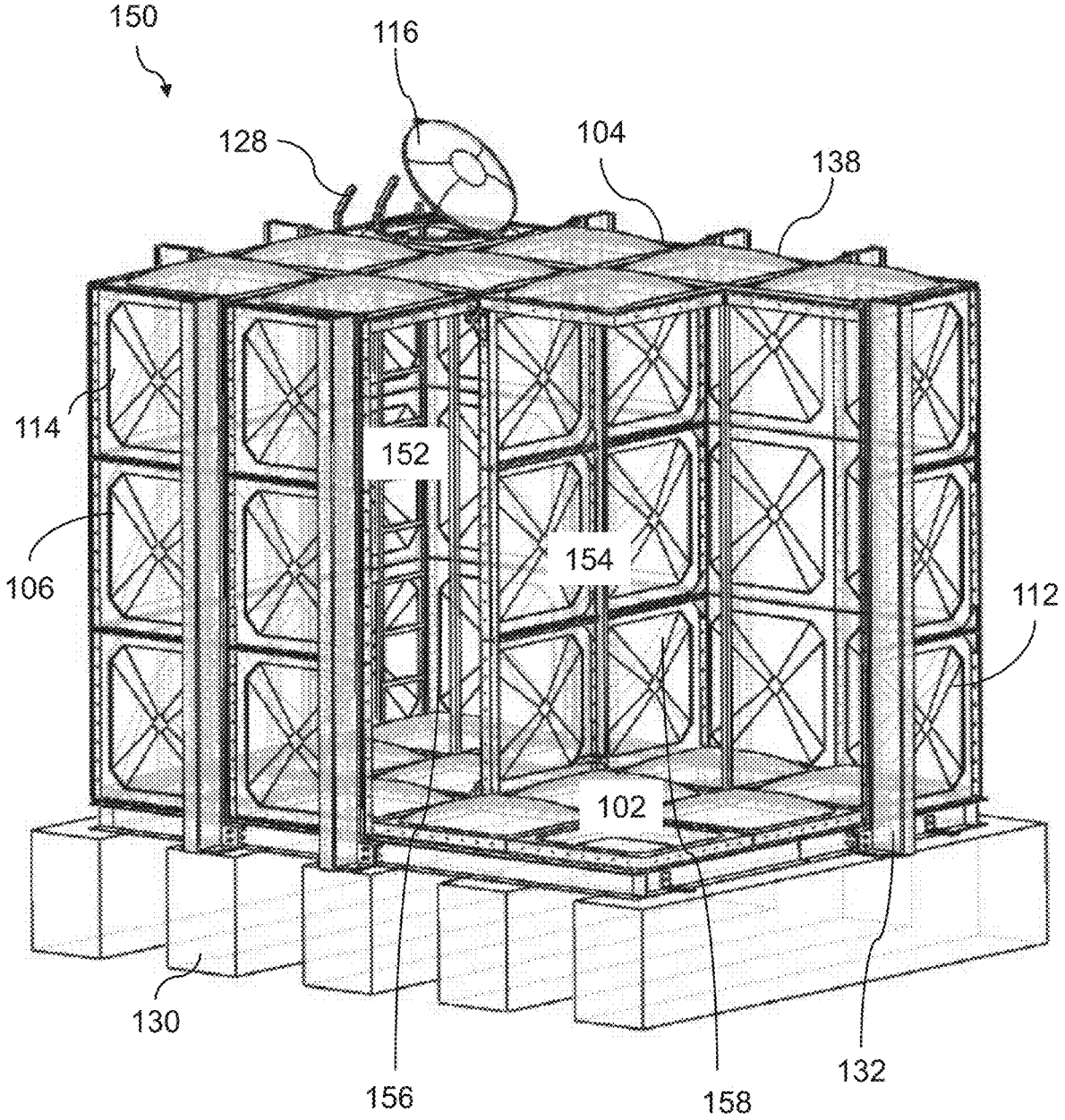
FIG. 2 illustrates a partially exploded view of a variant of the first sectional panel tank in FIG. 1.

FIG. 2 illustrates a partially exploded view of a variant 150 of the first sectional panel tank 100 in FIG. 1. The variant 150 has a similar structure with the first sectional panel tank 100 and thus features of the variant 150 herein are made references to the first sectional panel tank 100 illustrated in FIG. 1. In addition to the ladder 118, the variant 150 has a second ladder 152 inside the variant 150 for easily getting access into the bottom 102 of the variant 150 via the access hole 116. Furthermore, the variant 150 has a partition 154 for partitioning the variant 150 into two small tanks, i.e. a first tank 156 enclosed by the front wall 106, the rear wall 108, the left wall 110 and the partition 154; and a second tank 158 enclosed by the front wall 106, the rear wall 108, the right wall 112 and the partition 154.

Figure 3:
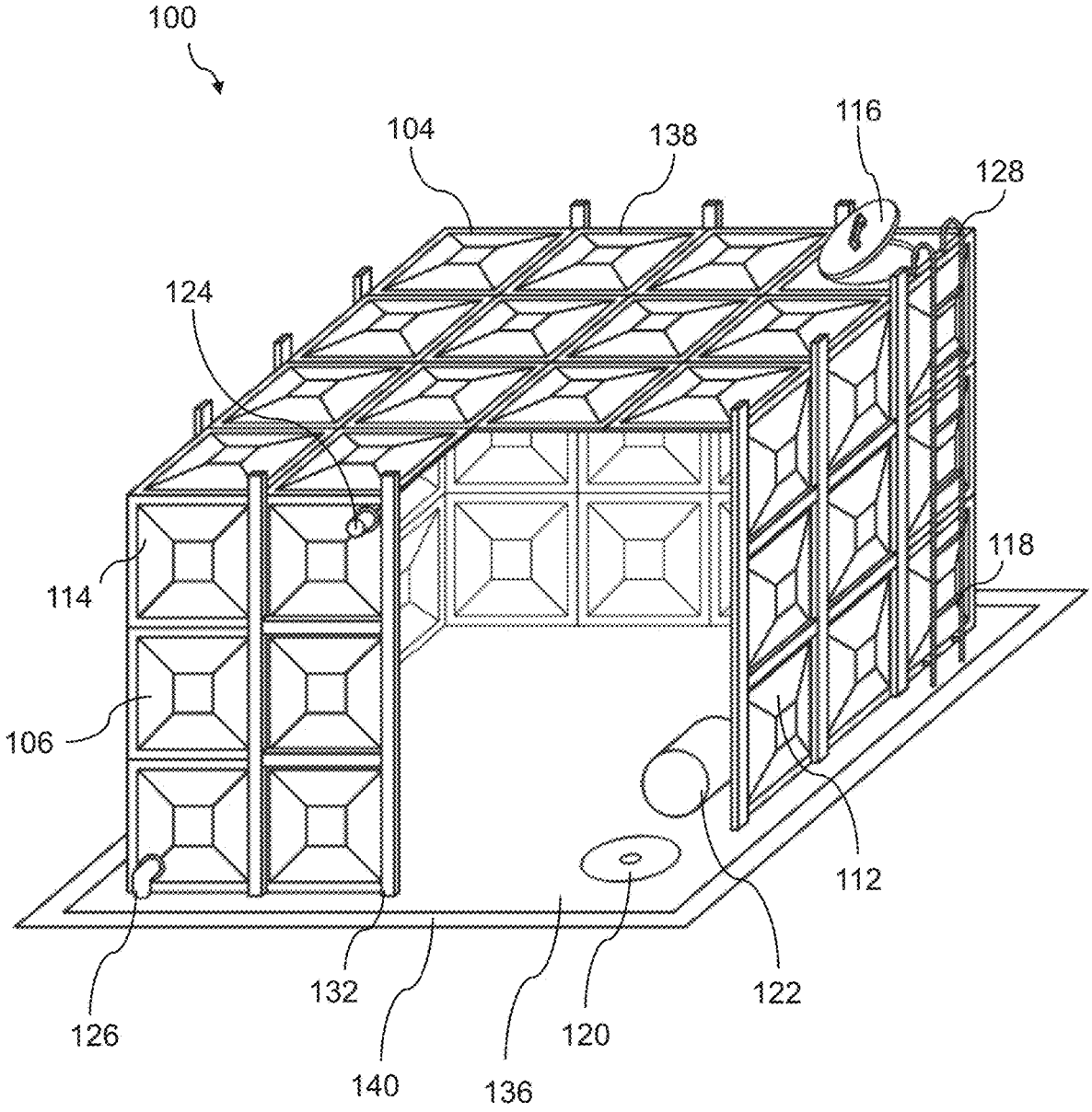
FIG. 3 illustrates a partially exploded view of the first sectional panel tank without an external foundation.

FIG. 3 illustrates a partially exploded view of the first sectional panel tank 100 without an external foundation 130. All features of the first sectional panel tank 100 are identical to those in FIG. 1, except that the bottom 102 is not needed. A compacted and flat soil plate (not shown) is prepared from the ground; and then a piece of lining 136 is spread on the compacted and flat soil plate. The first sectional panel tank 100 is directly built on the lining 136 by erecting the side walls 106, 108, 110, 112 and the joining the cover 104 with the side walls 106, 108, 110, 112. This first sectional panel tank 100 in FIG. 3 is particularly used for oil storage and chemical waste treatment. It is also understood that the first sectional panel tank 100 herein can also be suitable for potable water.

Figure 4:
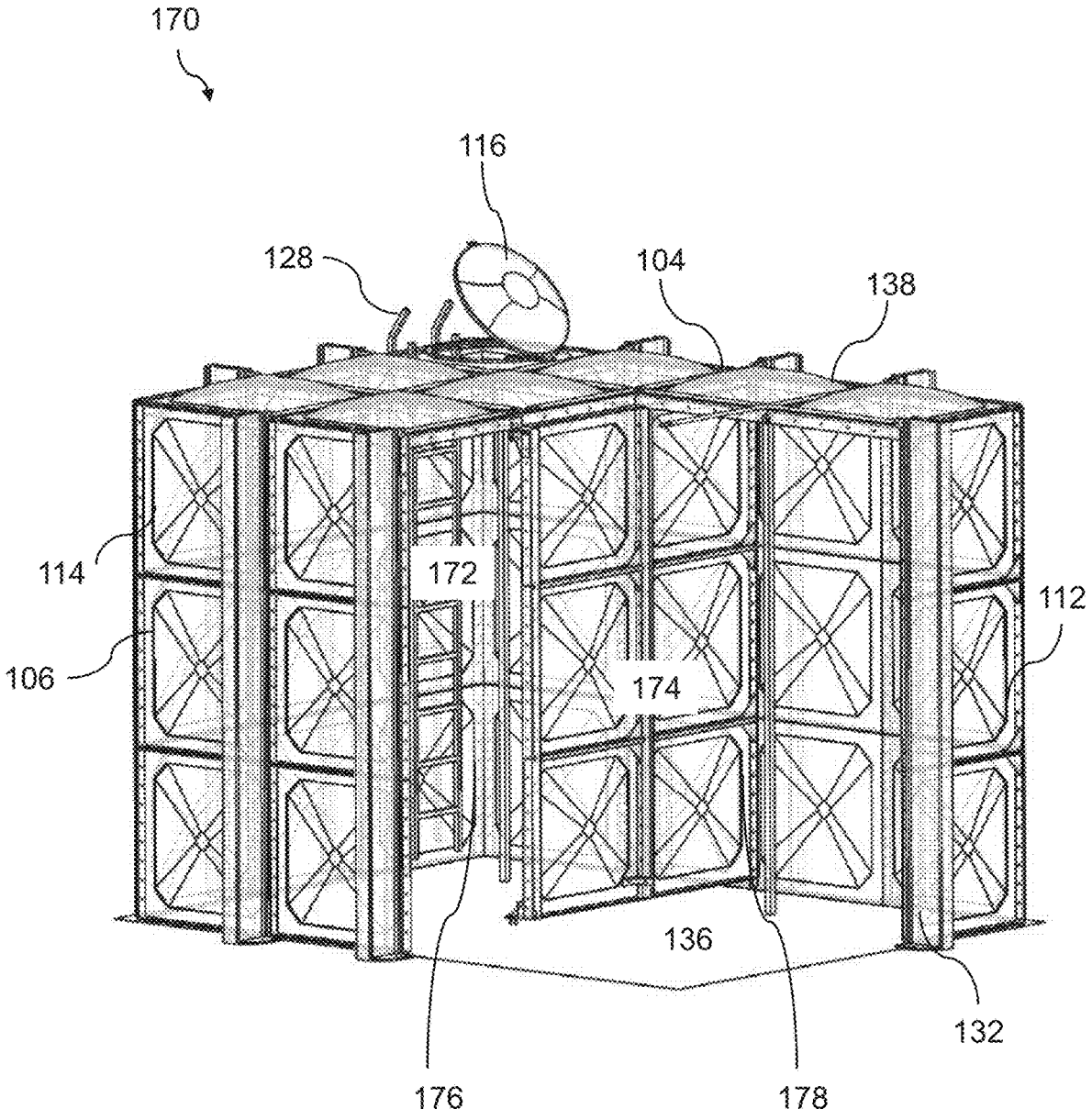
FIG. 4 illustrate a partially exploded view of a variant of the first sectional panel tank in FIG. 3.

FIG. 4 illustrate a partially exploded view of the variant 170 of the first sectional panel tank in FIG. 3. The variant 170 has a similar structure with the first sectional panel tank 100 and thus features of the variant 150 herein are made references to the first sectional panel tank 100 illustrated in FIG. 3. In addition to the ladder 118, the variant 170 has a second ladder 172 inside the variant 170 for easily getting access into the lining 136 of the variant 170 via the access hole 116. Furthermore, the variant 170 has a partition 174 for partitioning the variant 170 into two small tanks, i.e. a first tank 176 enclosed by the front wall 106, the rear wall 108, the left wall 110 and the partition 174; and a second tank 178 enclosed by the front wall 106; the rear wall 108, the right wall 112 and the partition 174.

Figure 5:
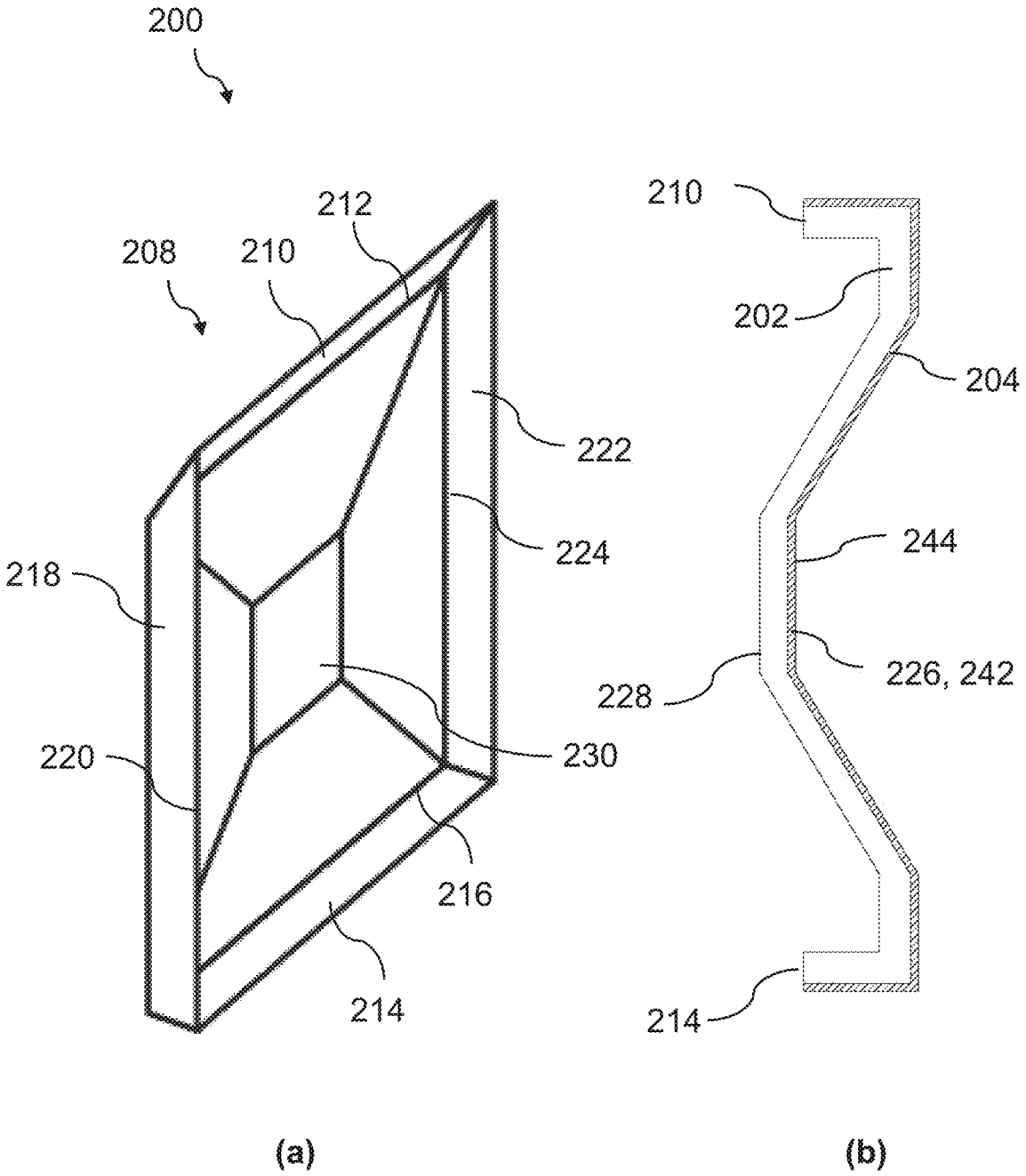
FIG. 5 illustrates (a) an isometric view and (b) a cross-sectional view of a first unit panel from an internal point of view.
Figure 6:
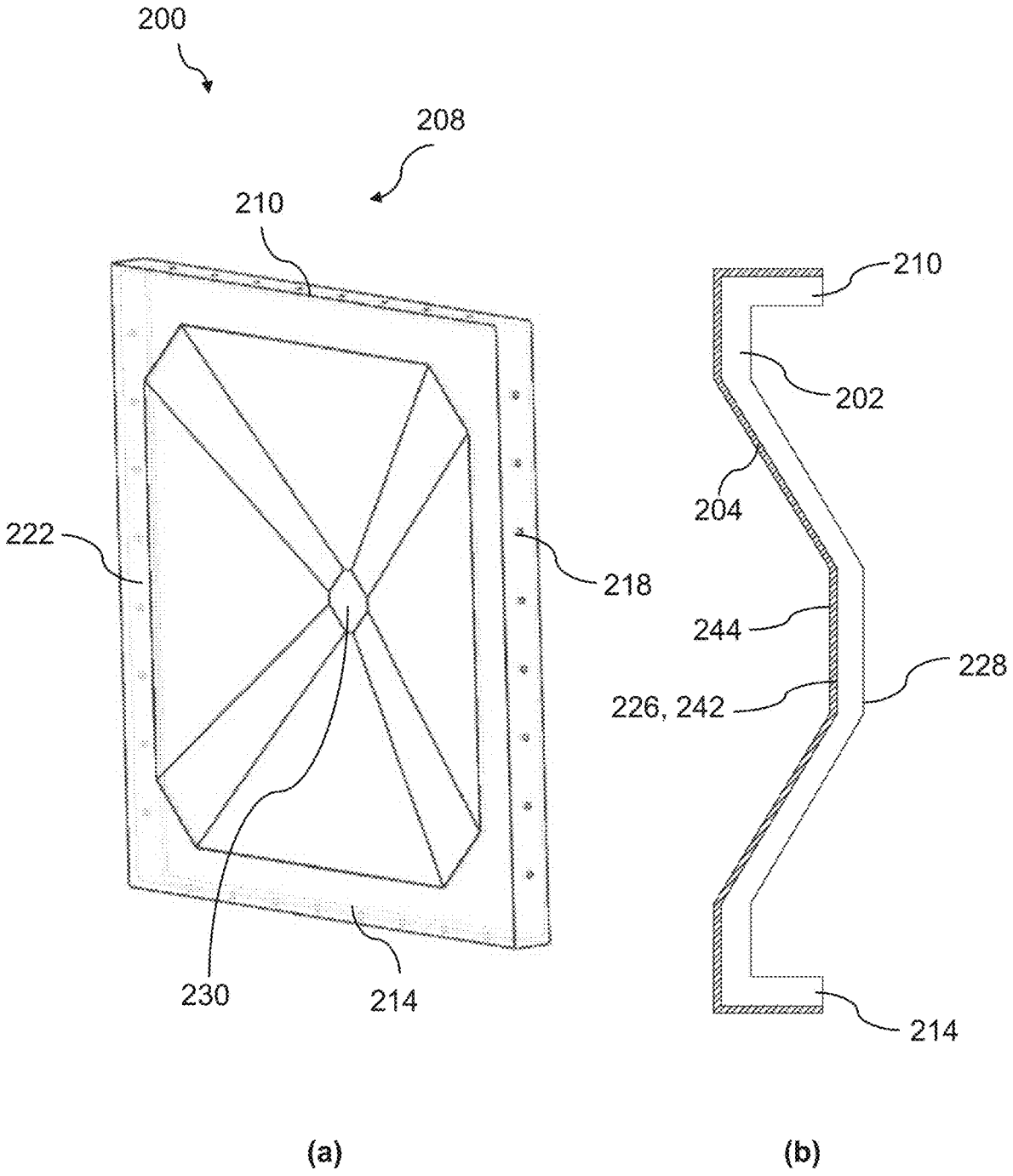
FIG. 6 illustrates (a) an isometric view and (b) a cross-sectional view of the first unit panel from an external point of view.

FIG. 5 illustrates an isometric view (FIG. 5(*a*)) and a cross-sectional view (FIG. 5(*b*)) of a first unit panel 200 from an internal point of view; and FIG. 6 illustrates an isometric view (FIG. 6(*a*)) and a cross-sectional view (FIG. 6(*b*)) of the first unit panel in FIG. 5 from an external point of view. The first unit panel 200 comprises a first structural panel 202, a first lining sheet 204 and a first extension 208. The first extension 208 further comprises four flanges folded at substantially 90 degrees at four peripheral edges of the first unit panel 200 respectively, i.e. a first front flange 210 folded at a first front edge 212, a first rear flange 214 folded at a first rear edge 216, a first left flange 218 folded at a first left edge 220, and a first right flange 222 folded at a first right edge 224. The first structural panel 202 thus extends between the four flanges 210, 214, 218, 222. The first structural panel 202 is made of stainless steel that is impermeable, corrosion resistive, and mechanically robust for resisting pressure of the fluid 134. The four flanges 210, 214, 218, 222 are formed by folding the four edges 212, 216, 220, 224 respectively at substantially 90 degrees. In other words, the four flanges 210, 214, 218, 222 are substantially vertically positioned to the four edges 212, 216, 220, 224 respectively. In particular, the first structural panel 202 has a size less than four square meters and a thickness of around 2 millimetres (mm); while the first lining sheet 204 also has a thickness of around 2 millimetres (mm). Therefore, the first unit panel 200 has a total thickness of around 4 millimetres (mm).

As shown in FIG. 5(*b*), the first lining sheet 204 has two flat sides, i.e. a first side 242 and a second side 244. The first side 242 is joined to an inner surface 226 of the first structural panel 202 for forming the first unit panel 200 by a thermoforming method. In particular, the first lining sheet 204 completely covers the inner surface 226, including the first structural panel 202 and the first extension 208. The first lining sheet 204 is made of a thermoplastic material such as PE, PP, PVDF, ECTFE. Since in direct contact with the liquid 134, the first lining sheet 204 is required to be water-proof and corrosion resistant to water and almost all chemical solutions. Furthermore, the first unit panel 200 comprises a first embossment 230 on the first structural panel 202 for further strengthening mechanical properties of the first structural panel 202.

Figure 7:
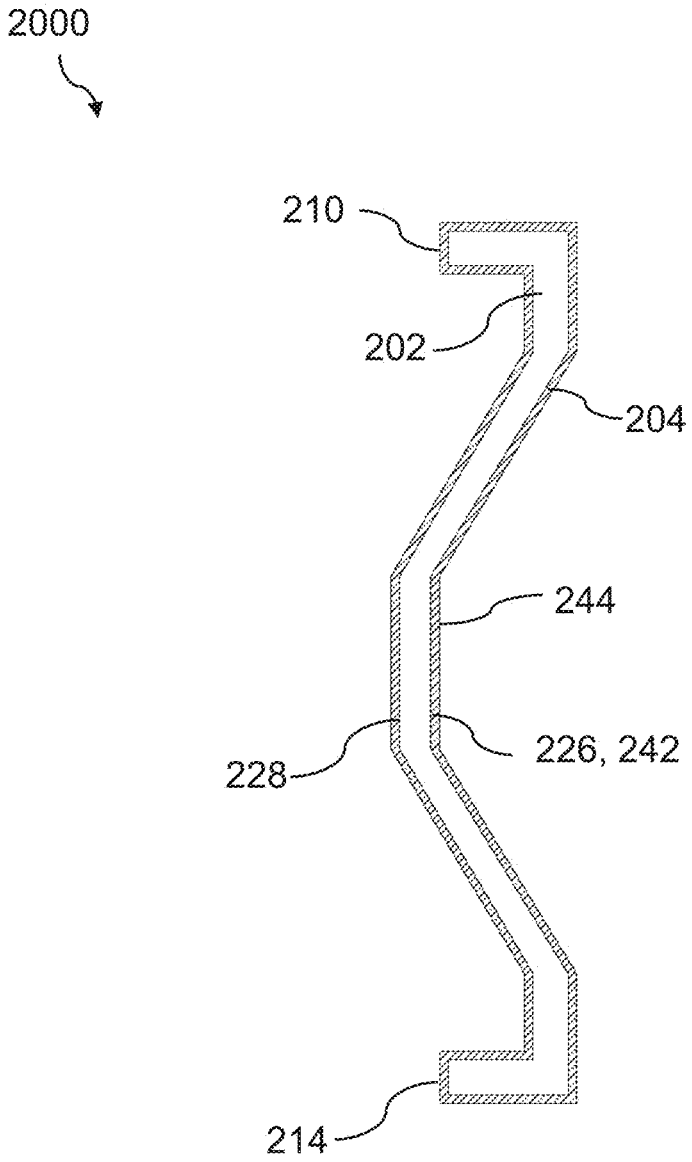
FIG. 7 illustrates a cross-sectional view of a variant of the first unit panel in FIG. 5(*b*)

FIG. 7 illustrates a cross-sectional view of a variant 2000 of the first unit panel 200 in FIG. 5(*b*). The variant 2000 has a similar structure with the first unit panel 200 and thus features of the variant 2000 herein are made references to the first unit panel 200 illustrated in FIG. 5(*b*). In addition to covering the inner surface 226 and the first extension 208, the first lining sheet 204 also covers the external surface 228 of the first structural panel 202. In other words, the first lining sheet 204 encapsulates the first structural panel 202 and the first extension 208 completely. The variant 2000 is particularly suited for partition panels as seen in FIG. 2 and FIG. 4.

Figure 8:
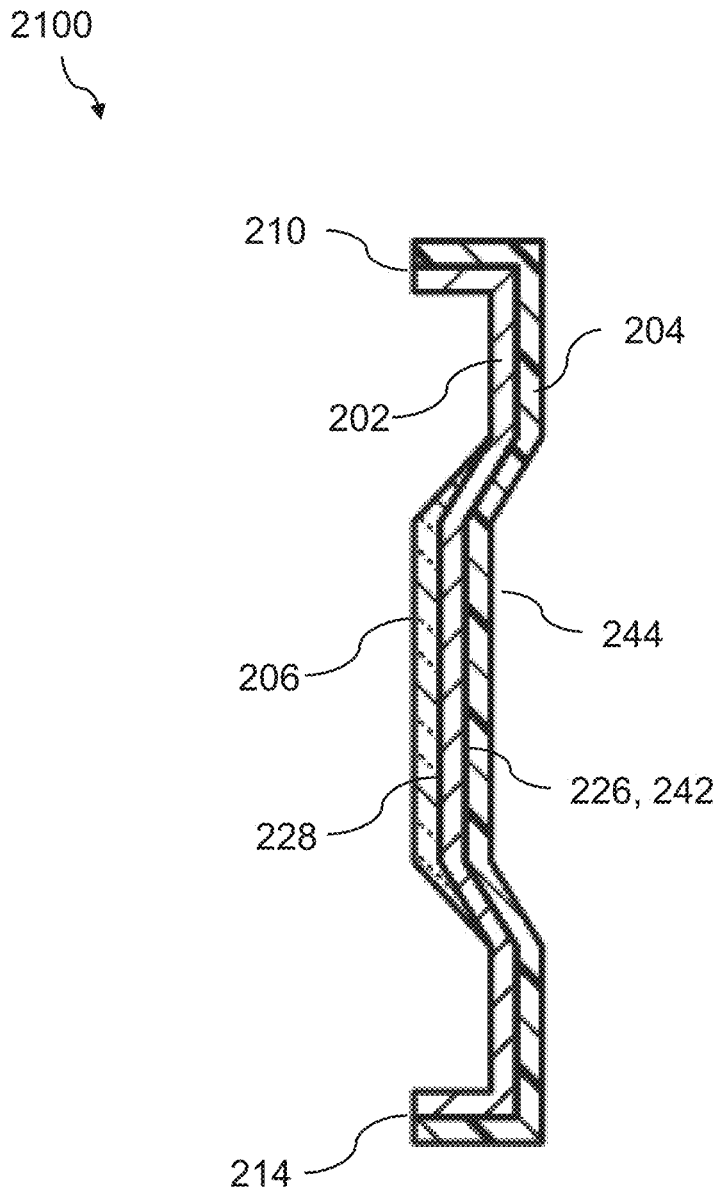
FIG. 8 illustrates a cross-sectional view of another variant of the first unit panel in FIG. 5(*b*)

FIG. 8 illustrates a cross-sectional view of another variant 2100 of the first unit panel 200 in FIG. 5(*b*). The variant 2100 has a similar structure with the first unit panel 200 and thus features of the variant 2100 herein are made references to the first unit panel 200 illustrated in FIG. 5(*b*). in addition, the variant 2100 has a first thermal insulation layer 206 formed on an external surface 228 of the first structural unit panel 202 for reducing temperature fluctuation of the fluid 134. The first thermal insulation layer 206 is made of fiberglass that is light in weight and also hydrophobic to water. It is noted that the first thermal insulation layer 206 covers a central portion of the first unit panel 200, including the first embossment 230.

Figure 9:
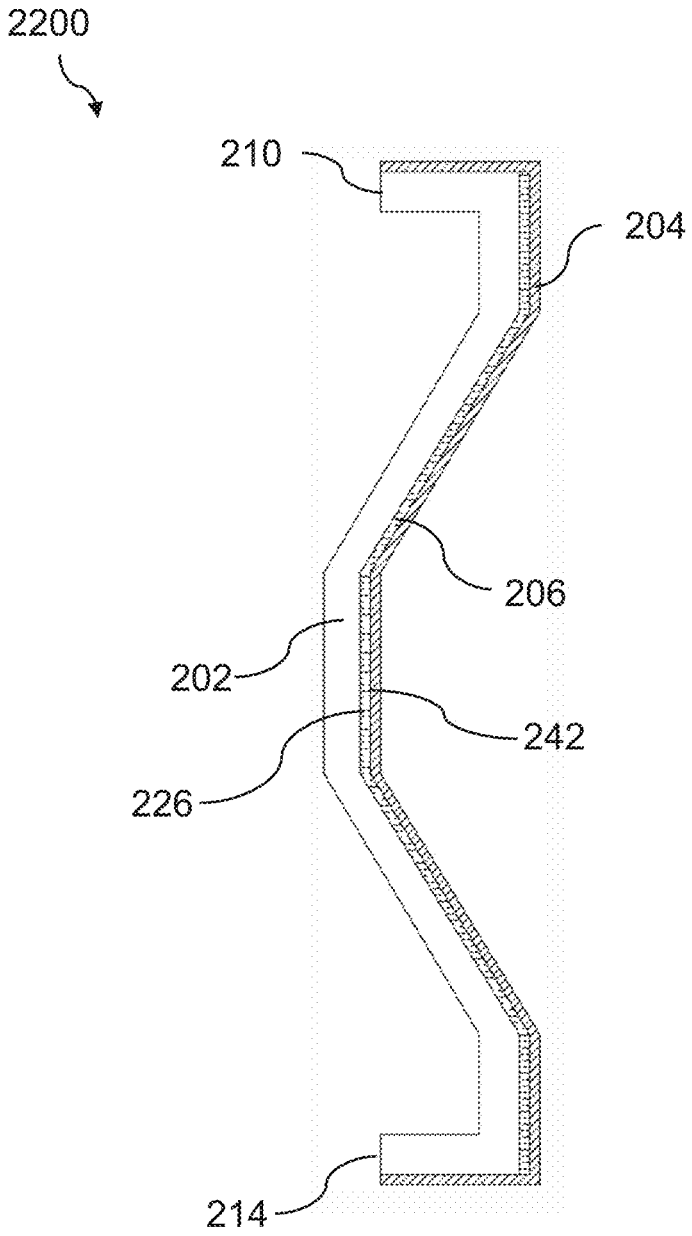
FIG. 9 illustrate a cross-sectional view of another variant of the first unit panel in FIG. 5(*b*)

FIG. 9 illustrate a cross-sectional view of another variant 2200 of the first unit panel 200 in FIG. 5(*b*). The variant 2200 has a similar structure with the variant 2100 and thus features of the variant 2200 herein are made references to the variant 2100 illustrated in FIG. 8. In comparison, the first thermal insulation layer 206 is sandwiched between the first structural panel 202 and the first lining sheet 204. In other words, the first thermal insulation layer 206 is attached between the inner surface 226 of the first structural panel 202 and the first side 242 of the first lining sheet 204. Therefore, the first thermal insulation layer 206 for the variant 2200 is known as an inner insulation layer. The first thermal insulation layer 206 also covers the first structural panel 202 completely, but does not extend to cover the first extension 208.

Figure 10:
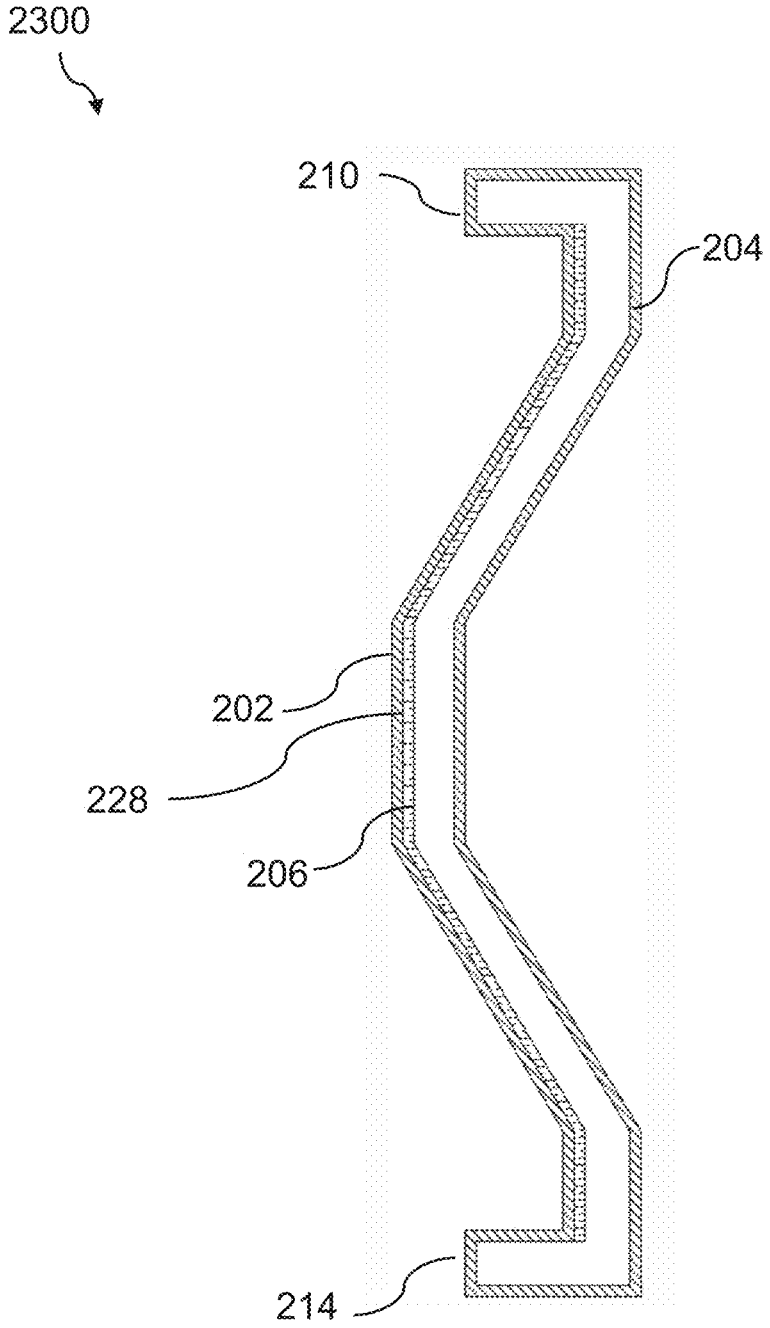
FIG. 10 illustrate a cross-sectional view of another variant of the first unit panel in FIG. 5(*b*)

FIG. 10 illustrate a cross-sectional view of another variant 2300 of the first unit panel 200 in FIG. 5(*b*). The variant 2300 has a similar structure with the variant 2200 and thus features of the variant 2300 herein are made references to the variant 2200 illustrated in FIG. 9. Similarly, the first thermal insulation layer 206 is sandwiched between the first structural panel 202 and the first lining sheet 204; but the first thermal insulation layer 206 is attached to the external surface 228 of the first structural panel 202 due to the complete encapsulation of the first structural panel 202 by the first lining sheet 204 similar to the variant 2000 in FIG. 7. Therefore, the first thermal insulation layer 206 for a variant 2300 is known as an external insulation layer. Meanwhile, the first lining sheet 204 is in direct contact with the inner surface 226 of the first structural panel 202.

Figure 11:
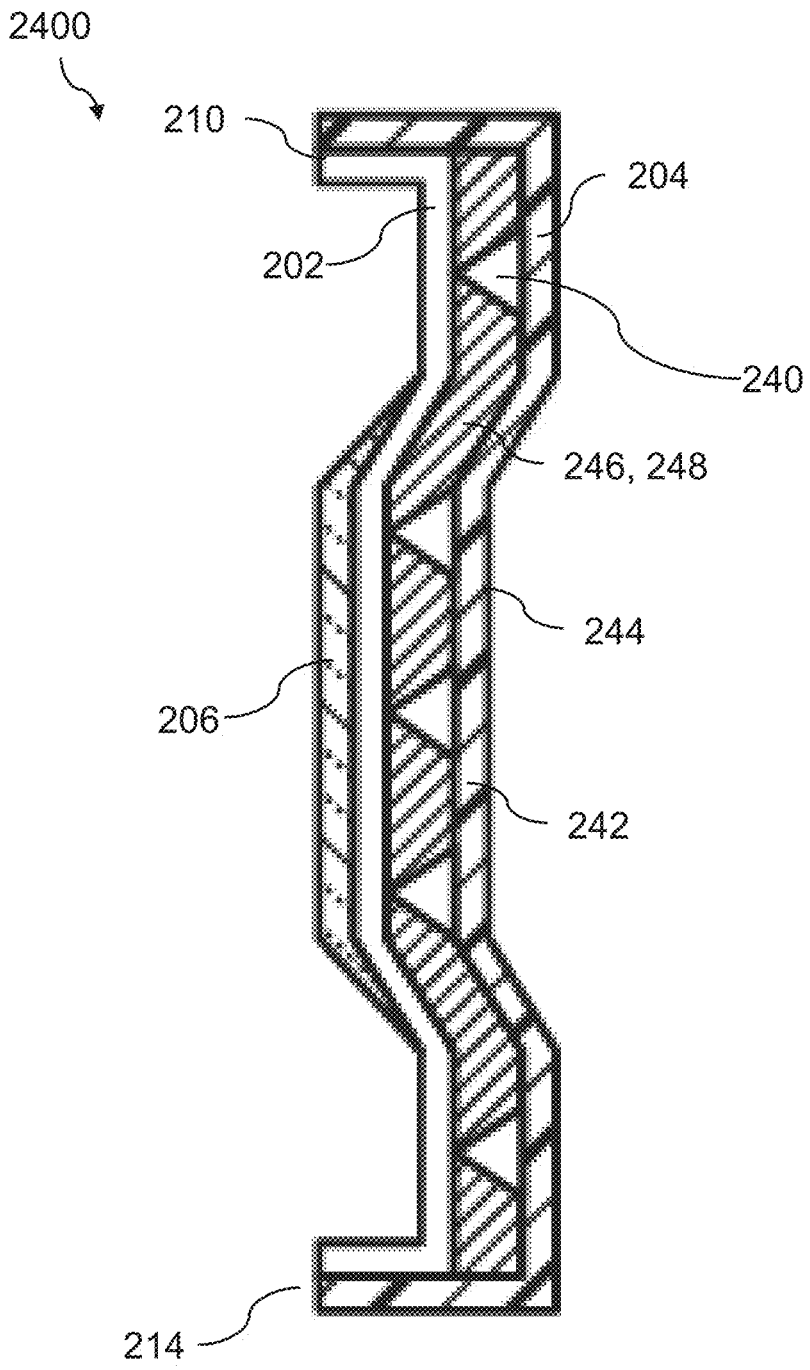
FIG. 11 illustrates a cross-sectional view of a modification to the first unit panel in FIG. 8 incorporated with studs.

FIG. 11 illustrate a cross-sectional view of a modification 2400 to the variant 2100 in FIG. 8 incorporated with studs 240. The studs 240 are either attached to the first side 242 of the first lining sheet 204 or attached to the inner surface 226 of the first structural panel 202. The first side 242 is assembled towards the first structural panel 202; and the second side 244 is in direct contact with water stored in the first unit panel tank 100. A continuous gap 246 is thus formed between the first structural panel 202 and the first side 242 of the first lining sheet 204. A porous filler 248 (such as aerogel) is filled inside the gap 246 as the first thermal insulation layer 206 for providing thermal insulation. The thermal insulation ensures that the first sectional panel tank 100 is still workable in high latitude countries in a cold winter or for special applications (such as spa). In addition, the porous filler 248 may also provide cushion to external shocks. The cushion function ensures that the first lining sheet 204 is tightly pushed against the first structural panel 202 under a pressure of the water stored inside the first sectional panel tank 100. In particular, the studs 240 do not exist at the flanges 210, 214, 218, 222 for tightly and reliably joined the first side 242 and the first structural panel 202.

Figure 12:
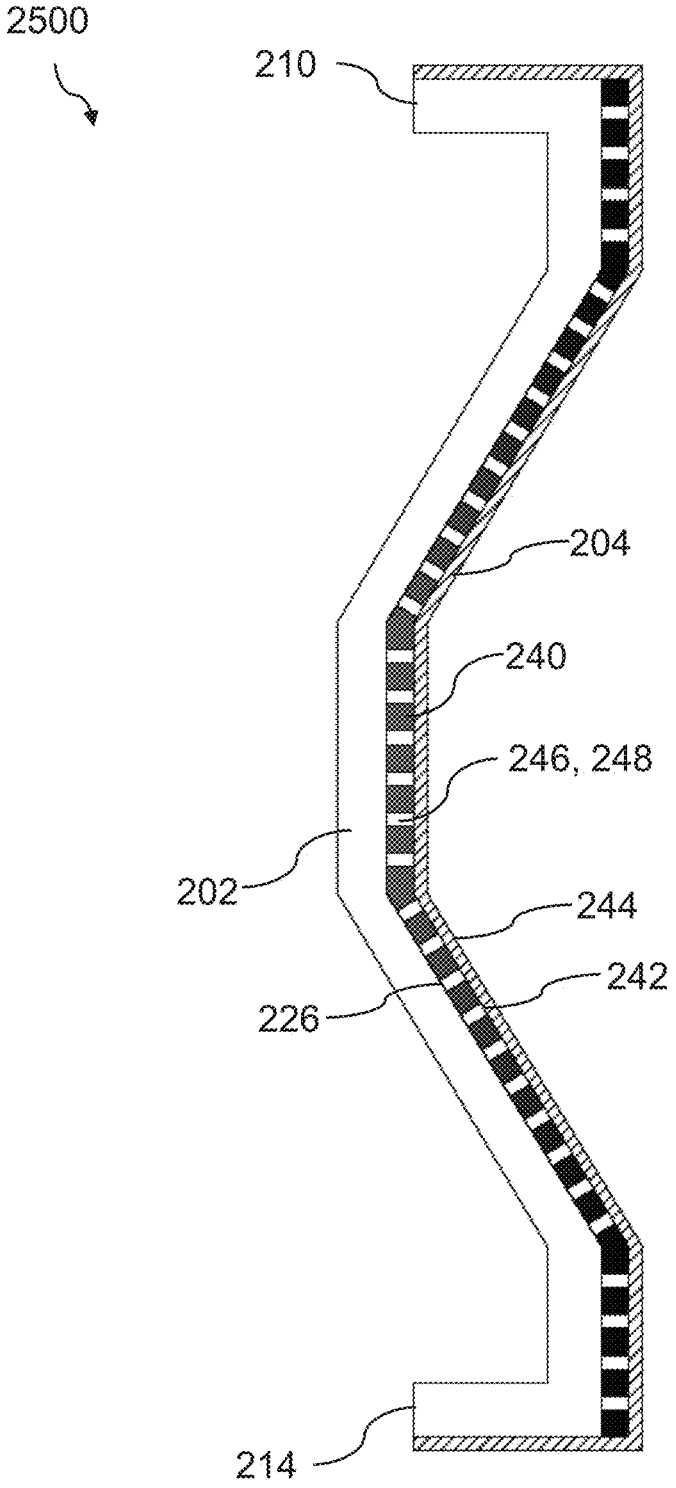
FIG. 12 illustrate a cross-sectional view of a modification to the variant in FIG. 9 incorporated with studs.

FIG. 12 illustrates a cross-sectional view of a modification 2500 to the variant 2200 in FIG. 9 with the studs 240. Similar to the modification 2400 in FIG. 11, the modification 2500 also has the filler 248 filled inside the gap 246 as the first thermal insulation layer 206. At the flanges 210, 214, 218, 222, the first lining sheet 204 is in direct with the first structural panel 202 without the studs 240.

Figure 13:
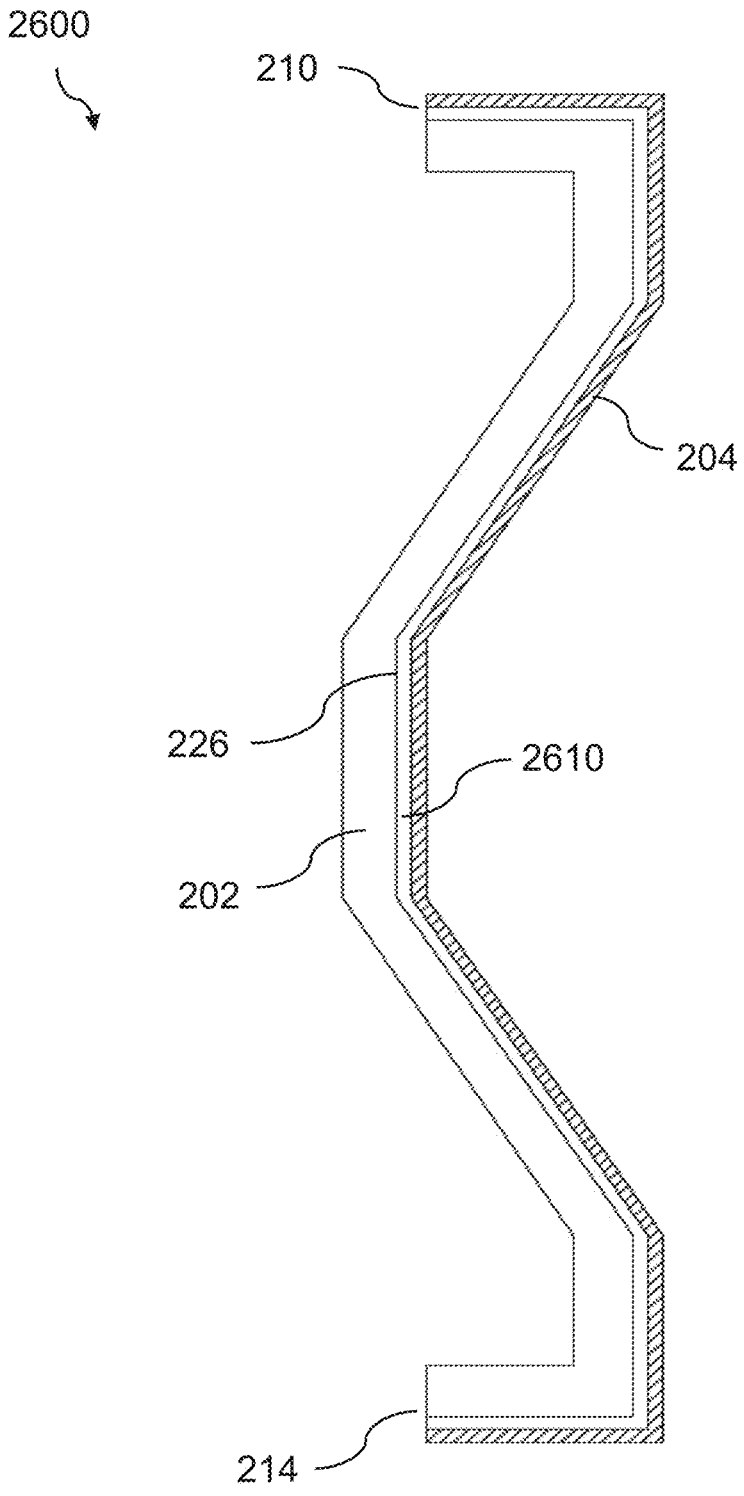
FIG. 13 illustrate a cross-sectional view of another modification to the first unit panel in FIG. 5(*b*) incorporated with an adhesive layer.

FIG. 13 illustrates a cross-sectional view of another modification 2600 to the first unit panel 200 in FIG. 5(*b*) with an adhesive layer 2610 when the first lining sheet 204 has a fabric backed liner (FBL). The adhesive layer 2610 adheres the fabric backed liner (FBL) to the inner surface 226 of the first structural panel 202.

A second unit panel 250 is provided for being joined with the first unit panel 200 for forming the first sectional panel tank 100. The second unit panel 250 is identical to the first unit panel 200 as described in FIG. 5. In other words, the second unit panel 200 comprises a second structural panel 252, a second lining sheet 254 and a second extension 258, which resemble the first structural panel 202, the first lining sheet 204 and the first extension 208, respectively. The second extension 258 further comprises a second front flange 260 folded at a second front edge 262, a second rear flange 264 folded at a second rear edge 266, a second left flange 268 folded at a second left edge 270, and a second right flange 272 folded at a second right edge 274. The second lining sheet 254 is also formed on an inner surface 276 and an external surface 278 of the second unit panel 250. The second unit panel 250 also comprises a second embossment 280 for further strengthening mechanical properties of the second structural panel 252.

Figure 14:
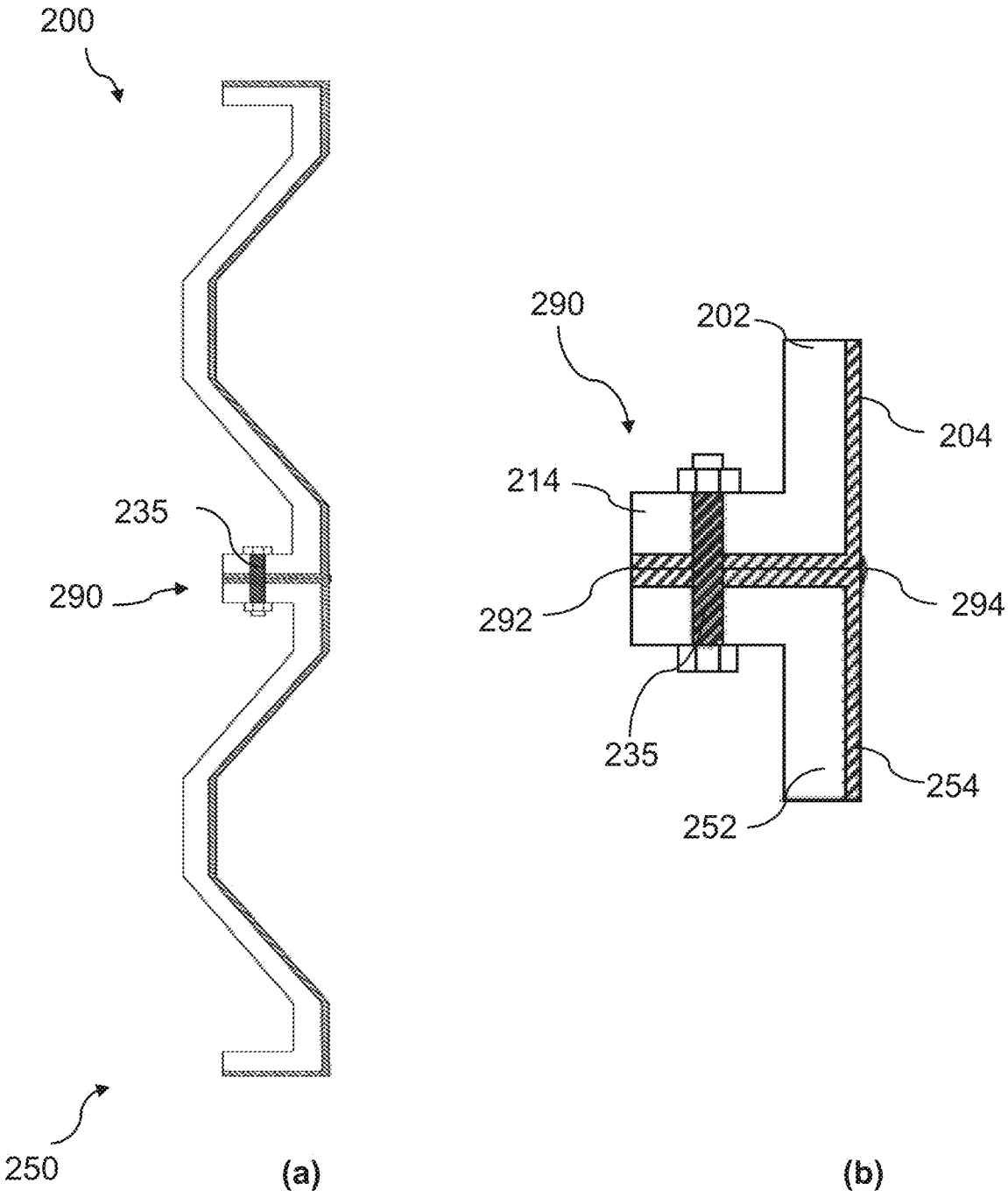
FIG. 14 illustrates (a) a cross-sectional view of two identical unit panels in FIG. 5(*b*) vertically joined together at a joint, and (b) an enlarged cross-sectional view of the joint.

FIG. 14(*a*) illustrates a cross-sectional view of the first unit panel 200 at a top side and the second unit panel 250 at a bottom side vertically joined together at a joint 290. The unit panels 200, 250 are joined for forming the side walls 106, 108, 110, 112 of the first sectional panel tank 100 in FIG. 1 to FIG. 4. The first unit panel 200 and the second unit panel 250 are joined at the joint 290 between the first rear flange 214 and the second front flange 260 by a thermoplastic welding method. In addition, a fastener 235 (such as a screw (Nut and Bolt)) also binds the first rear flange 214 and the second front flange 260 at the joint 209.

FIG. 14(*b*) illustrates an enlarged cross-sectional view of the joint 290 in FIG. 14(*a*). It is clearly seen that the first rear flange 214 and the second front flange 260 are joined together at the joint 290. In detail, the first lining sheet 204 and the second lining sheet 254 are pressed in direct contact at the joint 290. The joint 290 comprises a seam 292 even if the first lining sheet 204 and the second lining sheet 254 are closely pressed against each other. The thermoplastic welding introduces a jointer 294 for joining the first lining sheet 204 and the second lining sheet 254. The jointer 294 is so strong and reliable that the joint 290 can seal the liquid 134 inside the first sectional panel tank 100 during its normal operation. In contrast to known techniques, no gasket is needed for preventing any leakage from the joint 290.

Figure 15:
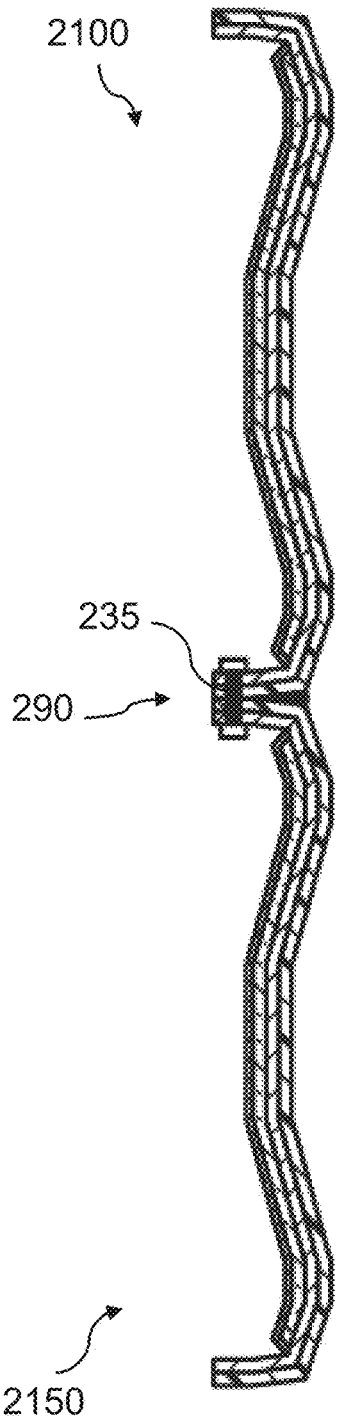
FIG. 15 illustrate (a) a cross-sectional view of two identical variants of the unit panels in FIG. 8 vertically joined together at a joint, and (b) an enlarged cross-sectional view of the joint.
Figure 15:
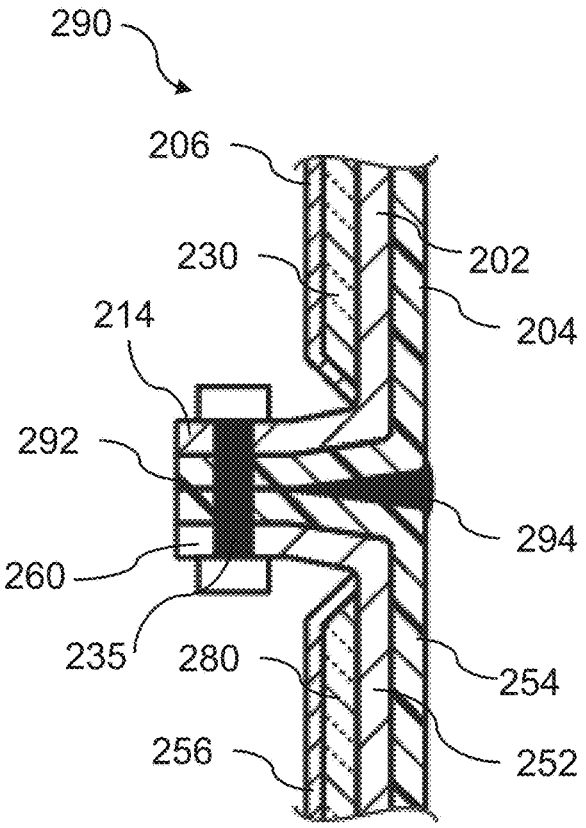

FIG. 15(*a*) illustrate a cross-sectional view of two identical variants 2100 in FIG. 8 vertically joined together at the joint 290, i.e. the variant 2100 at a top side and another variant 2150 at a bottom side, each of which has all the features of the variant 2100 in FIG. 8. The variants 2100, 2150 are joined for forming the side walls 106, 108, 110, 112 of the first sectional panel tank 100 in FIG. 1 to FIG. 4. Similarly, the variants 2100 and 2150 are joined at the joint 290 between the first rear flange 214 and the second front flange 260 by a thermoplastic welding method. In addition, the fastener 235 is also used to bind the first rear flange 214 and the second front flange 260 at the joint 290. In addition, the second variant 2150 has a second thermal insulation layer 256.

FIG. 15(*b*) illustrates an enlarged cross-sectional view of the joint 290. It is also clearly seen that the first rear flange 214 and the second front flange 260 are joined together at the joint 290 by thermoplastic welding which introduces the jointer 294 for sealing the seam 292. Similar to the FIG. 14(*b*), no gasket is needed for preventing any leakage from the joint 290. In addition, the first thermal insulation layer 206, the first embossment 230, the second thermal insulation layer 256 and the second embossment 280 terminate outside the joint 290.

Figure 16:
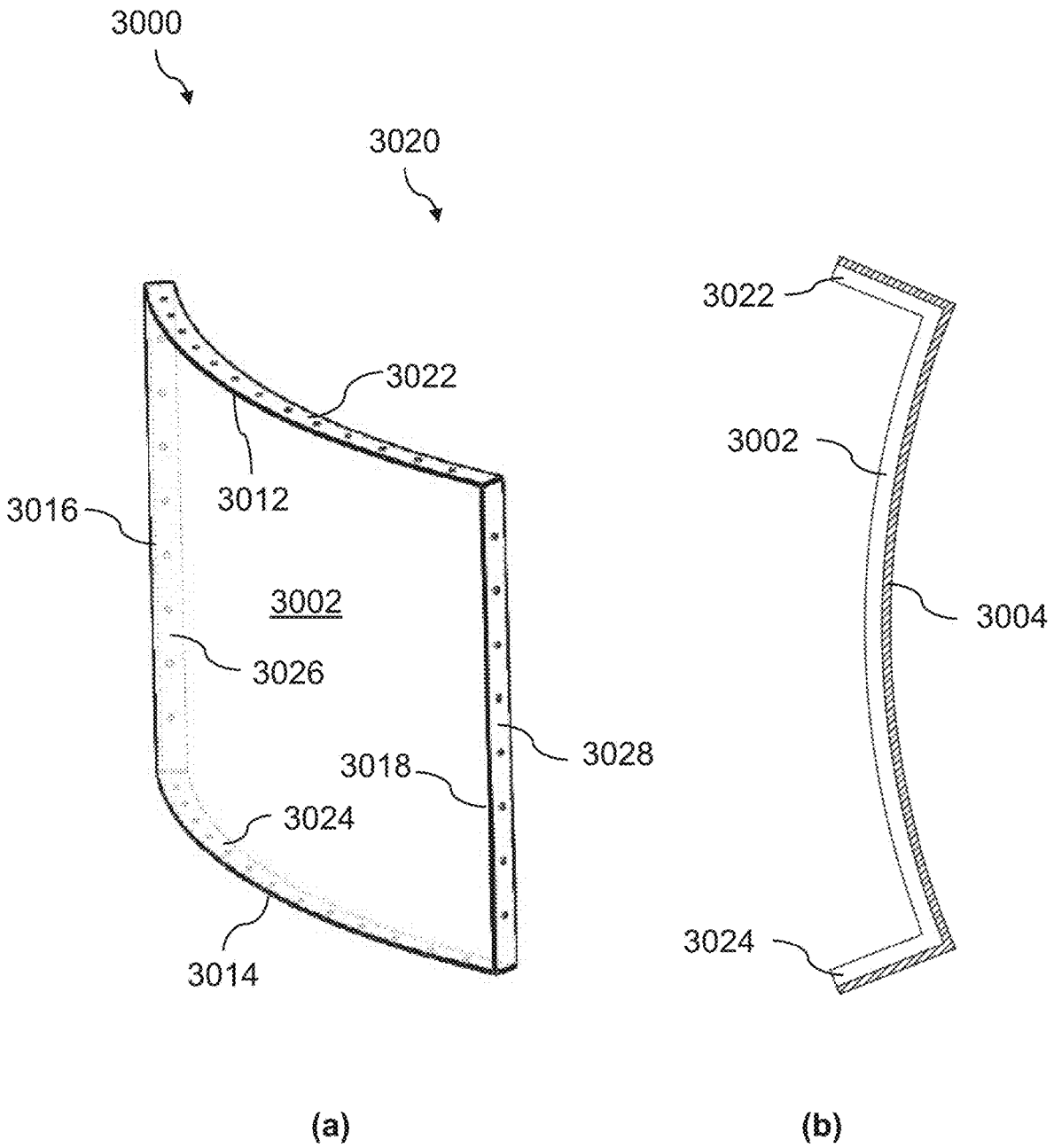
FIG. 16 illustrates (a) an isometric view and (b) a cross-sectional view of a curved unit panel from an external point of view.

FIG. 16 illustrates (a) an isometric view and (b) a cross-sectional view of a curved unit panel 3000 from an external point of view. Similar to the unit panel 200 in FIG. 5(*b*), the curved unit panels 3000 has a curved structural panel 3002 which further has an extension 3020. The extension 3020 has a front flange 3022 folded at a front edge 3012, a rear flange 3024 folded at a rear edge 3014, a left flange 3026 folded at a left edge 3016 and a right flange 3028 folded at a right edge 3018. In addition, the curved unit panel 3000 has a curved lining sheet 3004 encapsulating an inner surface 3008 of the curved structural panel 3002, including the extension 3020 (i.e. the flanges 3022, 3024, 3026, 3028).

Figure 17:
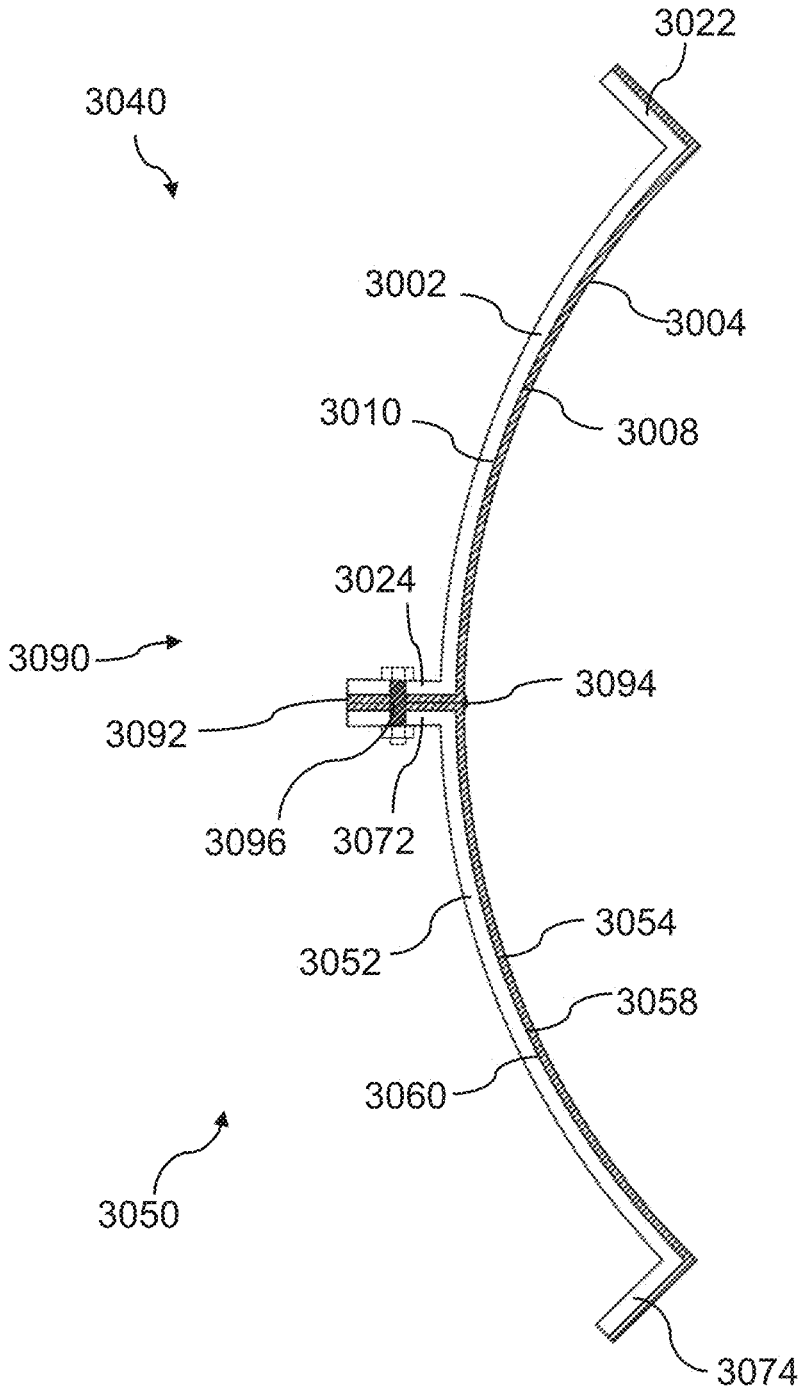
FIG. 17 illustrates a cross-sectional view of two identical curved unit panels joined together.

FIG. 17 illustrates a cross-sectional view of two identical curved unit panels joined together, i.e. a first curved unit panel 3040 and a second curved unit panel 3050, which have the same structures to the curved unit panel 3000 in FIG. 16. In other words, the second curved unit panel 3050 has a second structural panel 3052 which further has a second extension 3070. The second extension 3070 has a second front flange 3072 folded at a second front edge 3062, a second rear flange 3074 folded at a second rear edge 3064, a second left flange 3076 (not shown) folded at a second left edge 3066 (not shown) and a second right flange 3078 (not shown) folded at a second right edge 3068 (not shown). In addition, the second curved unit panel 3050 has a second lining sheet 3054. Similar to the joined unit panels 200, 250 in FIG. 14, the first and the second curved unit panels 3040, 3050 are joined together at a joint 3090. In detail, the curved lining sheet 3004 and the second lining sheet 3054 are pressed in direct contact at the joint 3090. The joint 3090 comprises a seam 3092 even if the curved lining sheet 3004 and the second lining sheet 3054 are closely pressed against each other. The thermoplastic welding introduces a jointer 3094 for joining the curved lining sheet 3004 and the second lining sheet 3054. A fastener 3096 (such as a screw) is also used to bind the rear flange 3024 and the second front edge 3062 at the joint 3009. In contrast to known techniques, no gasket is needed for preventing any leakage from the joint 3090.

Figure 18:
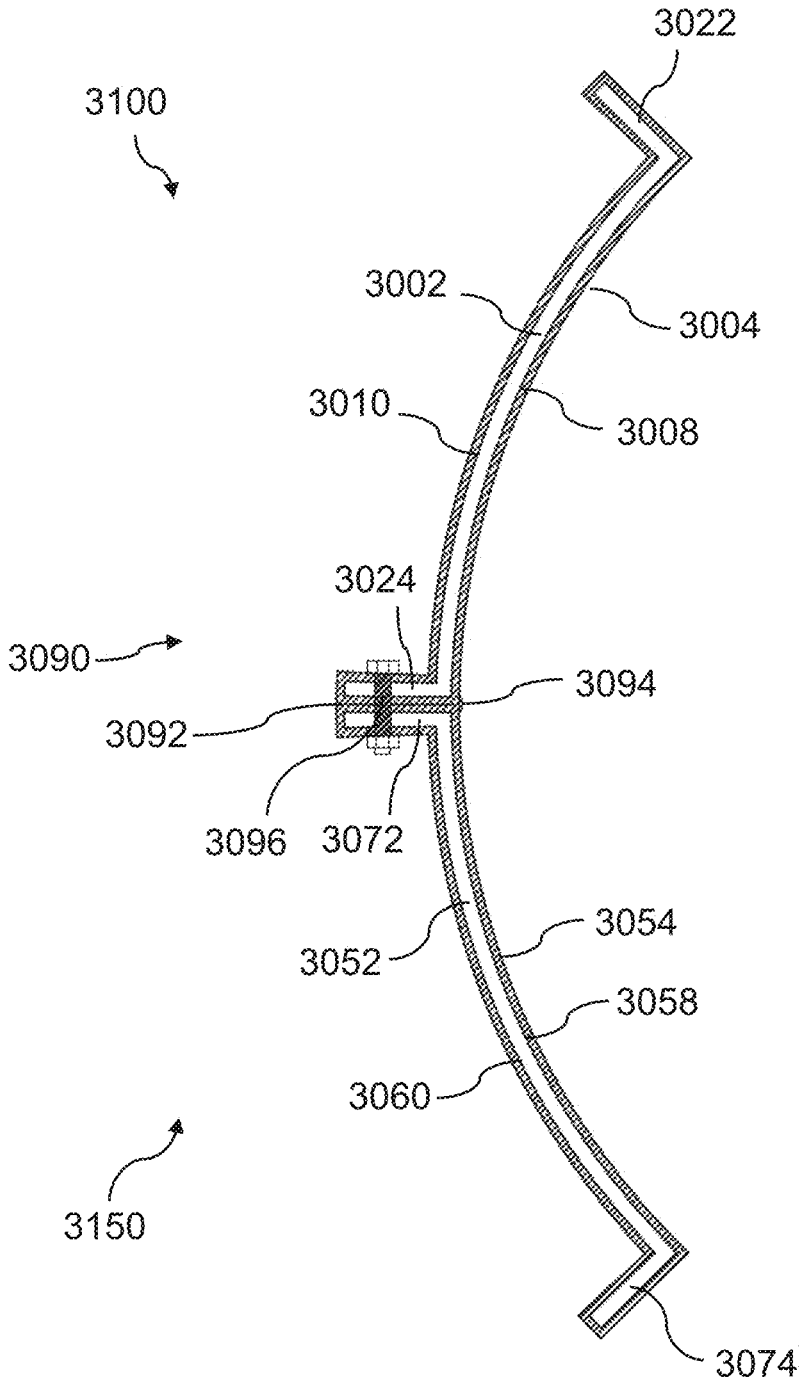
FIG. 18 illustrates a cross-sectional view of two identical variants of the curved unit panels joined together.

FIG. 18 illustrates a cross-sectional view of two identical variants of the curved unit panels joined together; i.e. a first variant 3100 and a second variant 3150. The variants 3100, 3150 have a similar structure with the curved unit panels 3040, 3050 and thus features of the variants 3100, 3150 herein are made references to the curved unit panels 3040, 3050 illustrated in FIG. 17. Different from the curved unit panels 3040, 3050, the curved lining sheet 3004 encapsulates the curved structural panel 3002 entirely, including the inner surface 3008 and an external surface 3010 of the curved structural panel 3002. Similarly, the second lining sheet 3054 encapsulates the second structural panel 3052 entirely, including a second inner surface 3058 and a second external surface 3060 of the second structural panel 3052. The embodiment in FIG. 18 is suitable for the cases where a smaller cylindrical sectional panel tank sits within a bigger cylindrical sectional tank; which contain different substances (such as different liquids) respectively.

Figure 19:
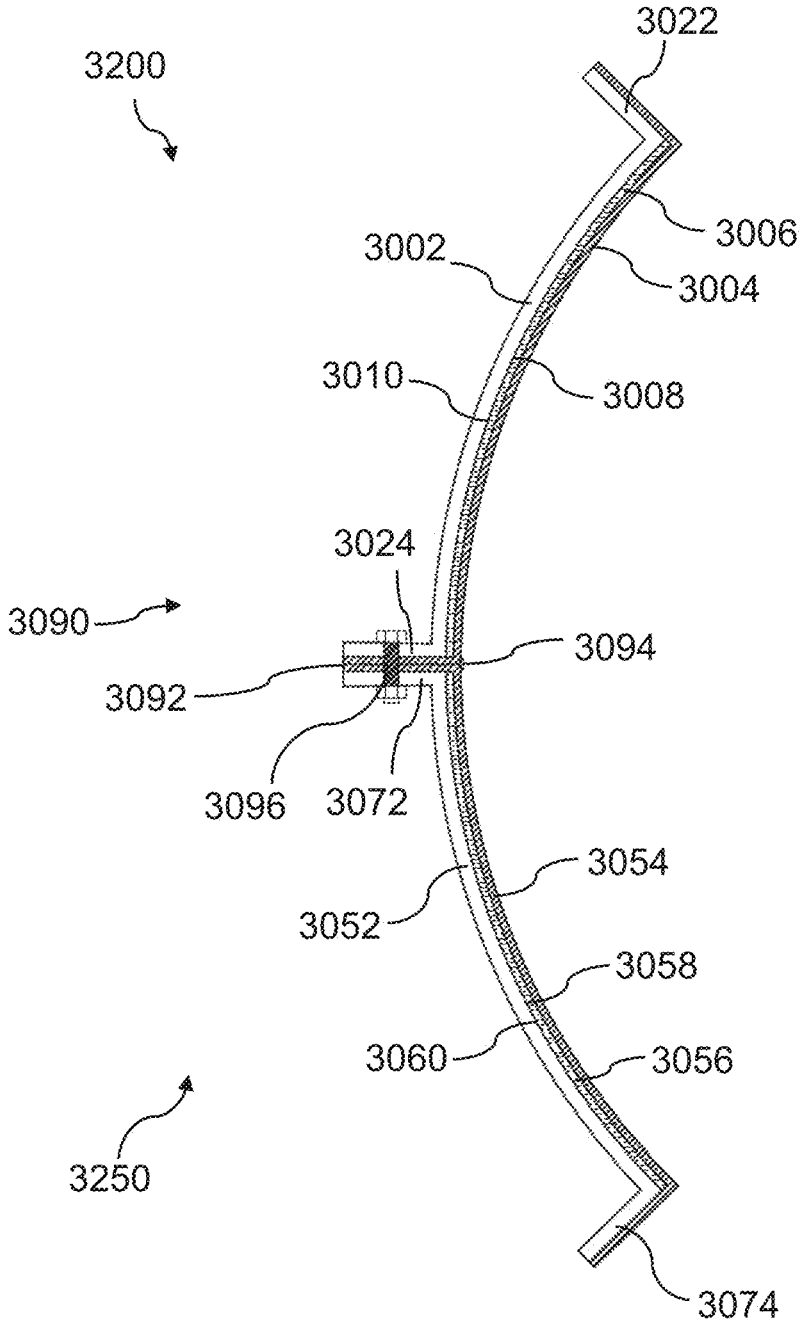
FIG. 19 illustrates a cross-sectional view of another two identical variants of the curved unit panels joined together.

FIG. 19 illustrates a cross-sectional view of another two identical variants of the curved unit panels joined together, i.e. a first variant 3200 and a second variant 3250. The variants 3200, 3250 have a similar structure with the curved unit panels 3040, 3050 and thus features of the variants 3200, 3250 herein are made references to the curved unit panels 3040, 3050 illustrated in FIG. 17, Different from the curved unit panels 3000, 3050, the variants 3200, 3250 have a curved thermal insulation layer 3006 and a second thermal insulation layer 3056 respectively. The curved thermal insulation layer 3006 is sandwiched between the curved lining sheet 3004 and the inner surface 3008; while the second thermal insulation layer 3056 is also sandwiched between the second lining sheet 3054 and the second inner surface 3058.

Figure 20:
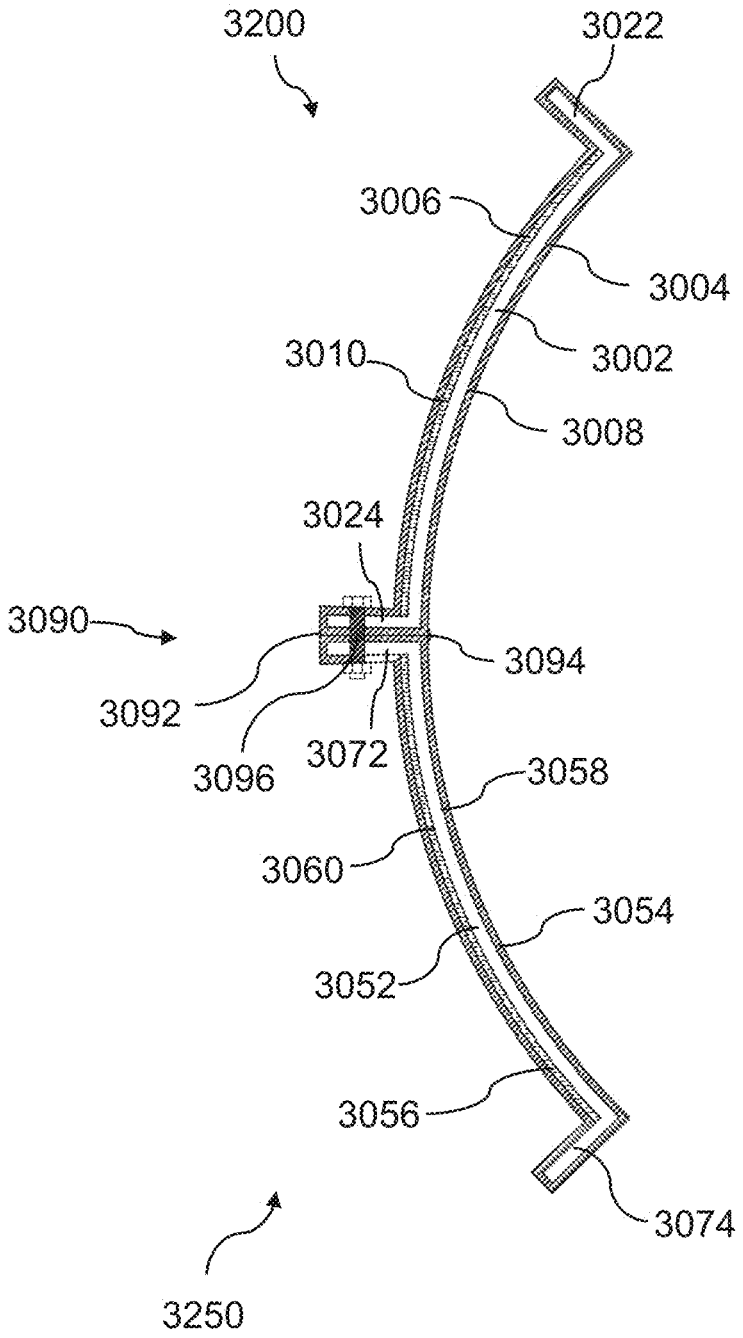
FIG. 20 illustrates a cross-sectional view of another two identical variants of the curved unit panels joined together.

FIG. 20 illustrates a cross-sectional view of another two identical variants of the curved unit panels joined together, i.e. the first variant 3200 and the second variant 3250. The variants 3200, 3250 have a similar structure with the variants 3100, 3150 and thus features of the variant 3200, 3250 herein are made references to the curved unit panels 3100; 3150 illustrated in FIG. 19. In comparison; the curved thermal insulation layer 3006 is sandwiched between the curved lining sheet 3004 and the external surface 3010; while the second thermal insulation layer 3056 is also sandwiched between the second lining sheet 3054 and the second externals surface 3060.

Figure 21:
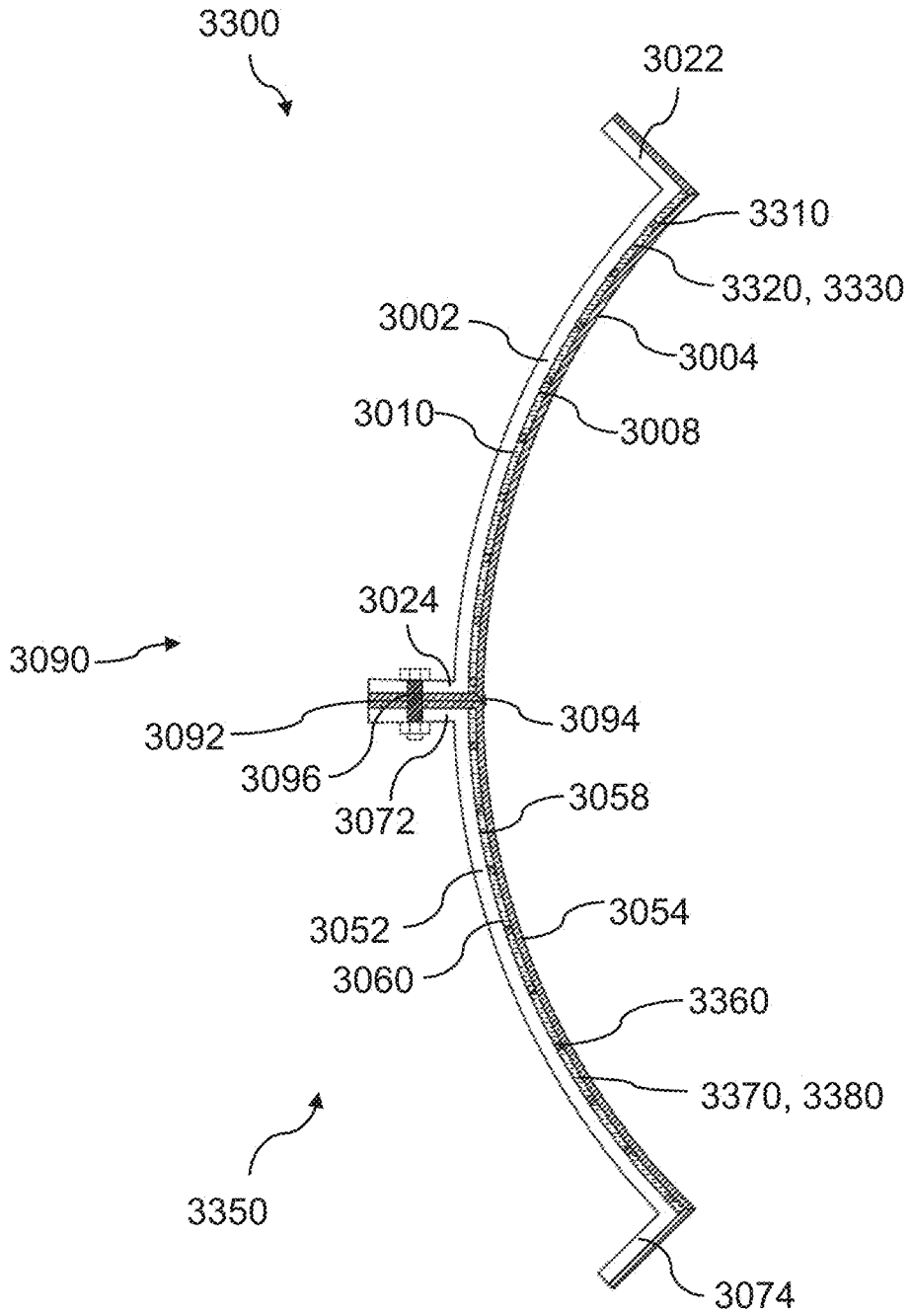
FIG. 21 illustrates a cross-sectional view of two identical modifications of the curved unit panels joined together.

FIG. 21 illustrates a cross-sectional view of two identical modifications of the curved unit panels joined together, i.e. a first modification 3300 and a second modification 3350. The modifications 3300, 3350 have a similar structure with the curved unit panels 3040, 3050 and thus features of the modification 3300, 3350 herein are made references to the curved unit panels 3040, 3050 illustrated in FIG. 17. In addition, the first modification 3300 has first studs 3310 sandwiched between the inner surface 3008 and the curved lining sheet 3004 for forming a first gap 3320; while the second modification 3350 has second studs 3360 sandwiched between the second inner surface 3508 and the second lining sheet 3504 for forming a second gap 3370. A first filler 3330 and a second filler 3380 are filled into the first gap 3320 and the second gap 3370, respectively. Similar to the filler 248 in FIG. 11 and FIG. 12, the fillers 3330, 3380 may act as the thermal insulation layers 3306, 3356 for providing thermal insulation. Alternatively, the filers 3330, 3380 may provide cushion to external shocks. The first filer 3330 and the second filer 3380 may be the same or different.

Figure 22:
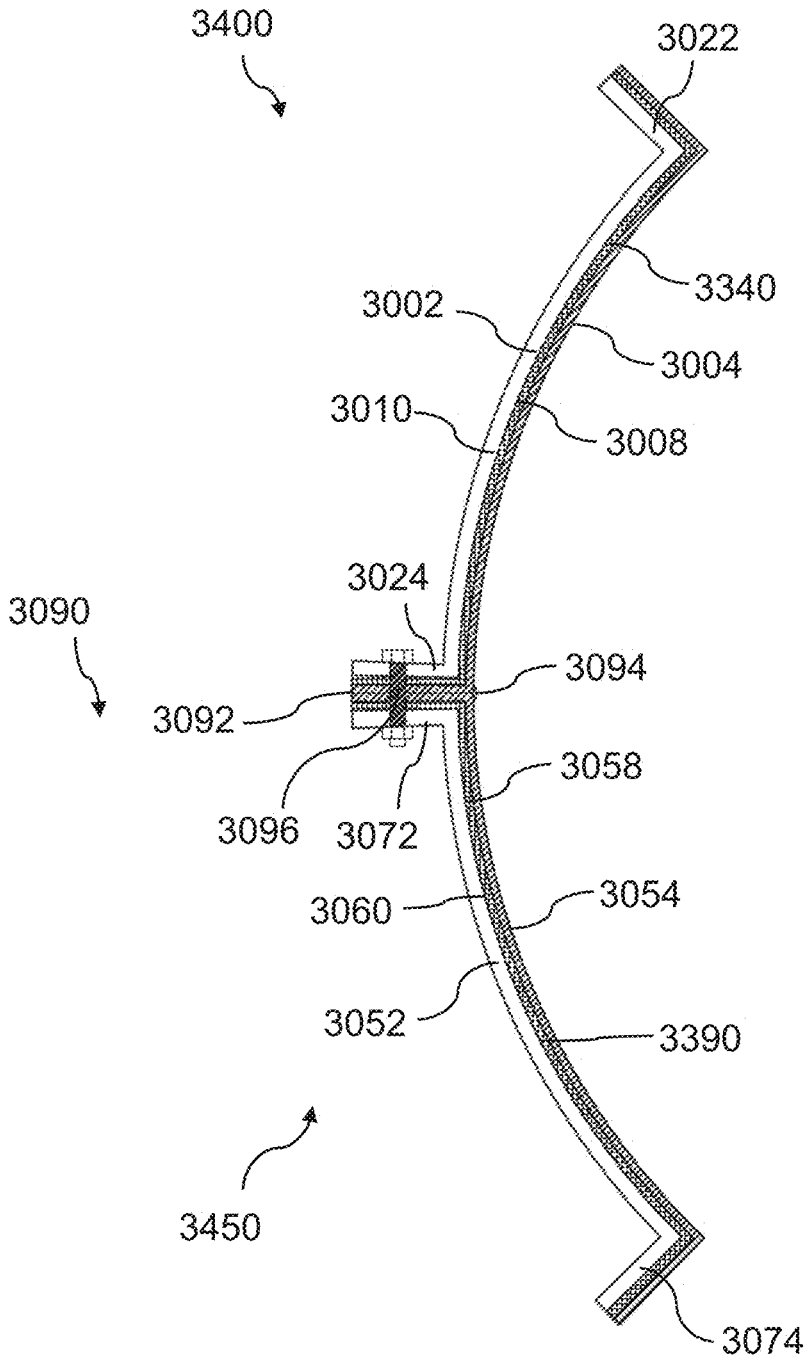
FIG. 22 illustrates a top planar view of another two identical modifications of the curved unit panels joined together.

FIG. 22 illustrates a cross-sectional view of another two identical modifications of the curved unit panels joined together, i.e. a first modification 3400 and a second modification 3450. The modifications 3300, 3350 have a similar structure with the curved unit panels 3040, 3050 and thus features of the modification 3300, 3350 herein are made references to the curved unit panels 3040, 3050 illustrated in FIG. 17. The modifications 3300, 3350 have a first adhesive layer 3340 and a second adhesive layer 3390, respectively when the lining sheets 3304, 3354 have fabric backed liner (FBL). The adhesive layers 3340, 3390 adhere the fabric backed liner (FBL) to the inner surfaces 3308, 3358 respectively.

Figure 23:
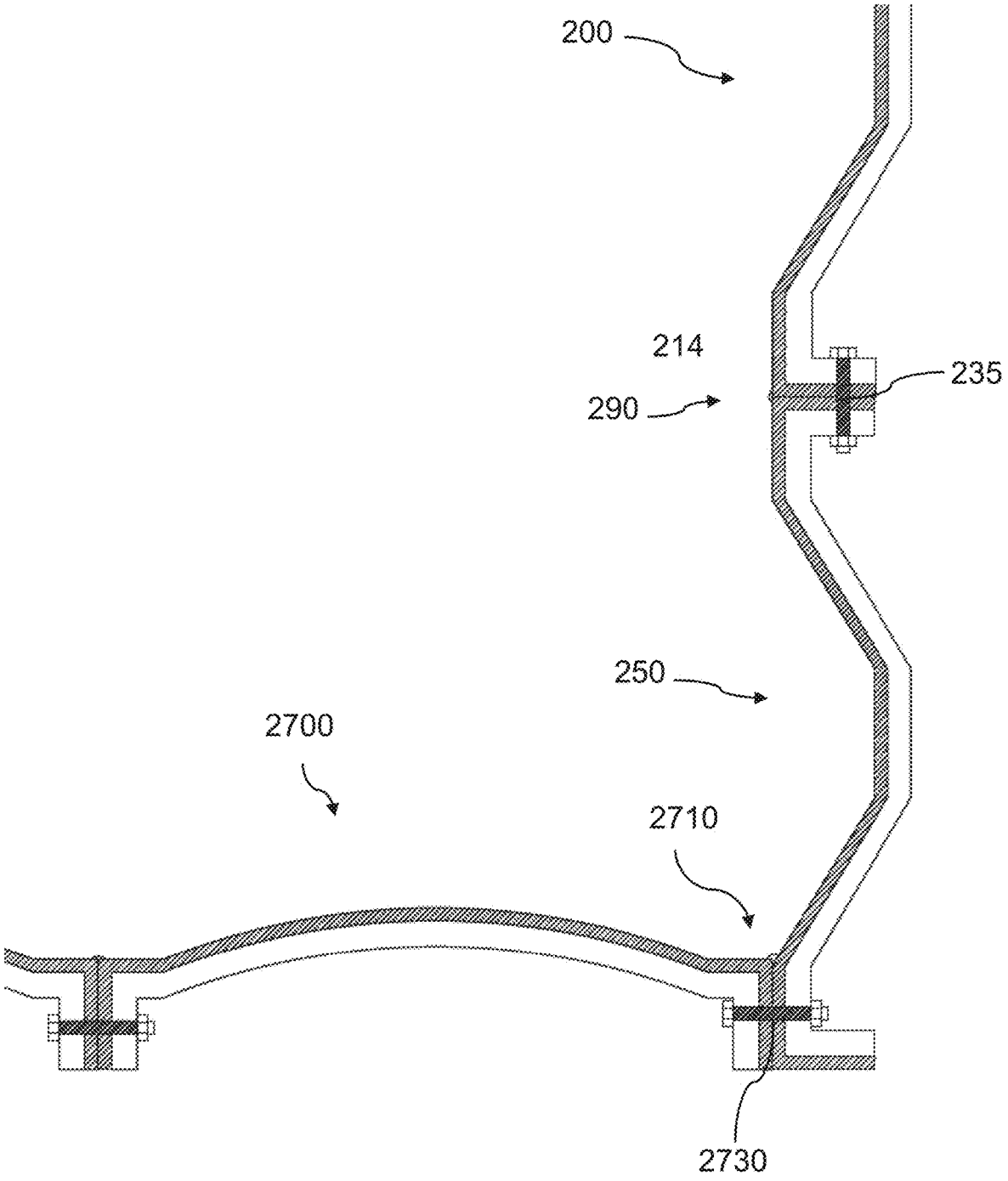
FIG. 23 illustrates a planar top view of three unit panels of FIG. 5(*b*) joined together.

FIG. 23 illustrates a cross-sectional view of three unit panels of FIG. 5(*b*) joined together, i.e. the first unit panel 200, the second unit panel 250 and a third unit panel 2700 vertically joined at the joint 290 and a joint 2710 in sequence for forming the right wall 112 and the front wall 106, respectively. Similar to the fastener 235, another fastener 2730 is used to further secure the joint 2710.

Figure 24:
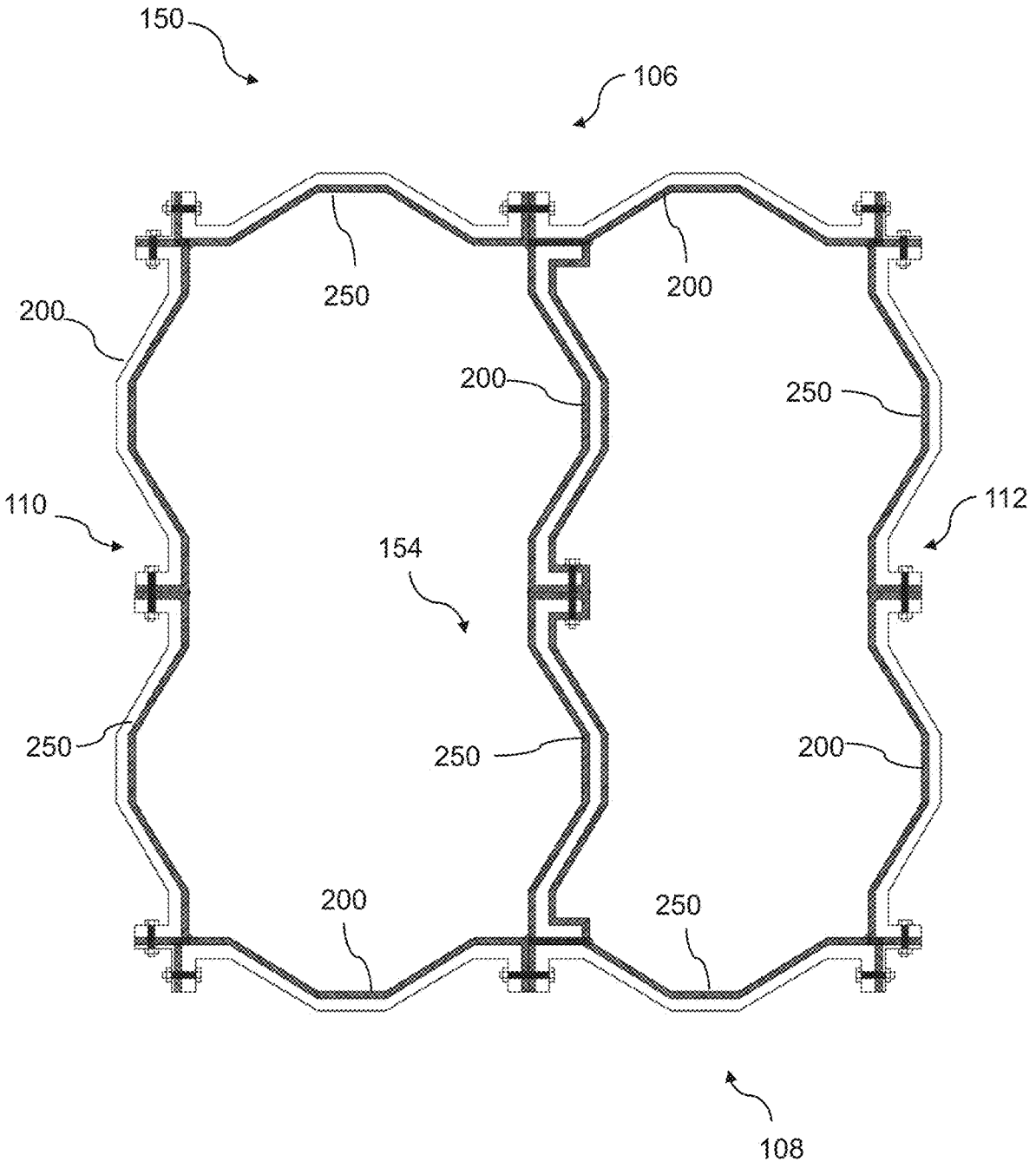
FIG. 24 illustrates a planar top view of multiple unit panels of FIG. 5(*b*) joined together.

FIG. 24 illustrates a top planar view of multiple unit panels of FIG. 5(*b*) joined together for forming the variant 150 of the first sectional unit panel 100. In details, the first unit panels 200 and the second unit panels 250 are joined for forming the front wall 106, the rear wall 108, the left wall 110, the right wall 112 and partition 154, respectively.

Figure 25:
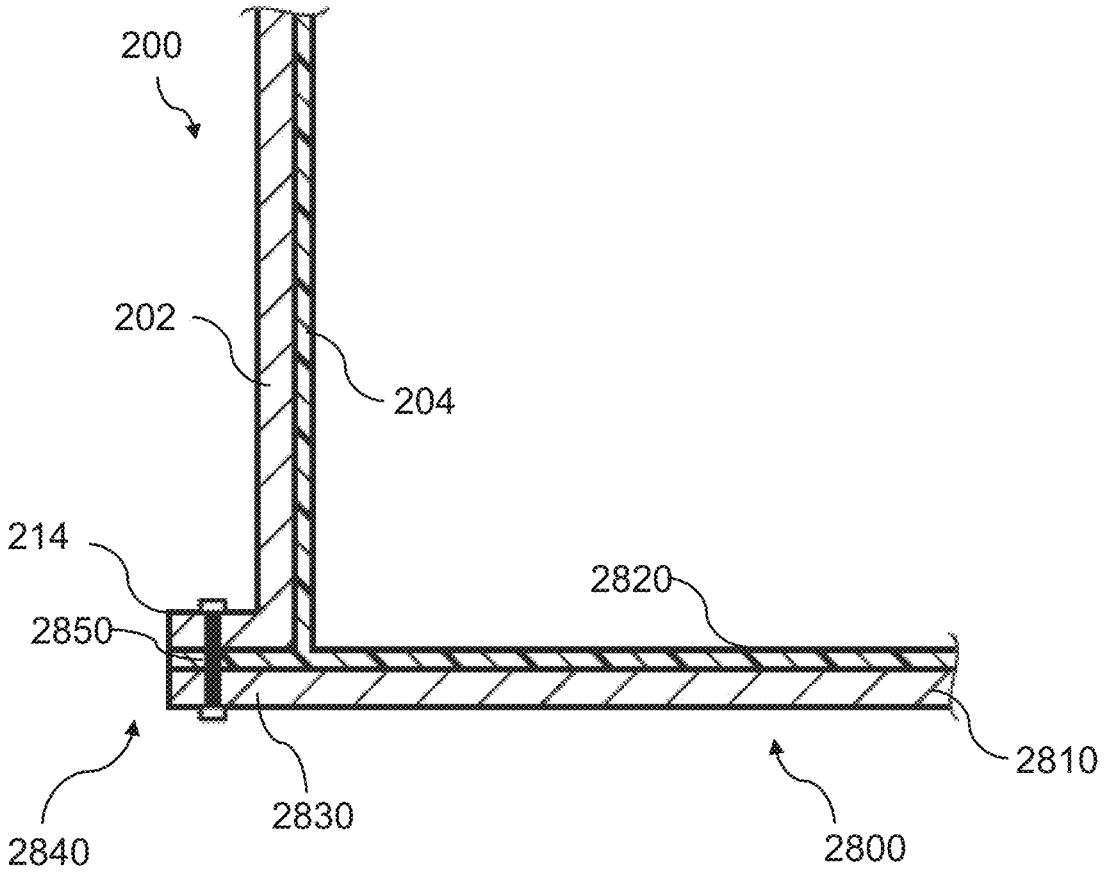
FIG. 25 illustrates a cross-sectional view of a unit panel of FIG. 5(*b*) and a planar unit panel orthogonally joined together.

FIG. 25 illustrates a cross-sectional view of the first unit panel 200 of FIG. 5(*b*) and a planar unit panel 2800 orthogonally joined together. The planar unit panel 2800 has a planar structural panel 2810 and a planar lining sheet 2820 formed together. The first unit panel 200 and the planar unit panel 2800 are joined at a joint 2840 with the first rear flange 214 and a left end 2830 of the planar unit panel 2800. In addition, a fastener 2850 is used to further secure the joint 2840.

Figure 26:
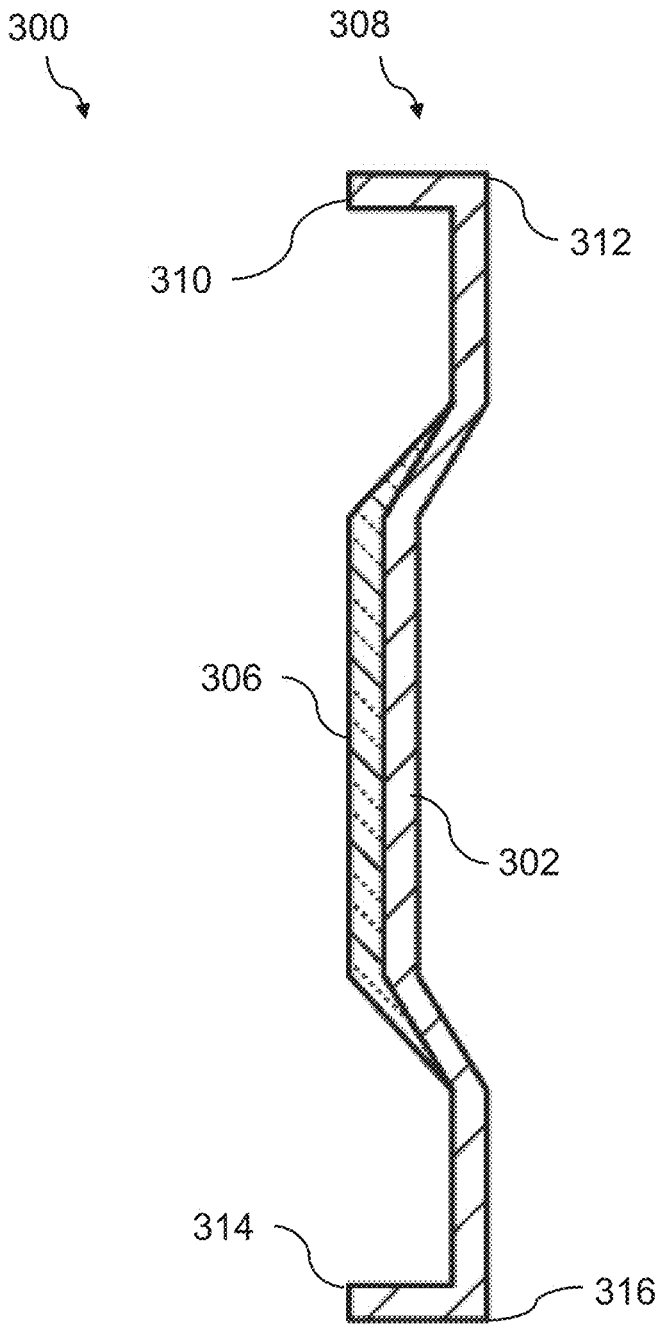
FIG. 26 illustrates a cross-sectional view of another unit panel without a lining sheet.

FIG. 26 illustrates a cross-sectional view of another unit panel, i.e. a third unit panel 300. Similar to the first unit panel 200 or the second unit panel 250, the third unit panel 300 comprises a third structural panel 302, a third thermal insulation layer 306, and a third extension 308. The third extension 308 further comprises a third front flange 310 folded at a third front edge 312, a third rear flange 314 folded at a third rear edge 316, a third left flange 318 (not shown) folded at a third left edge 320 (not shown), and a third right flange 322 (not shown) folded at a third right edge 324 (not shown). However, the third unit panel 300 does not have a lining sheet similar to the first lining sheet 204 or the second lining sheet 254.

In addition to the third unit panel 300, a fourth unit panel 350 is provided for being joined with the third unit panel 300. The fourth panel 350 is identical to the third unit panel 300 as described in FIG. 26. In other words, the fourth unit panel 300 comprises a fourth structural panel 352, a fourth thermal insulation layer 356, and a fourth extension 358. The fourth extension 358 further comprises a fourth front flange 360 folded at a fourth front edge 362, a fourth rear flange 364 folded at a fourth rear edge 366, a fourth left flange 368 folded at a fourth left edge 370, and a fourth right flange 372 folded at a fourth right edge 374.

Figure 27:
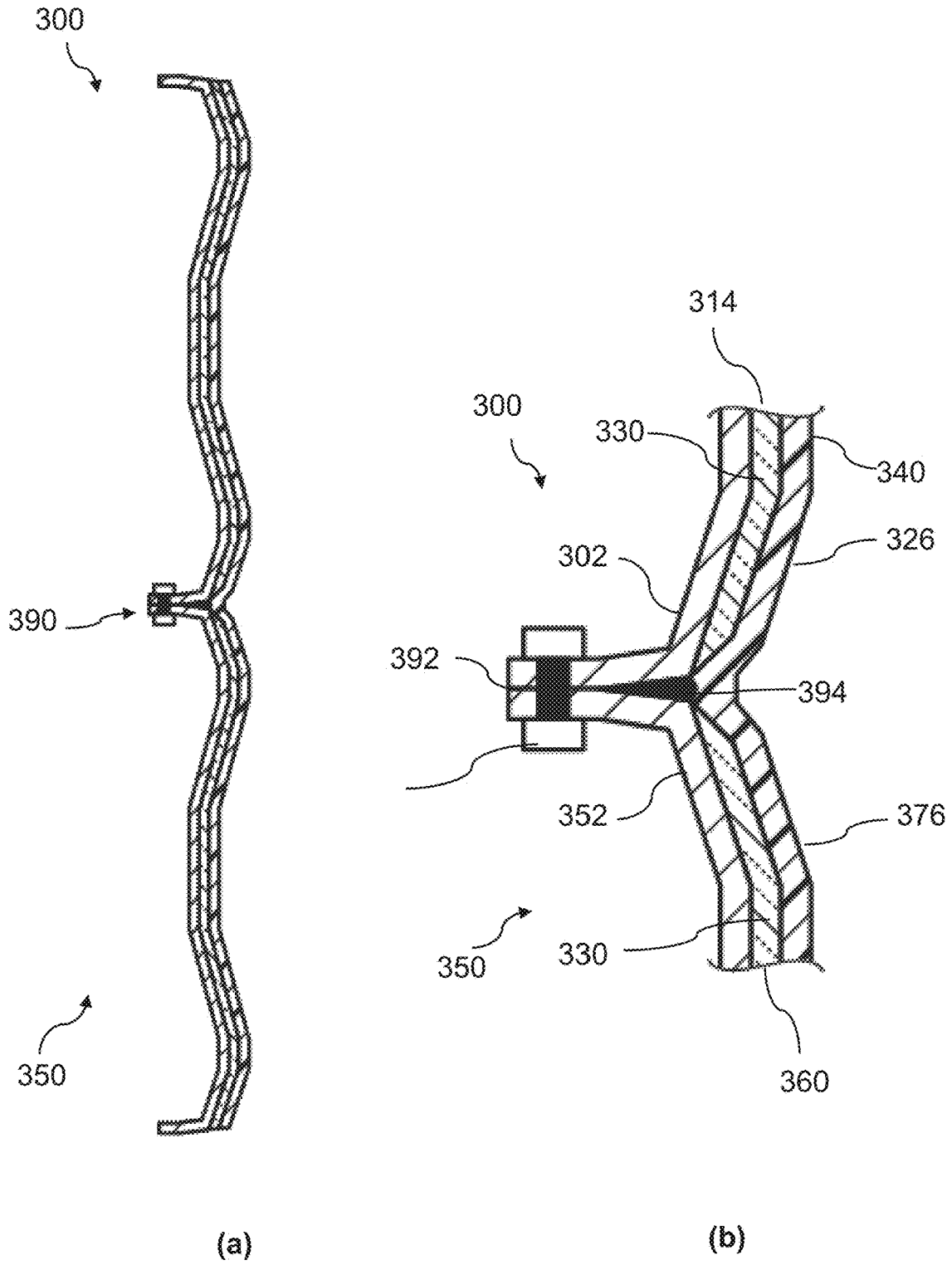
FIG. 27 illustrates a cross-sectional view of two unit panels of FIG. 26 vertically joined together.

FIG. 27(*a*) illustrates a cross-sectional view of two unit panels 300, 350 vertically joined for forming the side wall 106, 108, 110, 112 of the first sectional panel tank 100 in FIG. 1 to FIG. 4. The third unit panel 300 and the fourth unit panel 350 are joined at a joint 390 between the third rear flange 314 and the fourth front flange 360 by a metal welding method. The joint 390 comprises a seam 392 even if the third rear flange 314 and the fourth front flange 360 are closely pressed against each other. The metal welding introduces a jointer 394 for joining the third rear flange 314 and the fourth front flange 360. In contrast to known techniques, no gasket is needed for preventing any leakage from the joint 390. To further prolong the life time of the first sectional panel tank 100, a single and continuous lining 340, instead of the two lining sheets 204, 254 joined together, is used to cover an inner surface 326 of the third unit panel 300, the inner surface 376 of the fourth unit panel 350 and the joint 390 for preventing any leakage. Similarly, the unit panels 300, 350 are also horizontally joined together for forming the bottom 102 and/or the cover 104 of the first sectional panel tank 100. In addition, an adhesive 330 is applied to the third structural panel 302 and the fourth structural panel 352 before the lining 340 is applied for further fixing the lining in place.

FIG. 27(*b*) illustrates an enlarged cross-sectional view of a joint 390. The third rear flange 314 and the fourth front flange 360 are pressed against each other without a lining sheet or a known gasket in-between. The joint 390 comprises a seam 392 that is sealed by a jointer 394 by the solvent welding method. The lining 340 is then joined onto the joint 390 from the inner surfaces 326, 376 for further preventing any leakage from the joint 390.

Figure 28:
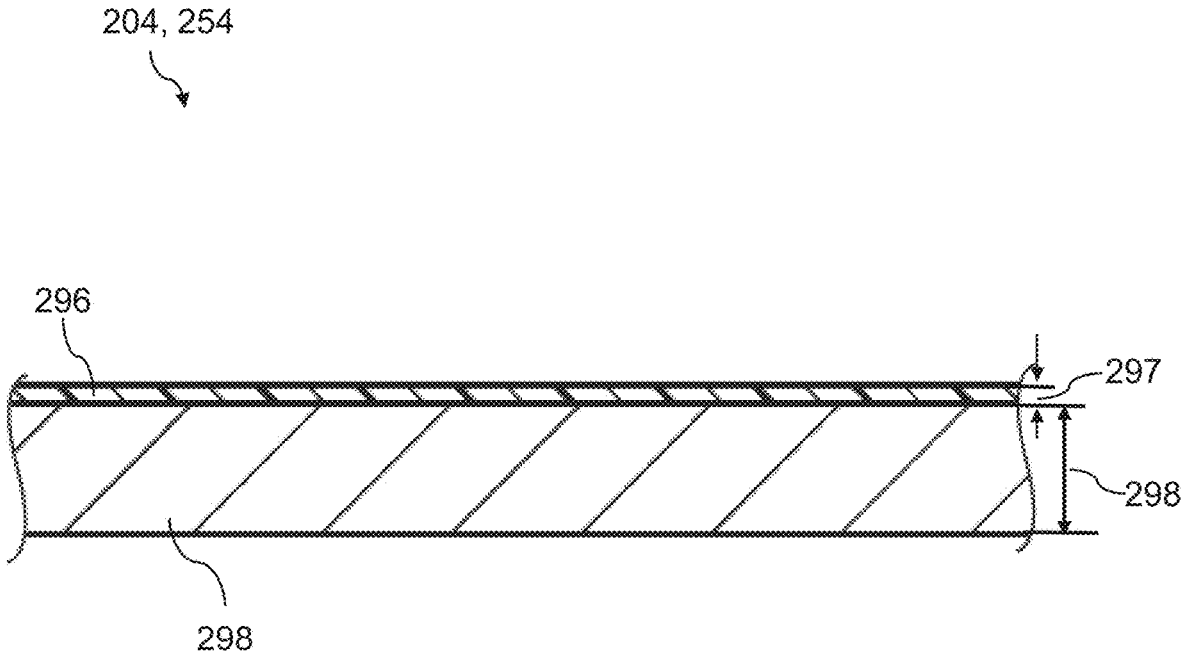
FIG. 28 illustrates an enlarged cross-sectional view of a lining sheet.

FIG. 28 illustrates an enlarged cross-sectional view of the lining sheet 204, 254. The lining sheet 204, 254 comprises a first layer 296 attached on the inner surfaces 226, 276 of the unit panels 200, 250; and a second layer 298 attached on the first layer 296. In this way, the second layer 298 is in contact with the liquid 134 stored inside the first sectional panel tank 100. The first layer 296 and the second layer 298 has a first thickness 297 and a second thickness 299 of 200 micrometres and 1.8 millimetres respectively. The first layer 296 and the second layer 298 are both made of a same thermoplastic material such as PE, PP, PVDF, ECTFE for easy and reliable attachment. Therefore, the lining sheet 204, 254 has dual protections for liquid leakage since both the first layer 296 and the second layer 298 are water-proof. In particular, the first layer 296 has a blue colour; while the second layer 298 has a black colour. Any erosion or destruction of the second layer 298 will uncover the first layer 296 for an easy vision inspection. If the first colour is observed in the inner surfaces 226, 276 of the lining sheet 204, 254, the second layer 298 needs to be replaced or repaired since it is already eroded or destructed. Similarly, the unit panels 200, 250 are also horizontally joined together for forming the bottom 102 and/or the cover 104 of the first sectional panel tank 100.

Figure 29:
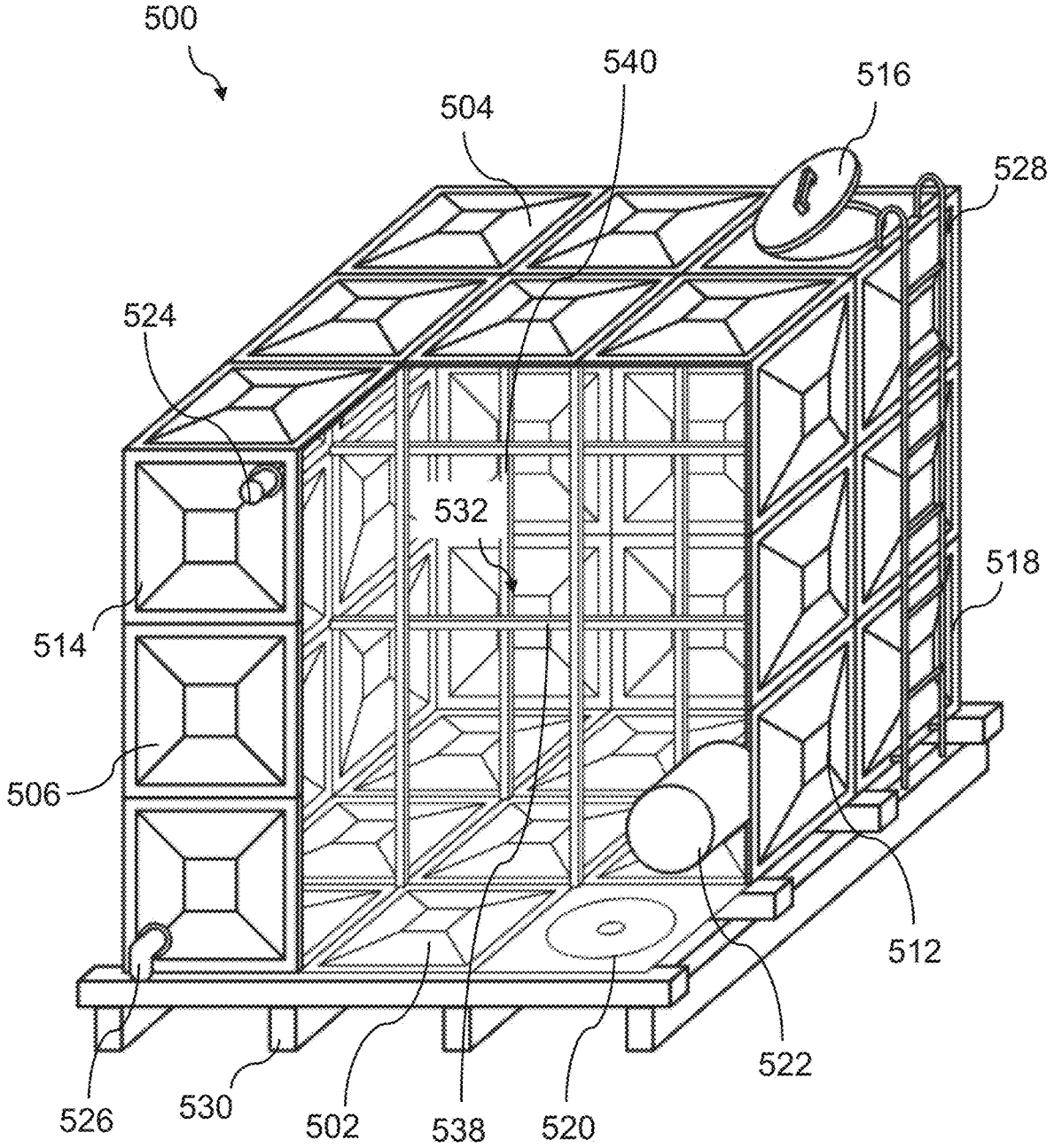
FIG. 29 illustrates a partially exploded view of a second sectional panel tank with an external foundation.

FIG. 29 illustrates a partially exploded view of a second sectional panel tank 500 with an external foundation 530. Similar to the first sectional panel tank 100, the second sectional panel comprises a bottom 502, a cover 504, a front wall 506, a rear wall 508 (not shown), a left wall 510 (not shown) and a right wall 512 that are built up by multiple unit panels 514. The second sectional panel 500 also comprises an access hole 516, a ladder 518, a drainage hole 520, a drainage tube 522, an inlet 524, an outlet 526 and the external foundation 530. A liquid 534 is stored inside the second sectional panel tank 500.

Instead of the external framework 132, the sectional panel tank 500 comprises an internal framework 532. The internal framework 532 comprises one or more rods 536 that connect the inner sides of two opposite unit panels 514. The rod 536 further comprises one or more beams 538 configured to connect inner sides of the opposite side walls 506, 508, 510, 512; and one or more poles 540 configured to connect inner sides of the bottom 502 and the cover 504. Similar to the structural panel 202, 252, 302, 352, the rod 536 optionally comprises metals or metal alloys (such as stainless steel, copper, bronze, brass or galvanized steel), plastics (such as polyethylene or polypropylene), composites (such as fiberglass reinforced plastics (FRP) or glass reinforced plastics (GRP)). In addition, the rod 536 is completely encapsulated by a lining 542 for resisting corrosion of the liquid 534. Accordingly, the lining 542 is either preformed or applied later on-site. The beam 538 and the pole 540 are arranged vertically to and thus support the side walls 506, 508, 510, 512 and the cover 504 respectively.

Figure 30:
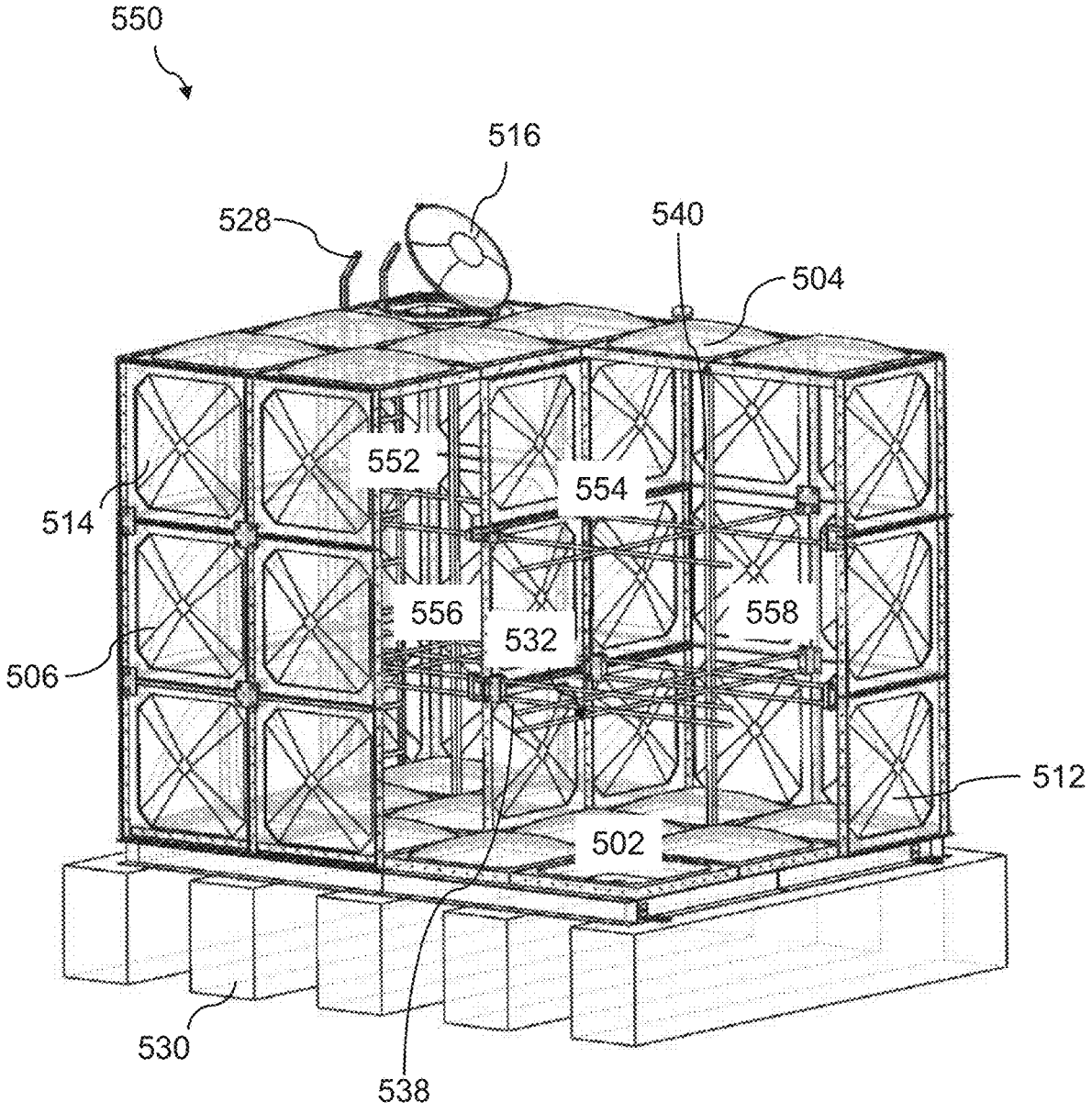
FIG. 30 illustrates a partially exploded view of a variant of the second sectional panel tank in FIG. 29.

FIG. 30 illustrates a partially exploded view of a variant 550 of the second sectional panel tank 500 in FIG. 29. The variant 550 has a similar structure with the second sectional panel tank 500 and thus features of the variant 550 herein are made references to the second sectional panel tank 500 illustrated in FIG. 29. In addition to the ladder 518, the variant 550 has a second ladder 552 inside the variant 550 for easily getting access into the bottom 502 of the variant 550 via the access hole 516. Furthermore, the variant 550 has a partition 554 for partitioning the variant 550 into two small tanks, i.e. a first tank 556 enclosed by the front wall 506, the rear wall 508, the left wall 510 and the partition 554; and a second tank 558 enclosed by the front wall 506, the rear wall 508, the right wall 510 and the partition 554.

Figure 31:
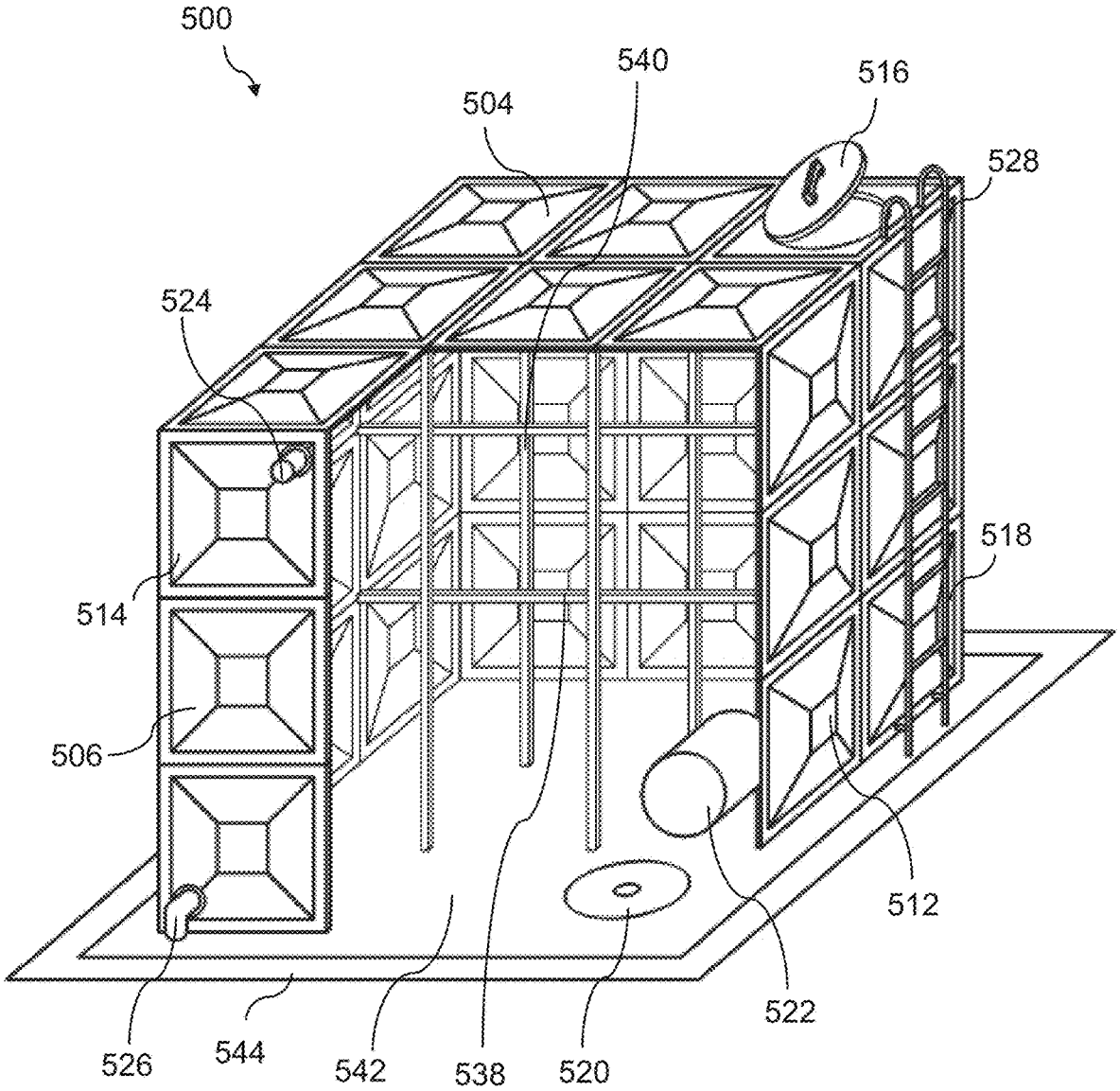
FIG. 31 illustrates a partially exploded view of the second sectional panel tank without an external foundation.

FIG. 31 illustrates a partially exploded view of the second sectional panel tank 500 without the external foundation 530. All features of the second sectional panel tank 500 are identical to those in FIG. 29, except that the bottom 502 is not needed. A compacted and flat soil plate 544 (not shown) is prepared from the ground; and then a piece of lining 542 is spread on the compacted and flat soil plate. The second sectional panel tank 500 is directly built on the lining 542 by erecting the side walls 506, 508, 510, 512 and the joining the cover 504 with the side walls 506, 508, 510, 512. This second sectional panel tank 500 in FIG. 31 is particularly used for oil storage and chemical waste treatment.

Figure 32:
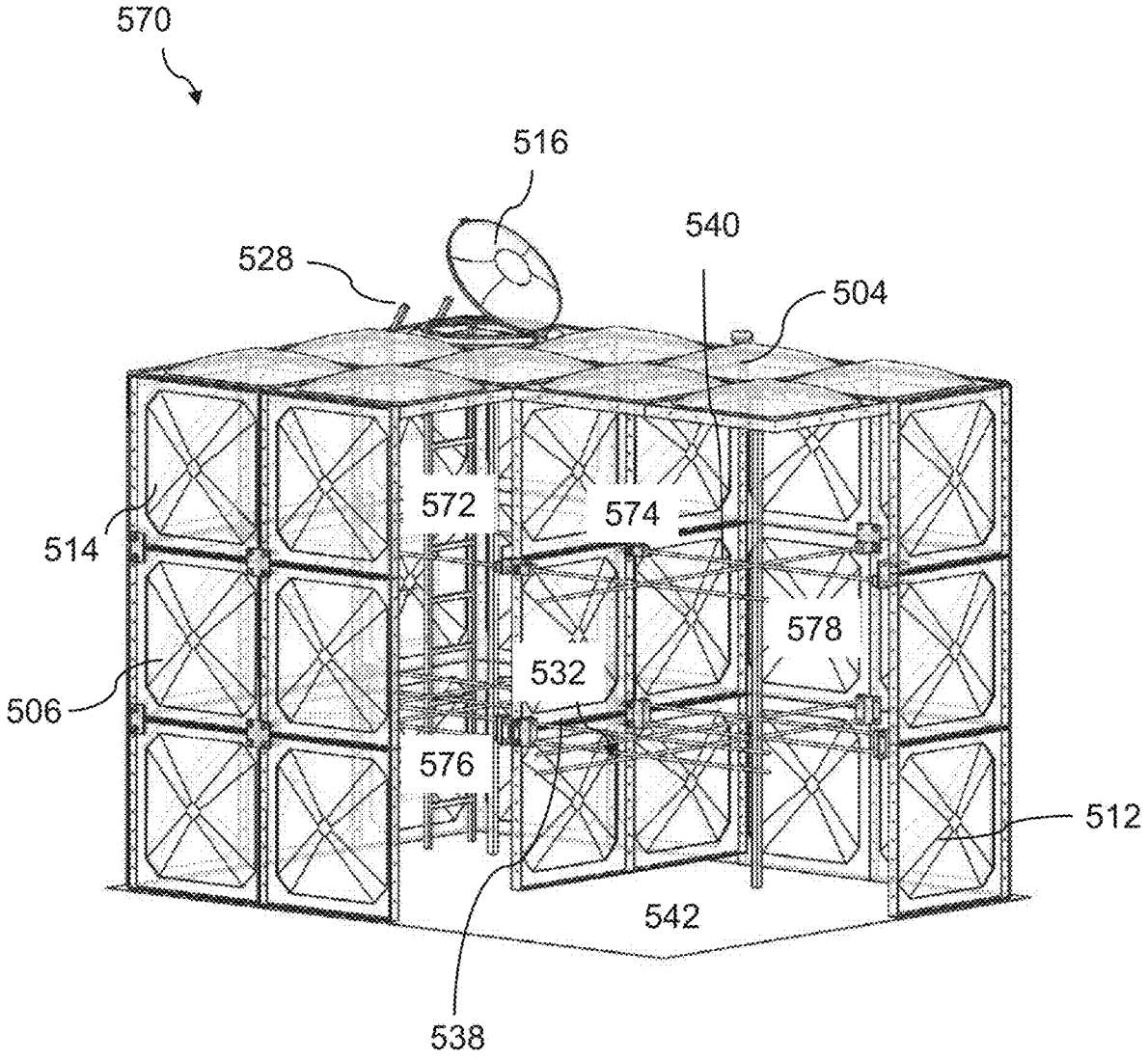
FIG. 32 illustrates a partially exploded view of a variant of the second sectional panel tank in FIG. 31.

FIG. 32 illustrates a partially exploded view of a variant 570 of the second sectional panel tank 550 in FIG. 30. The variant 570 has a similar structure with the second sectional panel tank 500 and thus features of the variant 570 herein are made references to the second sectional panel tank 500 illustrated in FIG. 31. In addition to the ladder 518, the variant 570 has a second ladder 572 inside the variant 570 for easily getting access into the lining 536 of the variant 570 via the access hole 516. Furthermore, the variant 570 has a partition 574 for partitioning the variant 570 into two small tanks, i.e. a first tank 576 enclosed by the front wall 506, the rear wall 508, the left wall 510 and the partition 574; and a second tank 578 enclosed by the front wall 506, the rear wall 508, the right wall 510 and the partition 574.

Figure 33:
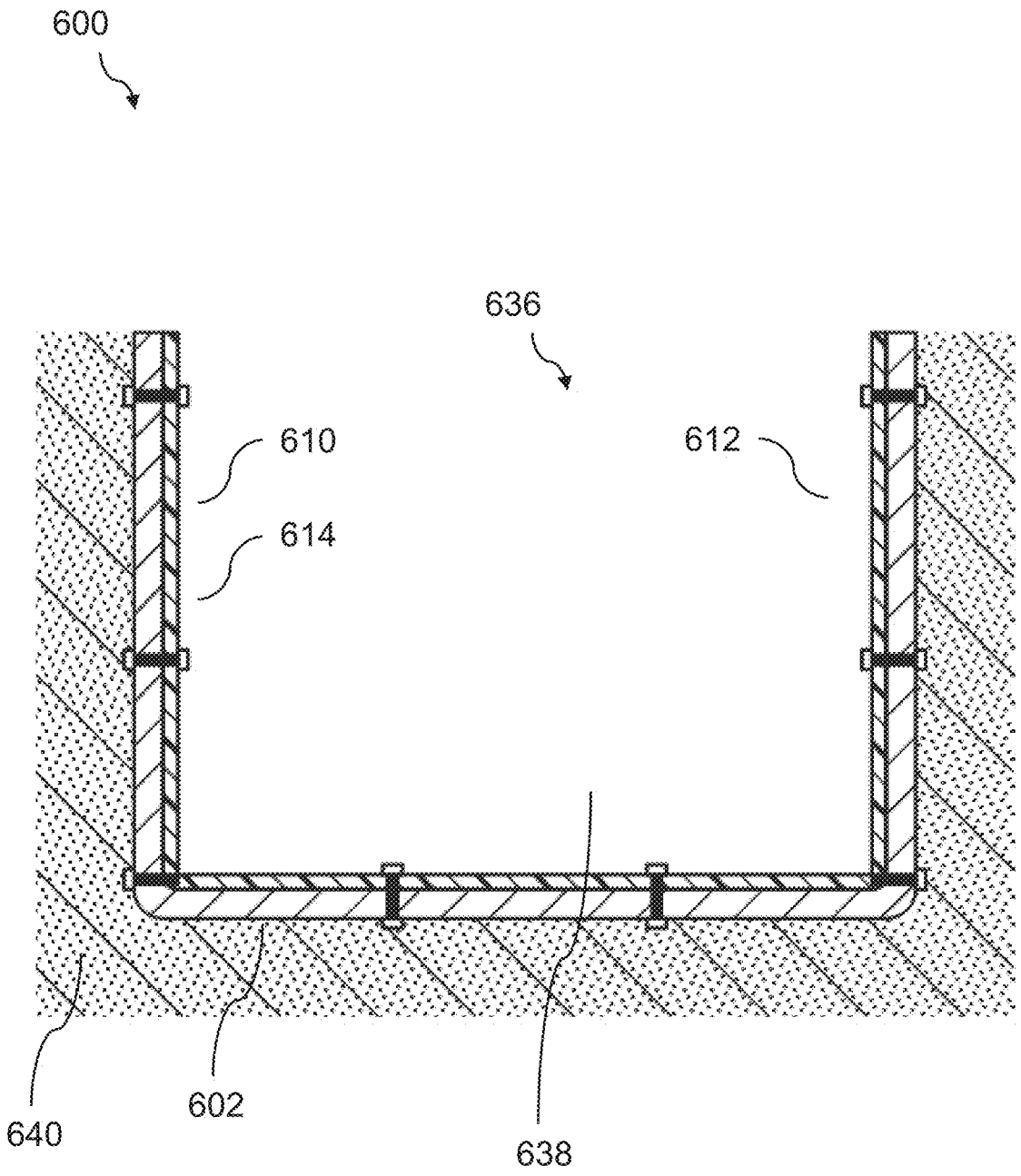
FIG. 33 illustrates a cross-sectional view of a third sectional panel tank.

FIG. 33 illustrates a cross-sectional view of a third sectional panel tank 600. The third sectional panel tank 600 shares some features of the first sectional panel tank 100, basically comprising a bottom 602, a cover 604 (not shown), a front wall 606 (not shown), a rear wall 608 (not shown), a left wall 610 and a right wall 612 that are built up by multiple unit panels 614. However, the sectional panel tank 600 is not an independent device that stands by itself, the bottom 602 and the four side walls 606, 608, 610, 612 are surrounded and supported by a facility 636. As shown in FIG. 33, the facility 636 comprises a hole 638 dug in a ground 640 of the earth. Since the ground 640 provides mechanical support to the bottom 602 and four side walls 606, 608, 610, 612, the unit panels 614 are loaded with less pressure from a liquid 634 (not shown) stored in the third sectional panel tank 600. Therefore, the third sectional panel tank 600 does not need additional features such as the external foundations 130, 530, the external framework 132 or the internal framework 532 and embossments 230, 280. Therefore, the third sectional panel 600 is less costly to build and maintain.

Figure 34:
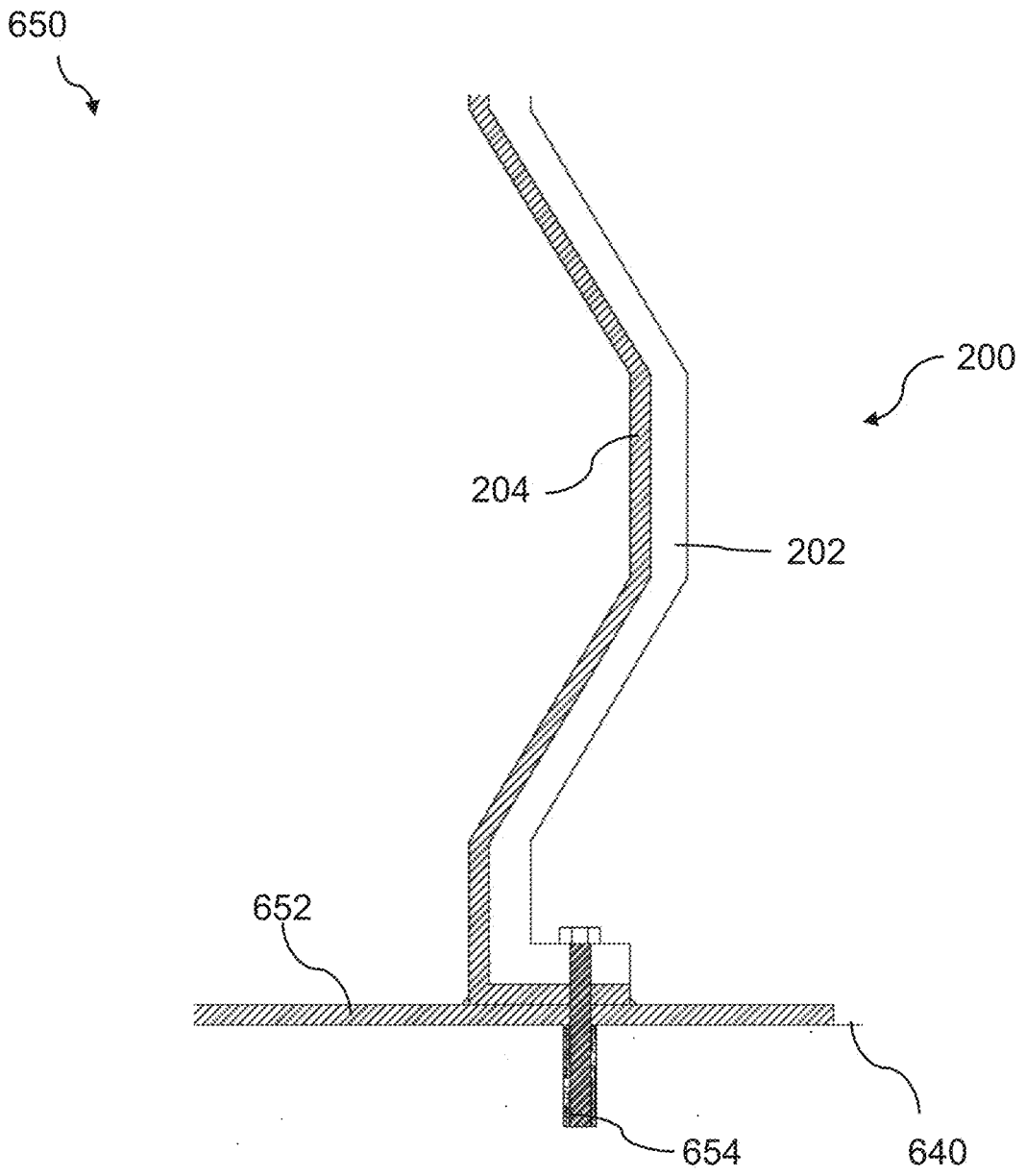
FIG. 34 illustrates an enlarged cross-sectional view of a variant of the third sectional panel tank.

FIG. 34 illustrates an enlarged cross-sectional view of a variant 650 of the third sectional panel tank 600. The variant 650 is construed by the multiple first unit panels 200. In contrast to the third sectional panel tank 600, the first unit panel 200 is secured to the ground 640 through a bottom lining 652 via the fastener 654.

Figure 35:
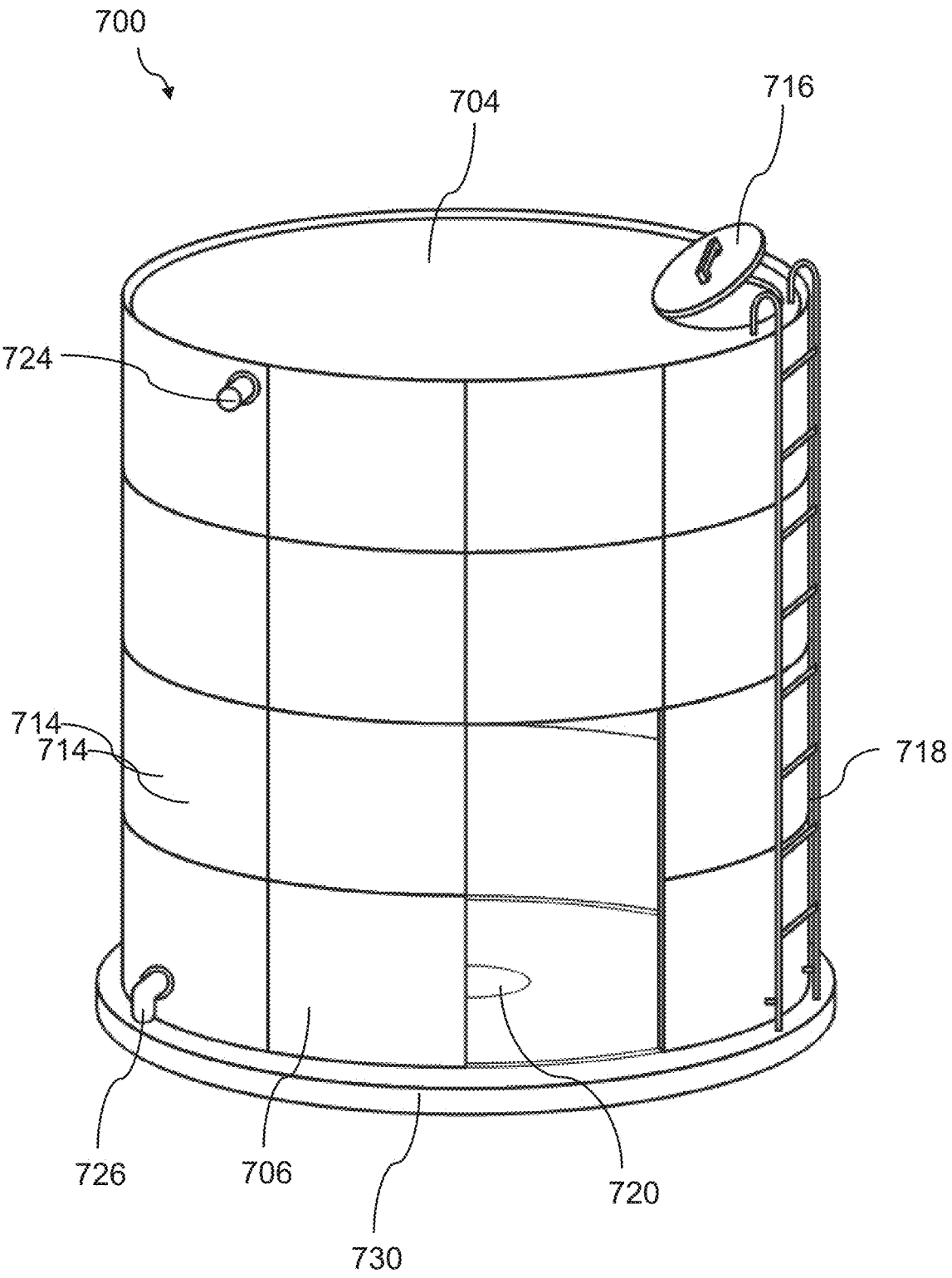
FIG. 35 illustrates a partially exploded view of a fourth sectional panel tank.

FIG. 35 illustrates a partially exploded view of a fourth sectional panel tank 700. In contrast to the sectional panel tanks 100, 500, 600 having a cubic dimension, the fourth sectional panel tank 700 has a cylindrical dimension. The fourth sectional panel tank 700 comprises a bottom 702 (not shown), a cover 704 and a side wall 706 that are assembled by multiple curved unit panels 714 shown in FIGS. 15 to 20. The fourth sectional panel 700 also comprises an access hole 716, a ladder 718, a drainage hole 720, a drainage tube 722 (not shown), an inlet 724, an outlet 726 and an external foundation 730. A liquid 734 (not shown) is stored inside the fourth sectional panel tank 700.

Figure 36:
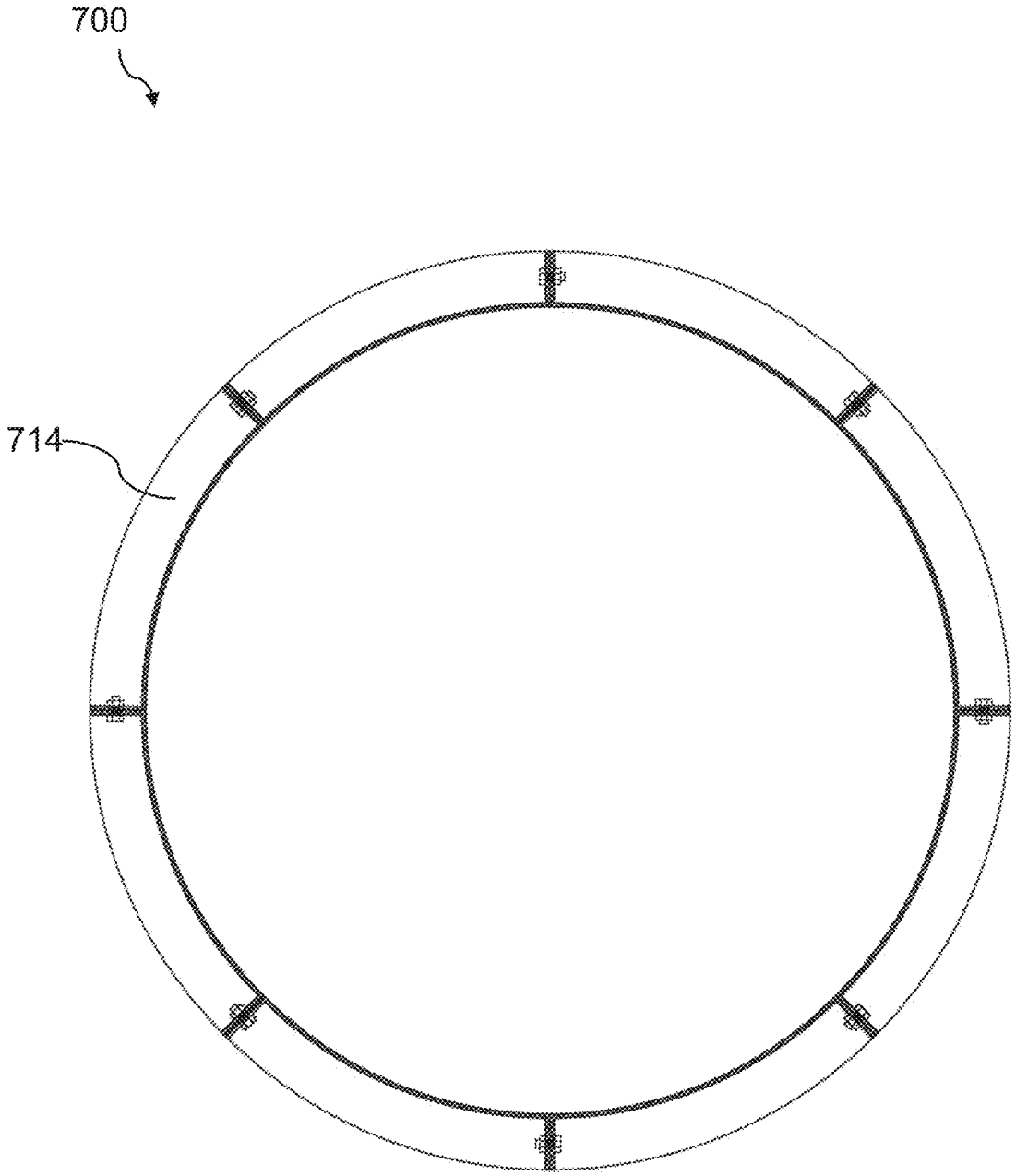
FIG. 36 illustrates a top view of the fourth sectional panel tank.

FIG. 36 illustrates a top view of the fourth sectional panel tank 700. It is clearly seen that the fourth sectional panel tank 700 is joined by multiple curved unit panels 714.

Figure 37:
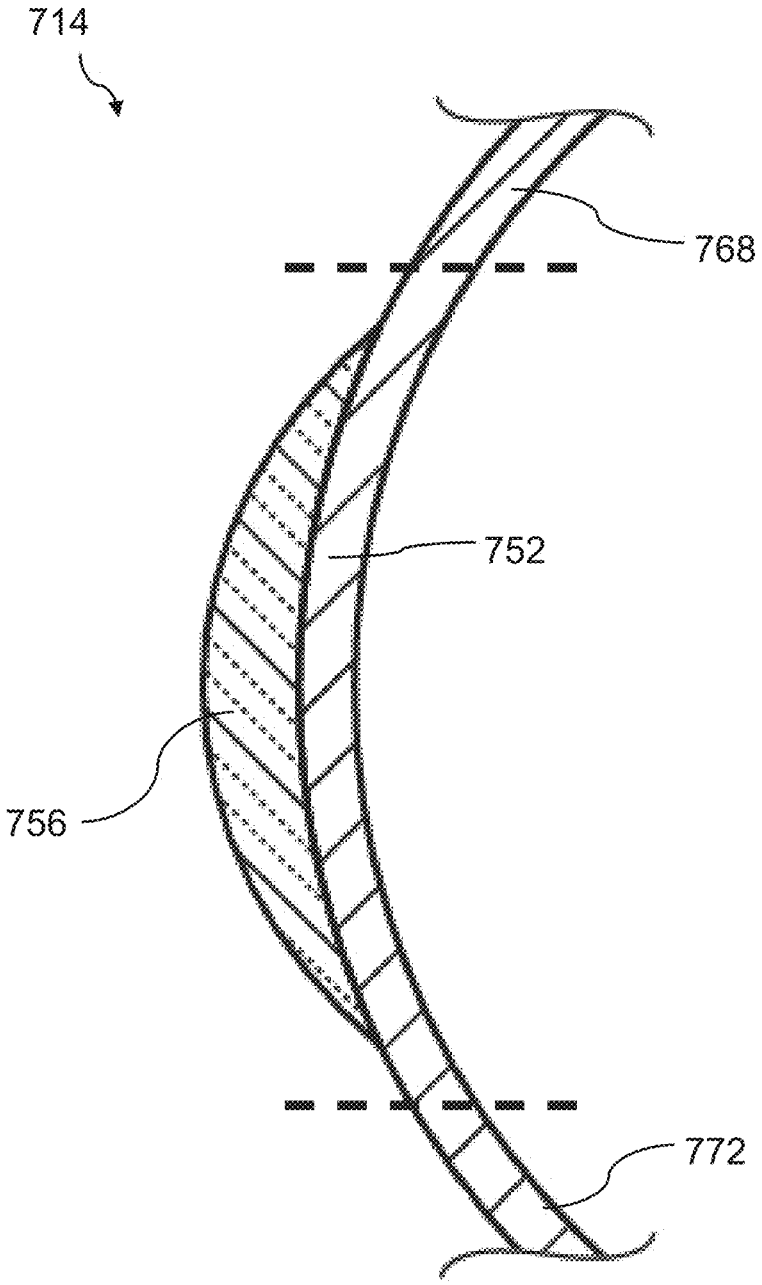
FIG. 37 illustrates a cross-sectional view of a curved unit panel.

FIG. 37 illustrates a perspective view and a cross-sectional view of the curved unit panel 714. The curved unit panel 714 further comprises a structural panel 752 and a thermal insulation layer 756 and an extension 758. In contrast to the extensions 208, 258, 308, 358, the extension 758 comprises four margins at four peripheral edges of the curved unit panel 714 respectively, i.e. a front margin 760 (not shown) at a front edge 762, a rear margin 764 (not shown) at a rear edge 766, a left margin 768 at a left edge 770, and a right margin 772 at a right edge 774. In particular, the four margins 760, 764, 768, 772 are not folded at an angle (such as 90 degrees) to the edges 762, 768, 770, 774 respectively. The structural panel 752 thus extends between the four margins 760, 764, 768, 772.

Figure 38:
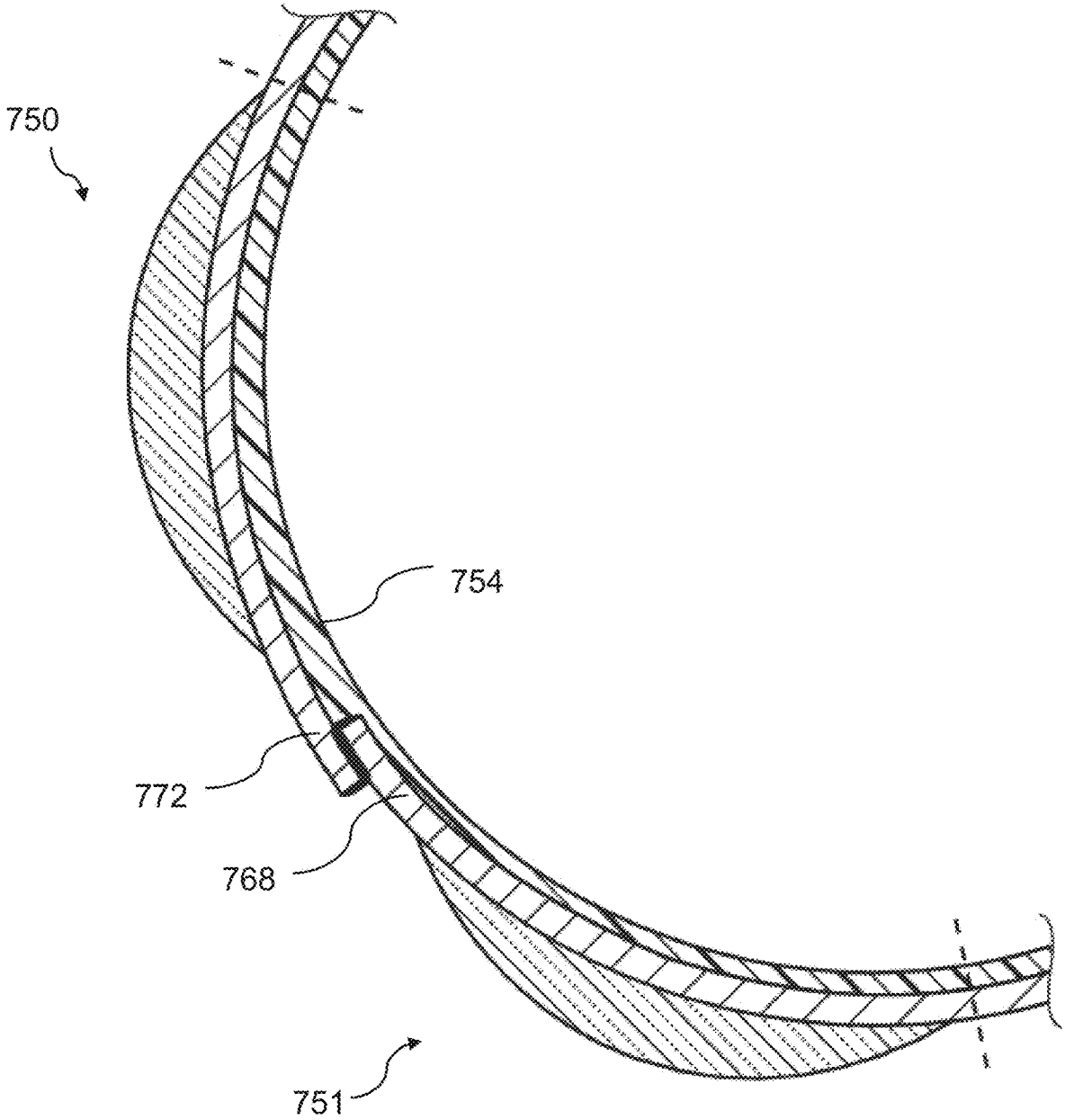
FIG. 38 illustrates a cross-sectional view of two unit panels of FIG. 37 joining together.

Two curved unit panels 714 are joined together. Similarly, more curved unit panels 714 are joined together for forming the fourth sectional panel tank 700. Alternatively, a single curved unit panel 714 can also join itself for forming a cylindrical component; and multiple cylindrical components are joined vertically together for forming the fourth sectional panel tank 700. FIG. 38 illustrates a cross-sectional view of two curved unit panels 714 joining together, i.e. a fifth unit panel 750 and a sixth unit panel 751. The right margin 772 of the fifth unit panel 750 and the left margin 768 of the sixth unit panel 752 are overlapped and joined together. A single and continuous lining 754 is then joined onto inner surfaces of the fifth unit panel 750 and the sixth unit panel 751.

Figure 39:
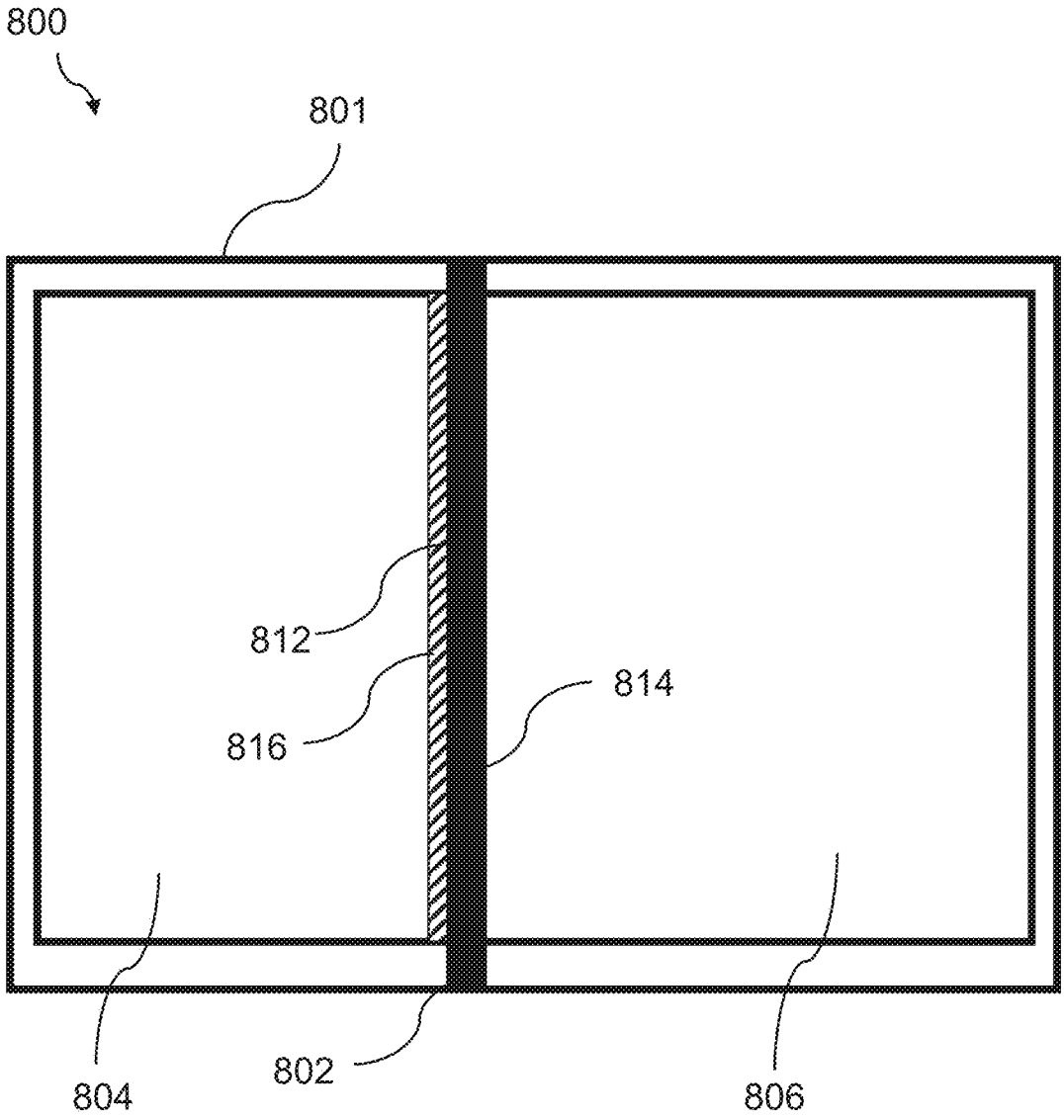
FIG. 39 illustrates a cross-sectional view of a partition tank using the unit panels of FIG. 3.

FIG. 39 illustrates a cross-sectional view of a partition tank 800 based on a sectional panel tank 801 described above, i.e. anyone of the sectional panel tanks 100, 500, 600, 700. The partition tank 800 is completely separated by a partition part 802 into a first sub-tank 804 and a second sub-tank 806. The first sub-tank 804 and the second sub-tank contain a first fluid 808 (not shown) and a second fluid 810 (not shown) respectively. In particular, the first fluid 808 and the second fluid 810 do not communicate through the partition part 802. The partition part 802 comprises a first side 812 and a second side 814 in contact with the first fluid 808 and the second fluid 810 respectively.

The partition part 802 is firstly assembled from the second side 814 by joining the first unit panel 200 and the second unit panel 250 together at the joint 290 between the first lining sheet 204 and the second lining sheet 254. The first and second unit panels 200, 250 are then further joined at the joint 290 from the first side 812 of the partition part 800. The partition part 800 finally further comprises an additional lining sheet 816 covering the first side 812, particular the joint 290. Therefore, the joint 290 is protected from the first side 812 by the additional lining sheet 816 and from the second side 814 by the first and second lining sheets 204, 254. In other words, the partition part 802 is protected from the first fluid 808 by the pre-formed lining sheets 204, 254 at the first side 812; and from the second fluid 810 by the post-formed additional lining sheet 816 after the partition part 800 is assembled from the first side 812.

Figure 40:
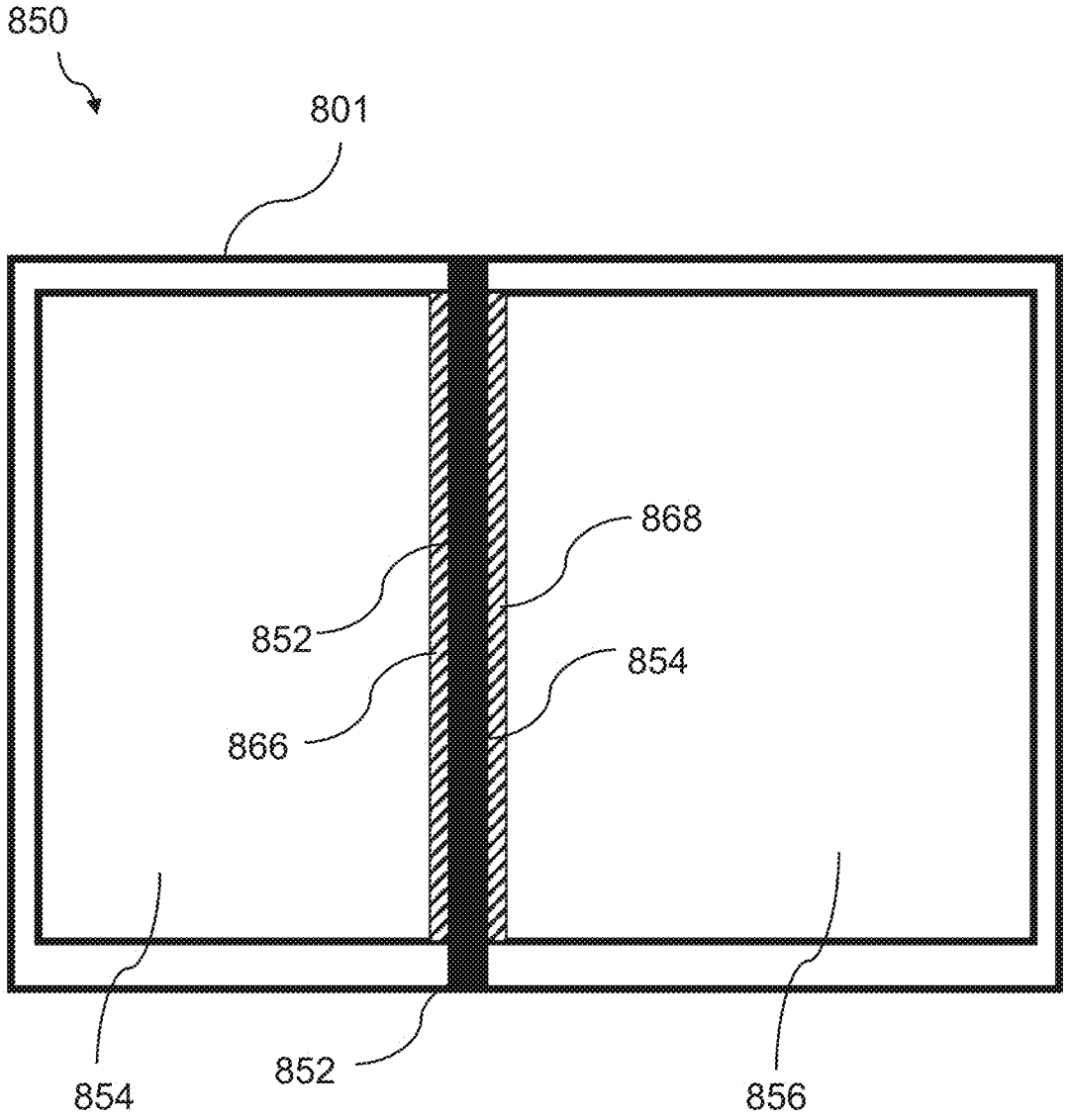
FIG. 40 illustrates a cross-sectional view of another partition tank using the unit panels of FIG. 10.

FIG. 40 illustrates a cross-sectional view of another partition tank 850 using the third unit panels 300 and the fourth unit panel 350 described in FIG. 27. Similar to the partition part 800, a partition part 852 is assembled for completely separating the partition tank 850 into a first sub-tank 854 and a second sub-tank 856 for containing a first fluid 858 and a second fluid 860 respectively. In contrast to the partition part 802, the partition part 852 is assembled by joining the third unit panel 300 and the fourth unit panel 350 at the joint 390 from both a first side 862 and a second side 864 of the partition part 852. The partition part 852 further comprises a first additional lining sheet 866 and a second additional lining sheet 868 for covering the first side 862 and the second side 864 respectively. In particular, the joint 390 is protected by the first and second lining sheets 866, 868 from the first side 862 and the second side 864 respectively. In other words, the partition part 852 is protected from the first fluid 858 and the second fluid 860 by the post-formed first and second additional lining sheets 866, 868 respectively after the partition part 850 is assembled.

Figure 41:
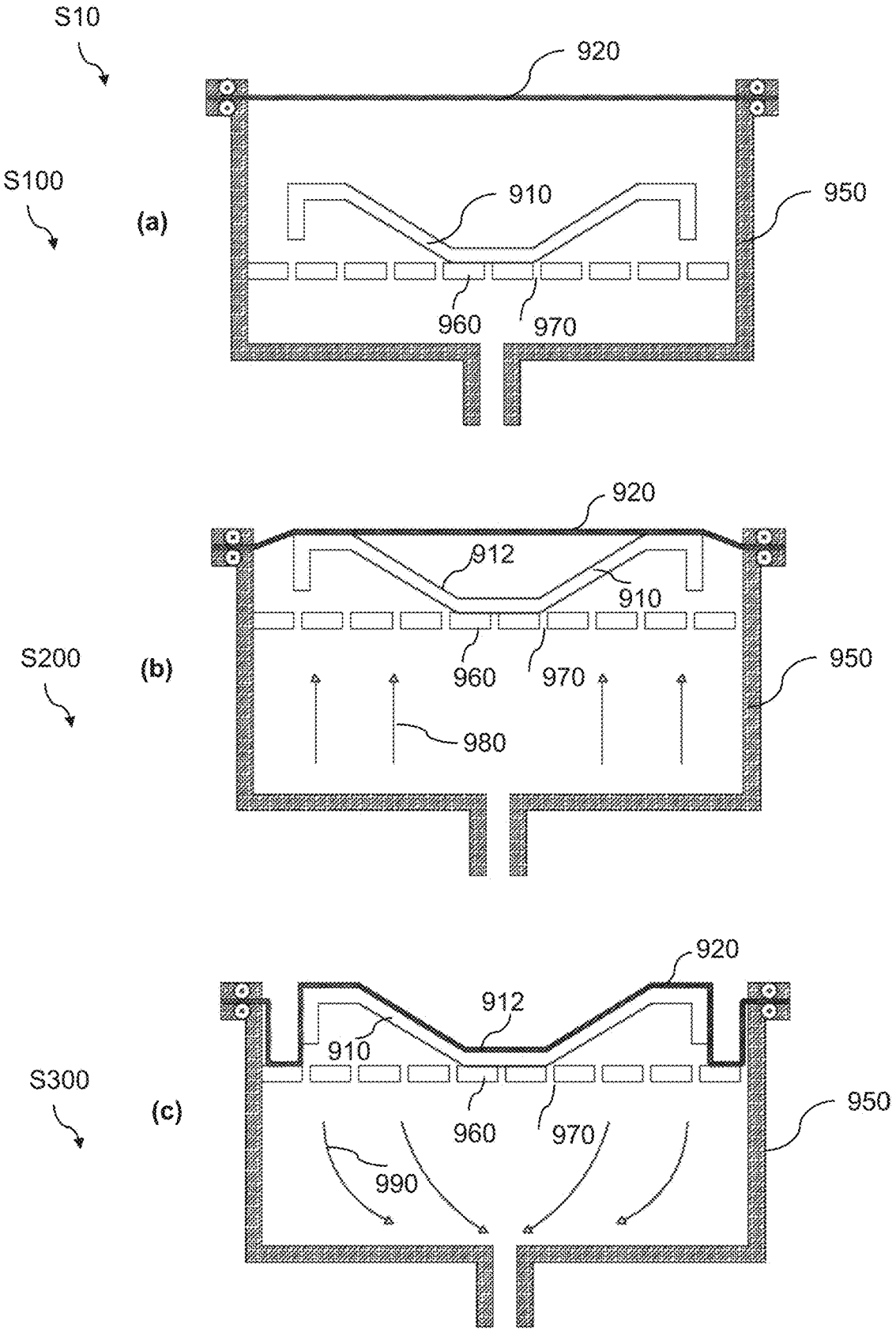
FIG. 41 illustrates a cross-sectional view of a vacuum forming process.

FIG. 41 illustrates a cross-sectional view of a vacuum forming process S10 for producing a prefabricated unit panel 900, including but not limited to any unit panel describe above. An exemplary vacuum forming process S10 is shown process the prefabricated unit panel 900. A structural panel 910 is placed into a vacuum chamber 950 before the vacuum forming process S10, The vacuum forming process S10 has a first step S100 (shown in FIG. 41(*a*)) of aligning a lining sheet 920 over the structural panel 910; a second step S200 (shown in FIG. 41(*b*)) of heating the lining sheet 920 to be pliable for deformation; and a third step S300 (shown in FIG. 41(*c*)) of forming the lining sheet 920 to an inner surface 912 of the structural panel 910 for bonding the lining sheet 920 and the structural panel 910 by a negative pressure. The negative pressure may be generated by any known apparatus or method, such as a vacuum pump which pumps air from the vacuum chamber 950 to an outside environment. A driving plate 960 is placed inside the vacuum chamber 950 for fixing and moving the structural panel 910 upwardly towards the lining sheet 920. In particular, the driving plate 960 has a plurality of orifices 970 for air to go through the driving plate 960. As shown by straight arrows 980 in FIG. 41(*b*), hot air goes upwardly through the orifices 970 to reach the lining sheet 920 for heating the lining sheet 920 to a predetermined temperature. The hot air is spread evenly through the orifices 970 for heating the lining sheet 920 more homogeneously. As shown by the curved arrows 990 in FIG. 41(*c*), the air inside the vacuuming chamber 950 is extracted outside for forming the negative pressure required for the vacuuming forming process.

In particular, the third step S300 further has a first procedure S310 of moving the structural panel 910 upwardly towards the lining sheet 920; a second procedure S320 of vacuum forming the lining sheet 920 to the structural panel 910 for transferring contours of the inner surface 912 of the structural panel 910 to the lining sheet 920; and a third procedure S330 of cooling the lining sheet 920 for crystalizing the contours to the lining sheet 920 and thus joining the structural panel 910 and the lining sheet 920 together.

In the application, unless specified otherwise, the terms "comprising", "comprise", and grammatical variants thereof, intended to represent "open" or "inclusive" language such that they include recited elements but also permit inclusion of additional, non-explicitly recited elements.

As used herein, the term "about", in the context of concentrations of components of the formulations, typically means+/−5% of the stated value, more typically +/−4% of the stated value, more typically +/−3% of the stated value, more typically, +/−2% of the stated value, even more typically +/−1% of the stated value, and even more typically +/−0.5% of the stated value.

Throughout this disclosure, certain embodiments may be disclosed in a range format. The description in range format is merely for convenience and brevity and should not be construed as an inflexible limitation on the scope of the disclosed ranges. Accordingly, the description of a range should be considered to have specifically disclosed all the possible sub-ranges as well as individual numerical values within that range. For example, description of a range such as from 1 to 6 should be considered to have specifically disclosed sub-ranges such as from 1 to 3, from 1 to 4, from 1 to 5, from 2 to 4, from 2 to 6, from 3 to 6 etc., as well as individual numbers within that range, for example, 1, 2, 3, 4, 5, and 6. This applies regardless of the breadth of the range.

It will be apparent that various other modifications and adaptations of the application will be apparent to the person skilled in the art after reading the foregoing disclosure without departing from the spirit and scope of the application and it is intended that all such modifications and adaptations come within the scope of the appended claims.

REFERENCE NUMERALS

100 first sectional panel tank;
102 bottom;
104 cover;
106 front wall;
108 rear wall (not shown);
110 left wall (not shown);
112 right wall;
114 unit panel;
116 access hole;
118 ladder;
120 drainage hole;
122 drainage tube;
124 inlet;
126 outlet;
128 top end of the ladder;
130 external foundation;
132 external framework;
134 liquid (not shown);
136 lining;
138 edge of the sectional panel tank;
150 variant of the first sectional panel tank;
152 second ladder;
154 partition;
156 first tank;
158 second tank;
170 variant of the first sectional panel tank;
172 second ladder;
174 partition;
176 first tank;
178 second tank;
200 first unit panel;
202 first structural panel;
204 first lining sheet;
206 first thermal insulation layer;
208 first extension;
210 first front flange;
212 first front edge;
214 first rear flange;
216 first rear edge;
218 first left flange;
220 first left edge;
222 first right flange;
224 first right edge;
226 inner surface (of the first structural panel);
228 external surface (of the first structural panel);
230 first embossment;
235 fastener;
240 stud;
242 first side (of the first lining sheet);
244 second (side of the first lining sheet);
246 gap;
248 filler;
250 second unit panel;
252 second structural panel;
254 second lining sheet;
256 second thermal insulation layer;
258 second extension;
260 second front flange;
262 second front edge;
264 second rear flange;
266 second rear edge;
268 second left flange;
270 second left edge;
272 second right flange;
274 second right edge;
276 inner surface (of the second unit panel);
278 external surface (of the second unit panel);
280 second embossment;
290 joint;
292 seam;
294 jointer;
296 first layer (of the lining sheet);
297 first thickness;
298 second layer of the lining sheet;
299 second thickness;
2000 variant of the first unit panel;
2100 variant of the first unit panel;
2150 second variant of the first unit panel;
2200 variant of the first unit panel;
2300 variant of the first unit panel;
2400 modification to the variant 2100;
2500 modification to the variant 2200;
2600 modification to the first unit panel;
2610 adhesive layer;
2700 third unit panel;
2710 joint;
2730 fastener;
2800 planar unit panel;
2810 planar structural panel;
2820 planar lining sheet;
2830 left end;
2840 joint;
2850 fastener;
3000 curved unit panel;
3002 curved structural panel;
3004 curved lining sheet;
3006 curved thermal insulation layer;
3008 inner surface (of the curved structural panel);
3010 external surface (of the curved structural panel);
3012 front edge;
3014 rear edge;

3016 left edge;
3018 right edge;
3020 extension;
3022 front flange;
3024 rear flange;
3026 left flange;
3028 right flange;
3040 first curved unit panel;
3050 second curved unit panel;
3052 second structural panel;
3054 second lining sheet;
3056 second thermal insulation layer;
3058 second inner surface (of the second structural panel);
3060 second external surface (of the second structural pane
3062 second front edge;
3064 second rear edge;
3066 second left edge (not shown);
3068 second right edge (not shown);
3070 second extension;
3072 second front flange;
3074 second rear flange;
3076 second left flange (not shown);
3078 second right flange (not shown);
3090 joint;
3092 seam;
3094 jointer;
3096 fastener;
3100 first variant of the curved structural panel;
3150 second variant of the curved structural panel;
3200 first variant of the curved structural panel;
3250 second variant of the curved structural panel;
3300 first modification of the curved structural panel;
3310 first studs;
3320 first gap;
3330 first filler;
3340 first adhesive layer;
3350 second modification of the curved structural panel;
3360 second studs;
3370 second gap;
3380 second filler;
3390 second adhesive layer;
3400 first modification of the curved structural panel;
3450 second modification of the curved structural panel;
300 third unit panel;
302 third structural panel;
306 third thermal insulation layer;
308 third extension;
310 third front flange;
312 third front edge;
314 third rear flange;
316 third rear edge;
318 third left flange;
320 third left edge;
322 third right flange;
324 third right edge;
326 inner surface of the third unit panel;
330 adhesive;
340 lining;
350 fourth unit panel;
352 fourth structural panel;
354 fourth lining sheet;
356 fourth thermal insulation layer;
358 fourth extension;
360 fourth front flange;
362 fourth front edge;
364 fourth rear flange;
366 fourth rear edge;
368 fourth left flange;
370 fourth left edge;
372 fourth right flange;
374 fourth right edge;
376 inner surface of the fourth unit panel;
390 joint;
392 seam;
394 welding solder;
396 first layer of the lining;
398 second layer of the lining;
400 bent unit panel;
402 bent portion;
404 first portion;
406 second portion;
500 second sectional panel tank;
502 bottom;
504 cover;
506 front wall;
508 rear wall (not shown);
510 left wall (not shown);
512 right wall;
514 unit panel;
516 access hole;
518 ladder;
520 drainage hole;
522 drainage tube;
524 inlet;
526 outlet;
528 top end of the ladder;
530 external foundation;
532 internal framework;
534 liquid (not shown);
536 rod;
538 beam;
540 pole;
542 lining;
544 soil plate;
550 variant of the second sectional panel tank;
552 second ladder;
554 partition;
556 first thank;
558 second tank;
570 variant of the first sectional panel tank;
572 second ladder;
574 partition;
576 first tank;
578 second tank;
600 third sectional panel tank;
602 bottom;
604 cover;
606 front wall;
608 rear wall;
610 left wall;
612 right wall;
614 unit panel;
634 liquid;
636 facility;
638 hole;
640 ground;
650 variant of the third sectional panel tank;
652 bottom lining;
654 fastener;
700 fourth sectional panel tank;
702 bottom;
704 cover;

706 side wall;
714 curved unit panel;
716 access hole;
718 ladder;
720 drainage hole;
722 drainage tube;
724 inlet;
726 outlet;
728 top end of the ladder;
730 external foundation;
734 liquid;
750 fifth unit panel;
751 sixth unit panel;
752 structural panel;
754 lining;
756 thermal insulation layer;
758 extension;
760 front margin;
762 front edge;
764 rear margin;
766 rear edge;
768 left margin;
772 right margin;
774 right edge;
800 partition tank;
801 sectional panel tank;
802 partition part;
804 first sub-tank;
806 second sub-tank;
808 first fluid;
810 second fluid;
812 first side of the partition part;
814 second side of the partition part;
816 additional lining sheet;
850 partition tank;
852 partition part;
854 first sub-tank;
856 second sub-tank;
858 first fluid;
860 second fluid;
862 first side;
864 second side;
866 first additional lining sheet;
868 second additional lining sheet;
900 prefabricated unit panel;
910 structural panel;
912 inner surface of the prefabricated unit panel;
920 lining sheet;
950 vacuum chamber;
960 driving plate;
970 orifices;
980 straight arrow;
990 curved arrow;
S10 vacuum forming process;
S100 first step;
S200 second step;
S300 third step;
S310 first procedure;
S320 second procedure;
S330 third procedure;

The invention claimed is:

1. A sectional panel tank, comprising:

at least one side wall for joining other side walls in forming the sectional panel tank;

wherein the at least one side wall comprises:

a first unit panel having a first extension at its edge for supporting the first unit panel;

a second unit panel having a second extension at its edge;

at least one lining attached onto an inner side of the first unit panel for preventing corrosion of the first unit panel; and a jointer applied at a seam on inner sides of the first unit panel and the second unit panel of the sectional panel tank to bridge a gap between neighboring unit panels and form a continuous surface impermeable to solid, liquid or gas;

wherein the first unit panel and the second unit panel are joined together contiguously at the first extension and the second extension by at least one fastener.

2. The sectional panel tank of claim 1, wherein the at least one lining comprises a thermoplastic material.

3. The sectional panel tank of claim 1, wherein the at least one lining comprises a bonding layer for fixing the at least one lining onto the first unit panel securely.

4. The sectional panel tank of claim 1, wherein the at least one lining comprises a first layer of a first colour and a second layer of a second colour.

5. The sectional panel tank of claim 1, wherein an external side of the first unit panel is treated for being substantially reflective.

6. The sectional panel tank of claim 1, wherein the first unit panel is made of impermeable, corrosion resistive and/or structurally robust material.

7. The sectional panel tank of claim 1, further comprising a framework that is connected to the first unit panel, the second unit panel or both for upholding structural integrity of the sectional panel tank.

8. The sectional panel tank of claim 1, further comprising at least one sensor, a communication module, or a combination of these for monitoring operation status of the sectional panel tank.

9. The sectional panel tank of claim 1, further comprising a cross connector configured to join corners of neighbouring unit panels together.

10. The sectional panel tank of claim 1, further comprising a bottom having a bottom extension, the bottom and the at least one side wall being directly joined at the bottom extension; and a bottom jointer applied at a bottom seam between the bottom extension and the at least one side wall.

11. The sectional panel tank of claim 1, further comprising a securing means for securing the first extension and the second extension together.

12. The sectional panel tank of claim 10, wherein the first securing means and the second securing means comprise a first coating and a second coating respectively, the first coating and the second coating are compatible with the lining for avoiding a leakage.

13. The sectional panel tank of claim 11, further comprising a fixture for joining the first extension and the second extension.

14. A prefabricated unit panel for constructing the sectional panel tank of claim 1, comprising a structural panel having an extension; and a lining sheet preformed on an inner side of the structural panel for covering the structural panel.

15. The prefabricated unit panel of claim 14, wherein the lining sheet comprises a thermoplastic material.

16. The prefabricated unit panel of claim 14, wherein the lining sheet comprises a first layer of a first colour and a second layer of a second colour.

17. The prefabricated unit panel of claim 14, wherein the extension comprises an engagement hole for receiving a securing means.

18. The prefabricated unit panel of claim 14, wherein the lining sheet comprises a through hole matching the engagement hole.

19. A method of making a side wall for a sectional panel tank of claim 1, comprising:

providing a first unit panel having an extension at its edge as a first extension;

providing a second unit panel having an extension at its edge as a second extension;

directly joining the first unit panel and the second unit panel together via a securing means at the first extension and the second extension; and applying a jointer at a seam between the first extension and the second extension on inner sides of the first unit panel and the second unit panel.

20. The method of claim 19, comprising attaching a lining onto the inner sides.

21. The method of claim 20, wherein the attaching the lining comprise a thermoforming process.

22. The method of claim 19, wherein applying the jointer by a thermoplastic welding process.

23. The method of claim 22, wherein the thermoplastic welding process is conducted by a mechanical welding means, a thermal welding means, an electromagnetic welding means, a chemical welding means or a combination of any of these.

24. A method of making a prefabricated unit panel for the sectional panel tank of claim 1, the method comprising providing a structural panel having an extension;

providing a lining sheet substantially larger than the structural panel; and attaching the lining sheet onto an inner side of the structural panel;

wherein the lining sheet covers the extension of the structural panel substantially.

25. The method of claim 24, further comprising attaching a thermal insulation layer onto an external side of the structural panel for reducing temperature fluctuation.

26. The method of claim 25, wherein the attaching step comprises a thermoforming process for bonding the lining sheet and the structural panel tightly into a unitary component.

27. The method of claim 26, wherein the thermoforming process comprises a vacuum forming process.

28. The method of claim 27, wherein the vacuum forming process comprises aligning the lining sheet over the inner side of the structural panel;

heating the lining sheet to be pliable for deformation; and forming the lining sheet to the inner side for bonding the lining sheet and the structural panel by a negative pressure.

29. The method of claim 27, further comprising applying a thermal insulation layer between the lining sheet and the inner side of the structural panel.

30. The method of claim 19, wherein the jointer is applied by a solvent welding method.

* * * * *